US008936830B2

(12) United States Patent
Kim

(10) Patent No.: US 8,936,830 B2
(45) Date of Patent: Jan. 20, 2015

(54) APPARATUS AND METHOD FOR CONTINUOUS POWDER COATING

(71) Applicant: FEMVIX Co. Ltd., Seongnam-si (KR)

(72) Inventor: Ok Ryul Kim, Yongin-si (KR)

(73) Assignees: FEMVIX Corp., Jung-dong, Giheung-gu, Yongin-si, Gyeonggi-do (KR); Ok Ryul Kim, Gongse-dong, Giheung-gu, Yongin-si, Gyeonggi-do (KR); Ok Min Kim, Geumgok-ri, Jinjeop-eup, Namyangju-si, Gyeonggi-do (KR)

( * ) Notice: Subject to any disclaimer, the term of this patent is extended or adjusted under 35 U.S.C. 154(b) by 0 days.

(21) Appl. No.: 13/764,670

(22) Filed: Feb. 11, 2013

(65) Prior Publication Data

US 2013/0149471 A1 Jun. 13, 2013

Related U.S. Application Data

(62) Division of application No. 12/999,058, filed on Dec. 14, 2010.

(51) Int. Cl.
*B05D 1/12* (2006.01)
*C23C 24/04* (2006.01)

(52) U.S. Cl.
CPC ..... *B05D 1/12* (2013.01)
USPC ..... 427/190; 427/294; 427/421.1

(58) Field of Classification Search
USPC ..... 427/190, 294, 421.1
See application file for complete search history.

(56) References Cited

U.S. PATENT DOCUMENTS

2007/0074656 A1* 4/2007 Zhao et al. ..... 118/308
2007/0160769 A1* 7/2007 Maev et al. ..... 427/446

* cited by examiner

*Primary Examiner* — Frederick Parker
(74) *Attorney, Agent, or Firm* — John K. Park; Park Law Firm

(57) ABSTRACT

The present invention relates to a method and an apparatus by which powder is evenly dispersed and is coated on a substrate uniformly and continuously so that a uniform layer may be formed. More specifically the present invention provides a method and an apparatus for forming a coating layer that powder is coated on an entire surface of a substrate uniformly and continuously, regardless of the material or the size of the substrate, as a uniform amount of powder entrained on the carrier air which is generated by carrier air and powder transported to a carrier pipe at a certain rate is consistently fed in to a nozzle, regardless of the size, morphology, and specific weight of the powder particles.

10 Claims, 27 Drawing Sheets

APPARATUS AND METHOD FOR CONTINUOUS POWDER COATING

FIELD OF THE INVENTION

The present invention relates to a method and an apparatus that coat solid powder on the substrates such as plastics, glasses, alloys, metals, ceramics, etc. continuously and uniformly by spraying powder entrained on carrier air regardless of the size, morphology, and specific weight of the powder.

DESCRIPTION OF THE PRIOR ARTS

The conventional coatings spraying the powder on a substrate have been affected by the size, the specific weight, heat treatment of the powder and temperature of the substrate (high temperature, low temperature, or room temperature), degree of vacuum, and velocity of the sprayed particles, etc. And all of these factors have a vital effect on productivity and economics of the coating. The powder refers to the solid powder of plastics, glasses, alloys, metals, semimetals, ceramics, and composites.

Conventional Coatings

1) Thermal Spraying

Generally, thermal spraying coats a surface with the powder melted by plasma, arc, or combustion flame. In the coating process, the temperature of plasma or combustion flame reaches 3,000K to 15,000K which depends on the kind of thermal spraying process. The size of a particle is more than dozens of micrometers. Thermal spraying can make a thick coating layer in a short time, but this coating process using the high temperature results in several problems such as containing voids and cracks inside the coated layer, deteriorating chemical property of the powder, shaping amorphous phase, weakening the adhesion strength between the substrate and the coated layer due to the high temperature and rapid cooling time. Besides, the surface of the layer is rough and it is hard to control thickness of the coated layer.

2) Electrospray Coating

Electrospray coating deposits the particles between nanometer and sub-micrometer on the substrate at the vacuum under $10^{-4}$ torr by electrostatic acceleration occurring between two electrodes. Deficiency of this technique is that the particles being charged electrically such as carbon or metal powder can be only coated, but the ceramic particles cannot.

3) Cold Spray

Cold spray technique is similar to one of the thermal spray, but it does not use high temperature gas or plasma as the thermal spray does. It deposits metal particles more than about 100 μm on the substrate by using gas with the appropriate temperature which does not melt the powder. Velocity of the gas ejected from the nozzle in cold spray is supersonic, more than 500 m/s. The particles are coated as being deformed plastically by the kinetic energy caused by the velocity of gas and heat of gas when they collide with a substrate.

The weakness of cold spray is that particles are not coated because their velocity decreases by the aerodynamic drag occurring after gas impinges upon the substrate.

U.S. Pat. No. 5,302,414 ("Gas-dynamic spraying method for applying a coating"), the origin of cold spray, states that the technique relates to coating metal, the particles (1~50 micrometers) of alloy, or polymer powder on a substrate by spraying them entrained on carrier gas (40~400° C.) at a speed of 300~1,200 m/s. The advantage of the technique is that unlike thermal spraying needing the high temperature, it is possible to coat a substrate at the relatively lower temperature than thermal spraying and therefore to decrease thermal shock on a substrate. But as mentioned above, its deficiency is that there is difficulty coating a substrate with powder because of the aerodynamic drag. And the technique has a problem depositing ceramic powder since it is not deformed plastically, unlike metal powder. Accordingly, the efficiency of coating declines considerably even if coating is possible.

Korea Pat. No. 10-0691161 ("Fabrication method of field emitter electrode") relates to the method fabricating the field emitter electrode with carbon nanotube powder by cold spray. But it also failed to overcome the problems shown from cold spray.

4) Gas Deposition

In Japanese Journal of Applied Physics 23, L910 (1984), Seiichiro Kashu et al. introduced this method. It has an aerosol chamber that mixes metal or ceramic powder (about 100 nm particles) with carrier gas and transports the mixed powder to the deposition chamber. Gas deposition that affected aerosol deposition of Jun Akedo makes metal or ceramic powder into an aerosol by gas agitation and ejects the aerosol through a nozzle. And when the particles impinge on a substrate, they are deposited on the substrate through sintering between the particles and between the particles and the substrate as the kinetic energy of the particles converts into thermal energy.

5) Aerosol Deposition

As Jun Akedo improved gas deposition, he made it possible to fabricate a variety of thin layers. [FIG. 1] shows a representative diagram illustrating aerosol deposition. It is a basic principle of aerosol deposition that carrier gas flows into the aerosol chamber containing powder and the powder and the gas are mixed and formed into the aerosol which is transported to the deposition chamber by the difference of pressure between the aerosol chamber and the deposition chamber and then the powder is deposited on a substrate by being blown through a nozzle in the vacuum deposition chamber.

Korea Pat. No. 10-0724070 ("Composite structured material and method for preparation thereof and apparatus for preparation thereof"; PCT/JP2000/007076) and Korea Pat. No. 10-0767395 ("Composite structured material" PCT/JP2000/007076) relate to the technique that applies the aerosol deposition method shown in [FIG. 1] to coating. Korea Pat. No. 10-531165 ("Method and apparatus for carbon fiber fixed on a substrate"; U.S. Pat. No. 7,306,503 ("Method and apparatus of fixing carbon fibers on a substrate using an aerosol deposition process")) has disclosed that in addition to a basic principle of aerosol deposition, the aerosol chamber can directly generate carbon nanotubes inside it and therefore reduce costs. The carbon nanotubes generated in the aerosol chamber are mixed with gas and transported to a deposition chamber to be deposited on a substrate by a nozzle. The technique was applied to form a thin layer which was expected to be as good as a thin metal layer. But it was not successful since it was not possible to make a thin layer with uniformity and low sheet resistance by the aerosol deposition technique. The shape of a carbon nanotube particle is very different from one of a metal particle. It is a tube type and has a peculiar aspect ratio of diameter (dozens of nanometers) to length (dozens of micrometers), 500~1.000 fold, which is completely different from a metal particle. And the carbon nanotube powder shows an agglomerate state by a Van der Waals force and an entangled state by a high molecule chain. These properties of the carbon nanotubes have been the obstacle to manufacturing commercialized large size products which absolutely need uniform coating.

Korea Pat. No. 10-846148 ("Deposition method using powder material and device thereby") relates to the technique applying aerosol deposition which coats a thin layer at room temperature by keeping the adequate pressure enough to accelerate the velocity of particles inside the deposition chamber. But there is a problem coating continuously and uniformly because when adjusting the pressure to get necessary pressure, velocity of powder changes which means that there is difficulty getting a uniform coating layer. The aerosol chamber has a filter or a windmill to disperse the entangled powder, but it could produce the opposite effect on dispersion and the filter could make the flow rate of carrier gas worse. It results in unsteady feeding of powder and being not able to form a uniform coating layer.

Korea Pat. No, 10-0818188 ("Highly efficient powder dispersion apparatus for aerosol deposition") relates to a technique developed to solve a problem with regard to dispersing powder. It tried to disperse powder more efficiently than the previous methods by shaking the aerosol chamber up and down and spinning it simultaneously. But it has no effect on dispersing the powder such as carbon nanotubes and cannot solve the problem of uniformity when coating a large size substrate. Furthermore, there is another problem generating high heat because of high sheet resistance of the unevenly coated substrate when transmitting an electrical current.

In the technique disclosed in Korea Pat. No. 10-0724070 ("Composite structured material and method for preparation thereof and apparatus for preparation thereof"; PCT/JP2000/007076), microwave or supersonic wave was beamed on aerosol to make particles dispersed smoothly and uniformly, but its effect on dispersion was not satisfactory, especially in the case of carbon nanotube powder.

In the arts disclosed in Japanese Unexamined Patent Publication No. HEI 8-81774, Japanese Unexamined Patent Publication No. HEI 10-202171, and Japanese Unexamined Patent Publication No. HEI 11-21677, additional heating processes such as resistance wire heating, electron beam heating, high-frequency induction heating, sputtering, and plasma were applied for the better deposition. In a similar way, Korea Pat. No. 10-0695046 ("Method for forming ultra fine particle brittle material at low temperature and ultra fine particle brittle material for use therein"; PCT/JP2003/006640) showed a technique doing heat treatment to make a crystal grain diameter reduced after coating a substrate with the mechanical impact force by an aerosol deposition method.

As described above, a conventional aerosol deposition apparatus shown in [FIG. 1] largely consists of an aerosol chamber and a deposition chamber. Aerosol in the aerosol chamber is formed by mixing the powder inside the chamber with carrier gas flown into it. The aerosol generated in the aerosol chamber is transported into the deposition chamber by the difference of pressure between two chambers and emitted through a nozzle and coated on a substrate. But it is very hard to make a uniform thin layer by a conventional aerosol deposition because of a problem controlling the amount of the transported aerosol. It is a serious problem of the aerosol deposition.

Another weakness of the aerosol deposition is keeping the deposition chamber at a high vacuumed state to get the powder deposited well by raising the velocity of aerosol which means that it takes a long time to prepare for coating.

On the other hand, as shown [FIG. 5], generally powder is injected into a pressure pipe under a pressure ($P_1$) more than atmospheric pressure (1 bar) by a higher pressure ($P_2$) than the pressure ($P_1$) inside the pipe in order that powder does not flow backward. Consequently, a powder feeder that can inject powder in a pressure pipe transporting carrier gas of higher pressure ($P_1$) than atmospheric pressure needs to be invented.

The followings are prior arts to inject powder in a pressure pipe transporting carrier gas of higher pressure than atmospheric pressure.

1) U.S. Pat. No. 5,302,414 ("Gas-dynamic spraying method for applying a coating") relates to a spraying technique that describes 3 different ways to feed powder. The first method shown in [FIG. 1] of the patent is transporting a compressed gas to a pressure pipe and a hopper containing powder and then transports powder mixed with gas to a nozzle by spinning a cylinder drum adjusting pressure properly to prevent powder from flowing backward. The second shown in [FIG. 4] of the patent is sending a compressed gas to a feeder including powder directly and pushing away powder into a nozzle. The third shown in [FIG. 5] of the patent shows that a compressed gas is transferred to a heating unit and a feeder separately, and a heated gas and powder are mixed in a premix chamber which is connected to carrier gas pipe and a powder feeding pipe and then sent to a nozzle.
2) U.S. Pat. No. 6,139,913 ("Kinetic spray coating method and apparatus") is about a spray technique. As shown in [FIG. 2] of the patent, gas is transported to a mixing chamber and powder mixed with gas with higher pressure than one inside the mixing chamber is sent to the mixing chamber. This is the method similar to the third way of U.S. Pat. No. 5,302,414 mentioned above.
3) Korea Pat. No. 10-0770173 ("Cold spray apparatus"), Korea Pat. No. 10-0575139 ("Cold spray apparatus with gas cooling apparatus"), and Korea Pat. No. 10-0515608 ("Cold spray apparatus with powder preheating apparatus"; U.S. Pat. No. 7,654,223) relate to a method transporting powder to a mixing chamber. This is the method similar to the third way of U.S. Pat. No. 5,302,414 mentioned above.

The methods feeding powder described in 1)~3) above have been generally used in thermal spray, cold spray, and kinetic spray. To make speed of gas ejected from a nozzle supersonic, gas flowing in a pipe and a mixing chamber keeps high pressure and gas carrying powder must keep pressure more than it and therefore a nitrogen gas ($N_2$) or a helium gas (He) has been usually used in the above coating methods.

4) Korea Pat. No. 10-0695046 ("Method for forming ultrafine particle brittle material at low temperature and ultrafine particle brittle material for use therein"; PCT/JP2003/006640), Korea Pat. No. 10-0724070 ("Composite structured material and method for preparation thereof and apparatus for preparation thereof"; PCT/JP2000/007076), Korea Pat. No. 10-0767395 ("Composite structured material"; PCT/JP2000/007076), and Korea Pat. No. 10-0531165 ("Method and apparatus for carbon fiber fixed on a substrate"; U.S. Pat. No. 7,306,503 "Method and apparatus of fixing carbon fibers on a substrate using an aerosol deposition process") applied aerosol deposition to their systems. A common method transporting powder in the system is sending powder to a nozzle by keeping pressure of gas carrying powder higher than pressure inside the deposition chamber. But the method has a problem transporting a fixed amount of powder continuously which must be solved for a good quality of coating.
5) U.S. Pat. No. 4,815,414 ("Powder spray apparatus") relates to a system transporting powder under atmospheric pressure to a nozzle by a highly compressed carrier gas. As shown in [FIG. 1] of the patent, powder contained in a reservoir under atmospheric pressure is sent to a nozzle by a highly compressed carrier gas flowing through a pressure pipe. A problem of this method is that much of powder near the low part of the reservoir is pushed up although some powder goes down to the manifold and then to a nozzle.

6) U.S. Pat. No. 6,569,245 ("Method and apparatus for applying a powder coating") discloses that powder under atmospheric pressure is transported to a nozzle unit. As shown in [FIG. 1] of the patent, powder in a feeder is sent to a nozzle unit, and entrained on a heated and compressed gas in a nozzle unit, and ejected through a nozzle.

In the process of feeding there is a problem that powder contained in a feeder is under atmospheric pressure and therefore it cannot be flowed into a nozzle unit when a compressed gas flows into the feeder.

In the above-described 5)~6) patents, powder in a hopper under atmospheric pressure is discharged by self weight without using a device and therefore it is not possible to control an amount of discharged powder which means that thickness and quality of a coating layer cannot be consistently kept by the feeding method.

As described above, there are several problems that must be improved in the method feeding powder into a pressure pipe having higher pressure than atmospheric pressure. 1) Need of high pressure (10~40 bar) more than atmospheric pressure 2) Use of costly nitrogen gas or helium gas to obtain high pressure 3) Backflow or tie-up of the powder flow when gas of higher pressure than atmospheric pressure flows into a feeder under atmospheric pressure 4) Difficulty in feeding a little and consistent amount of powder.

DETAILED DESCRIPTION OF THE INVENTION

The present invention has been made to solve the above-described problems and to disclose a method and an apparatus for fabricating a uniform coating layer. According to the invention, a properly fixed amount of powder and carrier air can be provided to a nozzle. Namely, the powder entrained on carrier air of a fixed and consistent flow, density, and velocity is fed into a nozzle through a transporting pipe and ejected and coated on a substrate uniformly and consistently regardless of material or size of the substrate. As shown in [FIG. 2], the present invention relates to an apparatus comprising; the following units; an air supply unit (100); an air treatment unit (200) filtering, drying, and ejecting air provided from said air supply unit (100); a feeder unit (300) entraining a fixed amount of powder on air transported from said air treatment unit (200); a coating chamber unit (400) containing a substrate; a carrier pipe (500) transporting powder entrained on the carrier air to said coating chamber (400) as connecting said air treatment unit (200) and said coating chamber (400); a spray nozzle (600) ejecting powder entrained on carrier air on a substrate as a ending part of said carrier pipe (500); a vacuum pump unit (700) connected to said coating chamber (400) through a vacuum connection pipe (710) and keeping said coating chamber vacuumed.

Said air supply unit (100) comprises a compressed air pump (110) and a compressed air storage tank (120). Said compressed air pump (110) pumps and transports air sucked in through its air inlet (111) to said compressed air storage tank (120) which transports air to said air treatment unit (200) after cooling it. There could be installed a flow control valve (10) between said compressed air pump (110) and said compressed air storage tank (120) and between said compressed air storage tank (120) and said air treatment unit (200) respectively.

Also, there could be installed a flow rate controller (20) in said air treatment unit (200) that controls a flow rate of air which is filtered and dried. The flow rate controller is what keeps a fixed amount of a filtered and dried air. Namely, it plays an important role in controlling an amount of powder entrained on the carrier air transported to the coating chamber per minute.

Said air treatment unit (200) could comprise a primary filter (210); a secondary filter (230); a primary dryer (220); and a secondary dryer (240) to filter and dry air twice. And said secondary filter (230) could comprises a dewater filter (231); an oil filter (232); and a dust filter (233). Said dewater filter (231) could be placed between the flow rate controller (20) and the secondary dryer (240) and the flow control valve (10) could be installed between said primary filter (210) and said primary dryer (220) and between said dewater filter (231) and said flow rate controller (20) respectively.

As shown in [FIG. 3], said feeder unit (300) and said carrier pipe (500) are connected by a connection pipe (310) which is penetrated into the carrier pipe and fixed to let the outlet of it face towards a direction of the air flow. Said carrier pipe (500) could have a shape of an elbow due to a layout of the pipes, but in this case, it is desirable to put a flow velocity controller (30) in front of the elbow part. The flow velocity controller keeps the velocity of air consistently even if the carrier pipe is crooked and therefore, as shown in [FIG. 4], it is not necessary if the carrier pipe is connected to a nozzle straightly without any curved part such as an elbow part. On the other hand, in the case that the carrier pipe has an elbow part, there occurs a phenomenon that velocity of air in an outer part and one in an inner part inside the pipe is different. As shown in [FIG. 4], in order to keep uniform velocity of air inside the pipe, the flow velocity controller must be installed in front of the elbow part of the carrier pipe. Of course, it is desirable to make said carrier pipe (500) straight so that there is no need for additional flow velocity controller.

As shown in [FIG. 2], a pressure gauge (50) could be installed to check an amount, velocity, and uniform distribution of powder entrained on the carrier air transported through said carrier pipe (500) per minute. Additionally, if a gap controller (40) is installed in said carrier pipe unit (500), distance between a spray nozzle (600) and a substrate (5) can be adjusted by controlling length of said carrier pipe (500). Said coating chamber (400) could be connected to a ventilation pump (800) through a ventilation pipe (810). The function of said ventilation pump (800) is to eject the powder floating inside the coating chamber, which is not coated on a substrate, through said ventilation pipe (810).

A pressure control valve (60) installed inside said vacuum connection pipe (710) can keep and adjust vacuum inside said coating chamber (400) effectively and efficiently. A substrate transporter (900) can be installed in said coating chamber to move a substrate back and forth. In this case, velocity of said substrate transporter can be controlled in accordance with change of pressure of said carrier pipe and coating chamber by installing and connecting a pressure gage (50) in said carrier pipe and said vacuum connection pipe (700).

As shown in [FIG. 7], said carrier pipe (500) is divided into the five sections such as a first section, a second section, a third section, a fourth section, and a fifth section. Each pipe diameter of the first section, the third, and the fifth does not change, but the second and the fourth have a throat in the middle of each pipes and each pipe diameter gradually scales down moving toward a throat from the ends of each section. The throat of the fourth section is bigger than it of the second section. The third section is connected to said feeder (300) by a connection pipe (310) and a block chamber (330) which has an open side (320) at the top. The angle of said connection pipe (310) is adjustable.

As shown in [FIG. 13] and [FIG. 14], said carrier pipe (500) can be also divided into three sections; the first section that a diameter of a pipe is uniform up to one point and then scales down, the second section that a diameter is uniform up to one point and then scales up, the third section that keeps a uniform diameter of a pipe. The second section is connected to said feeder (300) by a connection pipe (310) and a block chamber (330) which has an open side (320) at the top. As shown in [FIG. 15], said spray nozzle (600) can be used by a subsonic orifice nozzle of which cross section area scales down from the end of the third section to the nozzle outlet. In this case, the smallest cross section area of the second section is bigger than or the same as one of the nozzle outlet. On the other hand, said spray nozzle (600) can be used by a supersonic de-Laval nozzle of which cross section area scales down from the end of the third section to a nozzle throat and then scales up to the nozzle outlet. Similarly, the smallest cross section area of the second section is bigger than or the same as one of the nozzle throat.

As shown in [FIG. 23], the present invention comprises a roll-to-roll unit as said substrate transporter (900). The basic operating principle of the substrate transporter is that a flexible substrate wound on a raveling roller (910) unwinds and is wound on a winding roller (920) by a rotary motion. The roll-to-roll unit consists of a suction holder (970) propping the flexible substrate up by the adsorptive power between said raveling roller (910) and said winding roller (920), a suction pump (960) controlling the adsorptive power of said suction holder (970), and a suction pump connection pipe (950) connecting said suction holder (970) and said suction pump (960).

There are two kinds of suction holders as said suction holder (970). One, as shown in [FIG. 25], is a vacuum chuck covered with a holes set (974) having many small holes (973) on a suction holder body (971). The other, as shown in [FIG. 26], is a revolving vacuum chuck wound with the holes set (974) having many holes (973) on a track (972). Also, a tensile strength control roller (930) can be installed in the front and the back of said suction holder (970) and therefore stretch the flexible substrate tight adjusting tension of it properly. In addition, the adsorptive power can be controlled more precisely by a suction force controller (70) installed in said pipe (950).

The present invention also comprises a pressurizer (130) installed in said carrier pipe (500) which transports a compressed air to said air treatment unit (200) after compressing air transported from said air supply unit (100); a heater (510) heating air and adjusting temperature of air before forming powder entrained on the carrier air; and a cooler (340) cooling the powder before it is entrained on carrier air. These devices are installed to block thermal shock on a substrate when powder particles are impinged on it regardless of velocity of powder entrained on the carrier air, the size and the sort of powder, and the material of a substrate. It is possible because temperature of the powder and the air is controlled by the heater and the cooler.

The following [Table 1] shows cases requiring temperature control of gas and powder according to conditions.

TABLE 1

| Spray velocity | Particle size | Heating carrier gas | Cooling powder |
|---|---|---|---|
| supersonic | micrometer | ○ | ○ |
| | nanometer | ○ | X |
| subsonic | micrometer | ○ | Δ |
| | nanometer | ○ | X |

○: necessary
X: unnecessary
Δ: it depends

In the case that spray velocity is supersonic and micrometer powder is used, the carrier air is heated and the micrometer powder is cooled. When spray velocity is supersonic and the nanometer powder is used, the carrier air is heated and the nanometer powder is not cooled. On the other hand, in the case that spray velocity is subsonic and the micrometer powder is used, the carrier air is heated and the micrometer powder can be either heated or not. In the case of nanometer powder the carrier air is heated, but the nanometer powder is not cooled. By the above-described ways, thermal shock occurring on a substrate can be eliminated.

In order to operate this function smoothly and effectively, as shown in [FIG. 27], the present invention comprises a system control unit (1000) linked to said pressurizer (130), said heater (510), and said cooler (340). Therefore, pressure, velocity, flow rate, and temperature with regard to the carrier air and the powder can be easily controlled by the system control unit.

Also, said system control unit (1000) could be connected to said coating chamber unit (400) through an insulation pipe (411) and linked to a substrate temperature controller (410) installed inside said coating chamber (400) to control temperature of a substrate. It is desirable that the temperature of the substrate is lower than it of the nozzle outlet. And a flow rate gauge, a pressure gauge, and a temperature gauge could be installed in said carrier pipe (500) to keep a proper flow rate, velocity, and temperature of powder entrained on the carrier air flowing inside said carrier pipe (500).

As shown in [FIG. 27], said feeder (300) controls an amount of powder fed per minute and dispersion of powder uniformly. A block chamber (330) connected to the ejecting side of the feeder has an open side (320) on the top of it from which air flows in and transports powder to said connection pipe (310) by difference of pressure. A pretreatment device can be additionally installed in said open side (320) to eliminate moisture or impurities in the air flowed into said block chamber (330).

The present invention comprises a particle collector (730) collecting powder inside said coating chamber (400), which is not coated, through a pipe connected to said coating chamber (400).

In the case using a supersonic de-Laval nozzle, said connection pipe (310) coming out of said block chamber (330) can be directly connected between the nozzle throat and the nozzle outlet and therefore the powder transported to the nozzle is entrained on a supersonic air and forms powder entrained on the carrier air which is ejected at the supersonic velocity. In the other case using a supersonic de-Laval nozzle or a subsonic orifice nozzle, the powder having passed through said cooler (340) can be entrained on the carrier air through the insulated cooling pipe (341) which is connected to the inlet of a supersonic de-Laval nozzle or a subsonic orifice nozzle.

The processes performed in the present invention comprise the steps of; (a) sucking and storing air, (b) transporting a uniform amount of air after filtering and drying it, (c) forming an evenly dispersed powder entrained on the carrier air having gone through the process (b), (d) transporting powder entrained on the carrier air in a state that keeps its velocity, amount, and density consistently, (e) spraying the powder on a substrate through the spray nozzle with even pressure and ejecting velocity in a vacuumed coating chamber. These processes for a continuous coating method are able to be easily accomplished by the above-described coating apparatus.

The velocity ejecting powder entrained on the carrier air in the process (e) can be controlled through the control of an amount of air being transported in the process (b). And the process (e) can be done simultaneously with the process discharging and collecting powder remained in the coating chamber after coating.

In the case that a supersonic de-Laval nozzle or a subsonic orifice nozzle is used, a process pressuring air is included in the process (a) and a process offsetting temperature drop of carrier air by heating gas beforehand can be included in the process (b). At this point, if a size of the powder is micrometer, it is desirable to cool the powder before forming powder entrained on the carrier air as much as temperature dropped ($\Delta T_m$) of carrier air after it passes through a supersonic de-Laval nozzle or a subsonic orifice nozzle.

As shown in [FIG. 7], a carrier pipe (500) in the present invention is divided into the five sections such as a first section, a second section, a third section, a fourth section, and a fifth section; the first, the third, and the fifth that keep the uniform diameter of a pipe, the second and the fourth that a pipe diameter gradually scales down moving toward a throat in the middle of each sections from both ends of each sections. But the throat of the fourth section is bigger than it of the second. In said process (a) mentioned above, a transported air is compressed more than atmospheric pressure. And as shown in [FIG. 8], said process (b) includes lowering pressure of air transported in the first section of said carrier pipe and letting a shock wave occur at the throat of the fourth section. Also, said process (c) includes providing the third section of the carrier pipe with the powder under atmospheric pressure. At the same time, in said process (b) temperature of air passing the first section of said carrier pipe unit is controlled so that temperature of air passing the third section of said carrier pipe may be kept above freezing and a pressure gauge installed in said carrier pipe can always check whether pressure at the pipe throat of the fourth section increases rapidly. Besides, a Mach number of air passing through the third section of said carrier pipe can be controlled so that temperature of the air can be kept above freezing.

In the present invention, as shown in [FIG. 13] and [FIG. 14], air flows through the first section that a diameter of a pipe is uniform up to one point and then scales down, and air and powder are mixed in the second section that a diameter is uniform up to one point and then scales up, and the powder entrained cm the carrier air flows through the third section that keeps a uniform diameter of a pipe. Said process (a) mentioned above includes further the step of compressing sucked-in air up to more than atmospheric pressure, said process (b) includes further the step of forming minus pressure in the second section of said carrier pipe by transporting the pressurized air to the first section of said carrier pipe, said process (c) performed as powder under atmospheric pressure is transported to the second section of said carrier pipe. In said process (a) forming minus pressure inside the second section is decided by velocity of air transported to the first section and pressure inside said carrier pipe. The velocity and pressure of the carrier air can be set by the following four equations in connection with a cross-sectional area ratio between the first section (the largest area) and the second section (the smallest area) and a mass flow rate of air.

$$m=\rho AV \quad \text{(Equation 1)}$$

m: mass flow rate of carrier air flowing inside a carrier pipe
ρ: density of gas
A: cross-sectional area of an arbitrary place in a carrier pipe
V: velocity of gas $$M = \frac{V}{\sqrt{\gamma RT}} \quad \text{(Equation 2)}$$

M: Mach number
V: velocity of gas
γ: ratio of specific heats $$\frac{P}{P_0} = \left(\frac{\rho}{\rho_0}\right)^{\gamma} = \left(\frac{T}{T_0}\right)^{\frac{\gamma}{\gamma-1}} \quad \text{(Equation 3)}$$

P, ρ, T: pressure, density, and temperature of gas in an arbitrary place respectively
$P_0$, $\rho_0$, $T_0$: pressure, density, and temperature of gas in an initial state respectively $$\frac{A}{A^*} = \frac{1}{M}\left[\frac{2}{\gamma+1}\left(1+\frac{\gamma-1}{2}\right)M^2\right]^{\frac{\gamma+1}{2(\gamma-1)}} \quad \text{(Equation 4)}$$

A: cross-sectional area of an arbitrary place in a carrier pipe
A*: cross-sectional area of a throat at an arbitrary place in a carrier pipe
M: Mach number at an arbitrary place in a carrier pipe
γ: ratio of specific heats The continuous powder coating apparatus of the present invention can solve the several problems that have been caused by aerosol deposition so far.

First, the present invention can coat powder on a large size substrate by using a subsonic or a supersonic nozzle through control over a flow rate of carrier air as well as pressure inside the coating chamber regardless of a) the kinds of powders (ceramics, metals, semimetals, composites, etc.), particle sizes (a few hundred micrometers~a few nanometers), shapes (sphere, plate, tube, etc.) and specific weight, b) the kinds of substrates (glasses, polymers, metals, plastics, etc), and c) sizes of substrates.

Second, unnecessary is the aerosol chamber that is a must of aerosol deposition because in the present invention, an amount of powder per minute can be kept consistently and powder can be dispersed uniformly.

Third, continuous and uniform feeding of powder makes a continuous coating process for forming a uniform layer on a substrate possible.

As a result, the present invention controls flow rate of the carrier air, pressure in the inside of the coating chamber, and feeding and spray of powder, and therefore powder entrained on the carrier air can flow through the carrier pipe with even velocity distribution and uniform concentration of powder in carrier air can be kept consistently. Powder entrained on the carrier air ejected through a nozzle under the situation forms a uniform thin layer on a substrate,

<Names of major parts of drawings>

Figure 1:
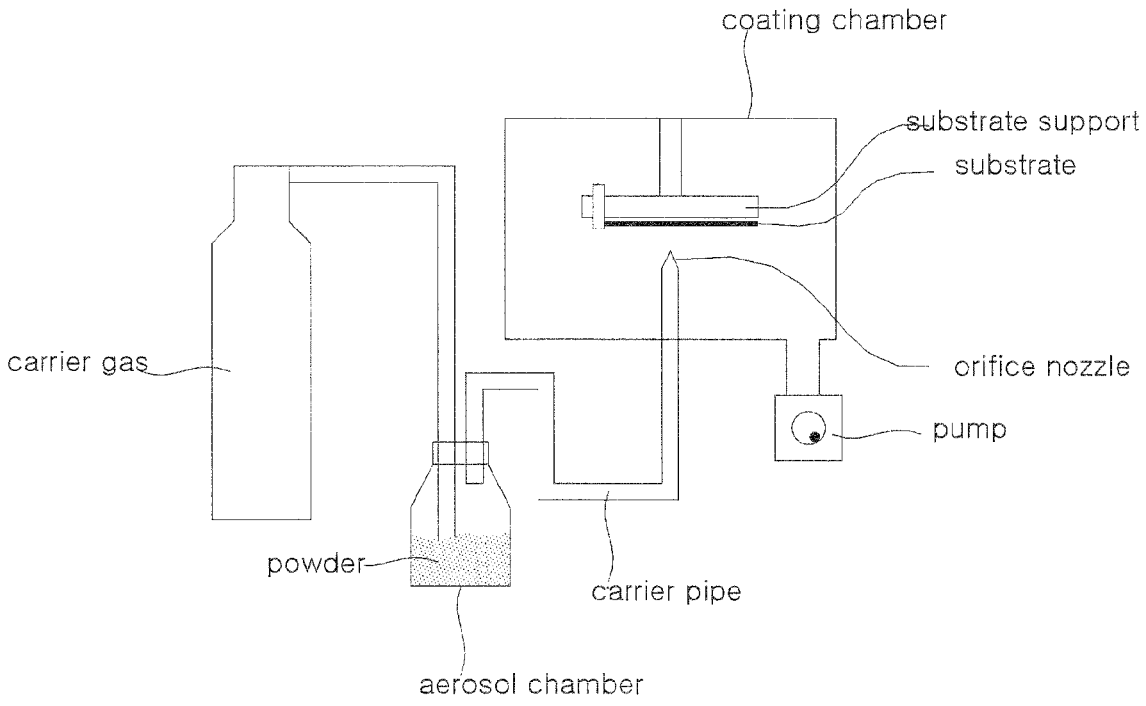
FIG. 1 is a schematic diagram of a conventional aerosol deposition.

1: carrier gas 3: powder
4: powder entrained on the carrier air 5: substrate
6: atmospheric pressure 7: 3 dimensional workpiece
12: powder control valve 13: shock wave
10: flow control valve 20: flow rate controller
30: flow velocity controller 40: gap controller
50: pressure gauge 60: pressure control valve
70: suction force controller
100: air supply unit 110: compressed air pump
111: air inlet 120: compressed air storage tank
130: pressurizer 131: pressurized pipe
200: air treatment unit 210: primary filter
220: primary dryer 230: secondary filter
231: dewater filter 232: oil filter
233: dust filter 240: secondary dryer
300: feeder 310: connection pipe
320: open side 330: block chamber
340: cooler 341: insulated cooling pipe
400: coating chamber unit 410: substrate temperature controller
411: insulation pipe 420: workpiece positioner
500: carrier pipe 510: heater
600: spray nozzle 610: nozzle positioner
700: vacuum pump 710: vacuum connection pipe
720: particle collector connection pipe 730: particle collector
800: ventilation pump 810: ventilation pipe
900: substrate transporter 910: raveling roller
920: winding roller 930: tensile strength control roller
940: auxiliary roller 950: suction pump connection pipe -continued

| <Names of major parts of drawings> | |
|---|---|
| 960: suction pump | 970: suction holder |
| 971: suction holder body | 972: track |
| 973: holes | 974: holes set |
| 1000: system control unit | |

DESCRIPTION OF THE PREFERRED EMBODIMENTS

The best performance can be made by using apparatus for continuous powder coating comprising: an air supply unit (100); an air treatment unit (200) flowing out after filtering and drying air flowed in from the air supply unit (100); a feeder (300) entraining a uniform amount of powder on the air ejected from the air treatment unit (200); a coating chamber unit (400) containing a substrate; a carrier pipe (500) connecting the air treatment unit (200) and the coating chamber unit (400) and transporting powder entrained on the carrier air ejected from the air treatment unit (200) and powder to the coating chamber; a spray nozzle (600) connected to the end of the carrier pipe and ejecting the powder entrained on the carrier air on a substrate inside the coating chamber; a vacuum pump (700) connected to the coating chamber unit (400) through a vacuum connection pipe (710) and keeping the coating chamber vacuumed.

In addition, said air supply unit (100) consists of a compressed air pump (110) and a compressed air storage tank (120). Said compressed air pump (110) transports air flowed in through air inlet (111) on it to said compressed air storage tank (120) and said compressed air storage tank (120) contains and cools air and then sends it said air treatment unit (200). A flow control valve is installed between said compressed air pump (110) and said compressed air storage tank (120) and between said compressed air storage tank (120) and said air treatment unit (200) respectively.

Also, it is desirable that a flow rate controller (20) be installed in said air treatment unit (200) to control an amount of a filtered and dried air consistently. Said air treatment unit (200) has a primary filter (210), a primary dryer (220), a secondary filter (230), and a secondary dryer (240) and they filter and dry air flowed in from said air supply unit (100) repeatedly. The secondary filter (230) consists of said dewater filter (231) installed between said secondary dryer (240) and said flow rate controller (20), an oil filter, and a dust filter (233). The flow control valve is installed between said first filter (210) and said first dryer (220) and between said dewater filter (231) and said flow rate controller (20) respectively.

I. Basic Embodiment of Continuous Powder Coating Apparatus

Figure 2:
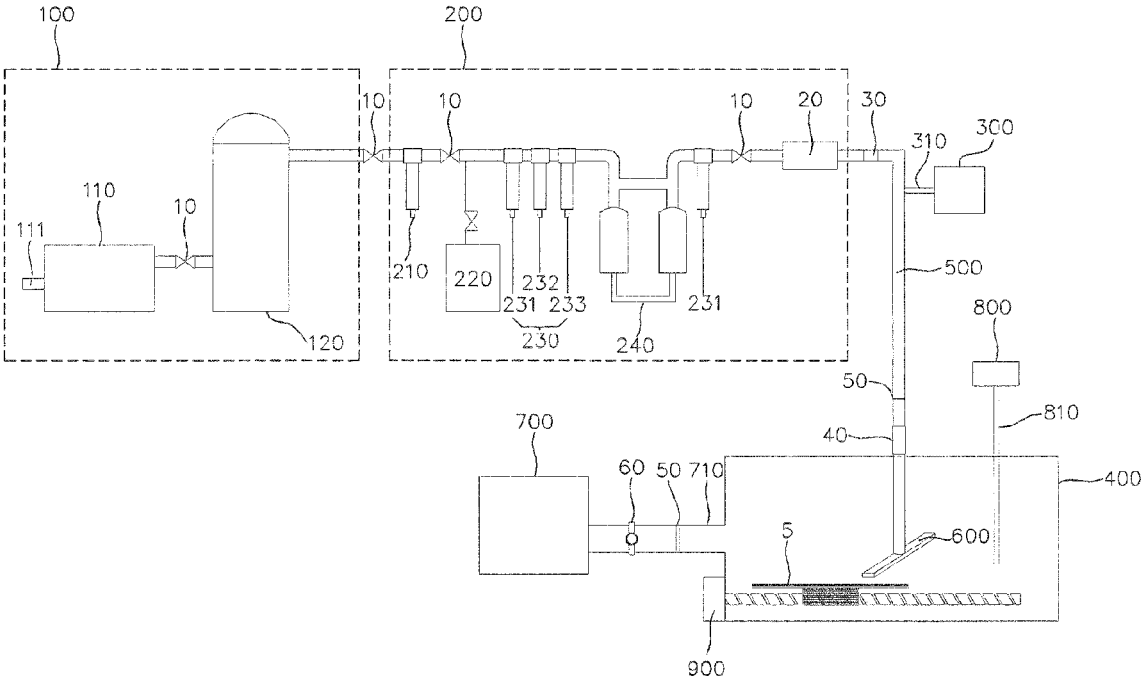
FIG. 2 is a schematic diagram explaining a basic embodiment of a continuous powder coating apparatus.

FIG. 2 is a schematic diagram explaining a basic embodiment of the continuous powder coating apparatus.

1. Air Supply Unit

The conventional aerosol deposition shown in [FIG. 1] used inert gases as carrier gas such as argon (Ar), nitrogen ($N_2$), and helium (He) to form an aerosol. But those are too expensive to be used for a mass production process and unsuitable for a continuous process because of limit of an amount of gas being able to be filled in gas container. In the present invention, just air is used instead of an inert gas. Said air supply unit (100) sucks in the air from the outside and transports it to said air treatment unit (200). Consequently, the present invention is fit for a continuous process to mass-produce a commercialized product at a low price.

As shown in [FIG. 2], the air supply unit (100) is composed of the compressed air pump (110) and the compressed air storage tank (120). Said compressed air pump (110) pumps and transports air sucked-in through air inlet (111) on it to said compressed air storage tank (120) and the compressed air storage tank (120) contains and cools air and then sends it to said air treatment unit (200). In the case that temperature of air flowed into the compressed air storage tank rises by the heat generated from said compressed air pump (110), as the temperature of the air flowed into the compressed air storage tank falls up to about 40% of it again by a cooling function of said tank (120), the flow rate of air transported to the next stage becomes uniform and stable which makes it possible to mass-produce a product continuously and steadily.

A flow control valve (10) installed between said compressed air pump (110) and said compressed air storage tank (120) and between said compressed air storage tank (120) and said air treatment unit (200) respectively can control an amount of air flowing-in and flowing-out in each stages.

2. Air Treatment Unit

Said air treatment unit (200) filters and dries air transported from said air supply unit (100) and then sends out it. A flow rate controller (20) that uniformly adjusts and sends out an amount of the filtered and dried air could be installed in said air treatment unit (200). In the conventional aerosol deposition the coating chamber must be kept in a state of high vacuum to increase the velocity of an aerosol ejected from a nozzle. But the present invention applies a method controlling the velocity of powder entrained on carrier air in a state of low vacuum of the coating chamber by eliminating impurities in the carrier air, that is, air flowed in from the air supply unit, and by adjusting the flow rate of it.

Said air treatment unit (200) has a primary filter (210), a primary dryer (220), a secondary filter (230), and a secondary dryer (240) and they filter and dry air flowed in from the air supply unit (100) repeatedly. The secondary filter (230) consists of a dewater filter (231), an oil filter (232), and a dust filter (233) and can get rid of impurities in the air completely. As air passes through the dewater filter (231) again after having passed through the secondary dryer (240), it can be sent out in an entirely dried state.

A flow control valve (10) installed between said primary filter (210) and said primary dryer (220) and between said dewater filter (231) and said flow rate controller (20) respectively can control an amount of air flowing-in and flowing-out in each stages.

3. Feeder

Said feeder (300) is a component entraining a fixed amount of powder on gas flowed out from said air treatment unit (200). So the feeder is connected to said carrier pipe (500) into which the gas transported from said air treatment unit (200) flows. That is, powder (3) contained in the feeder is sent to said carrier pipe (500). The feeder can consistently feed a fixed amount of powder into the carrier pipe holding gas with a uniform velocity distribution. The most important thing is that the feeder feeds a uniform amount of powder per minute (g/m) and disperses it evenly.

Figure 3:
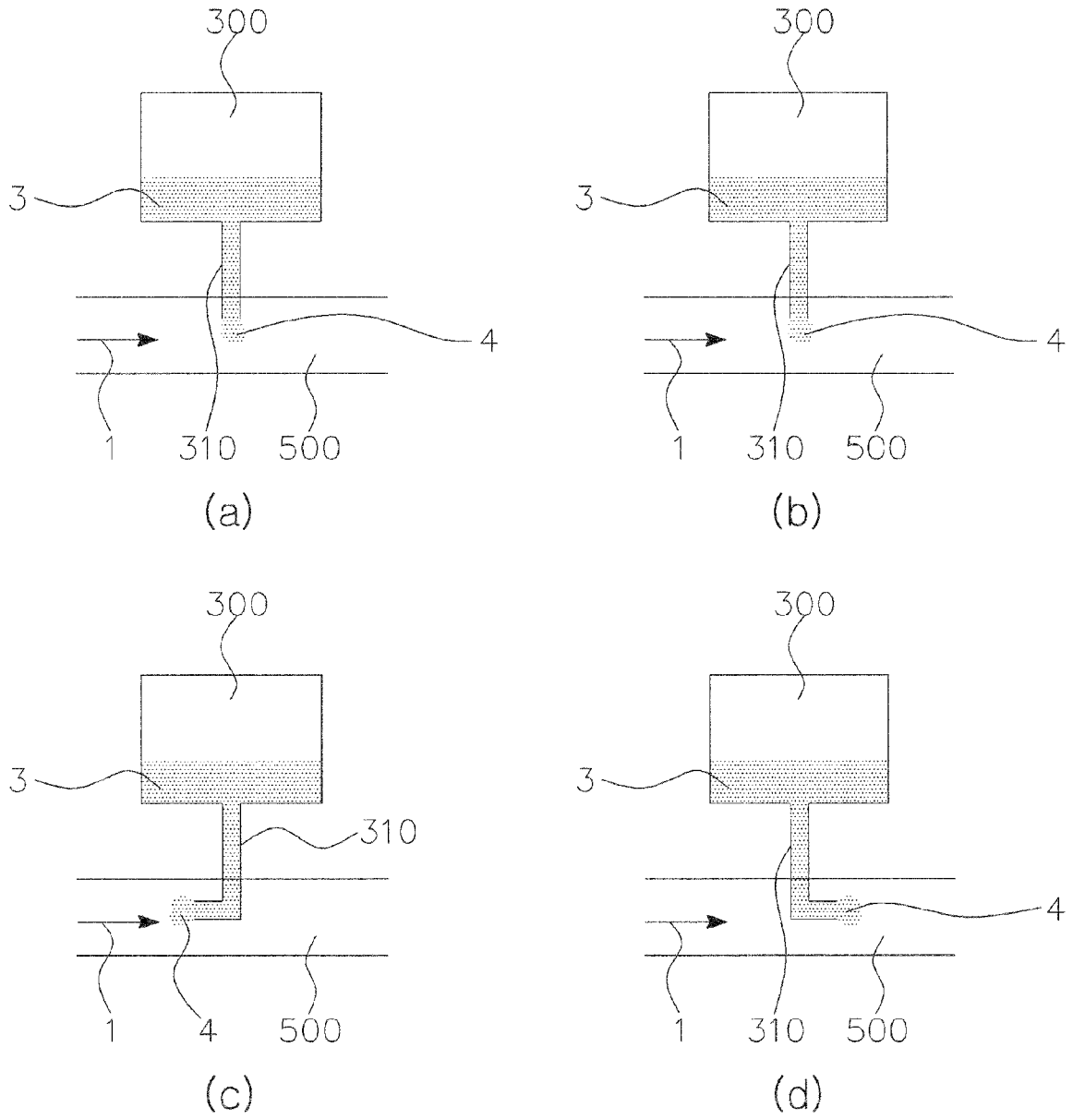
FIG. 3 is a drawing explaining an embodiment of a feeder supplying powder to a carrier pipe.
Figure 4:
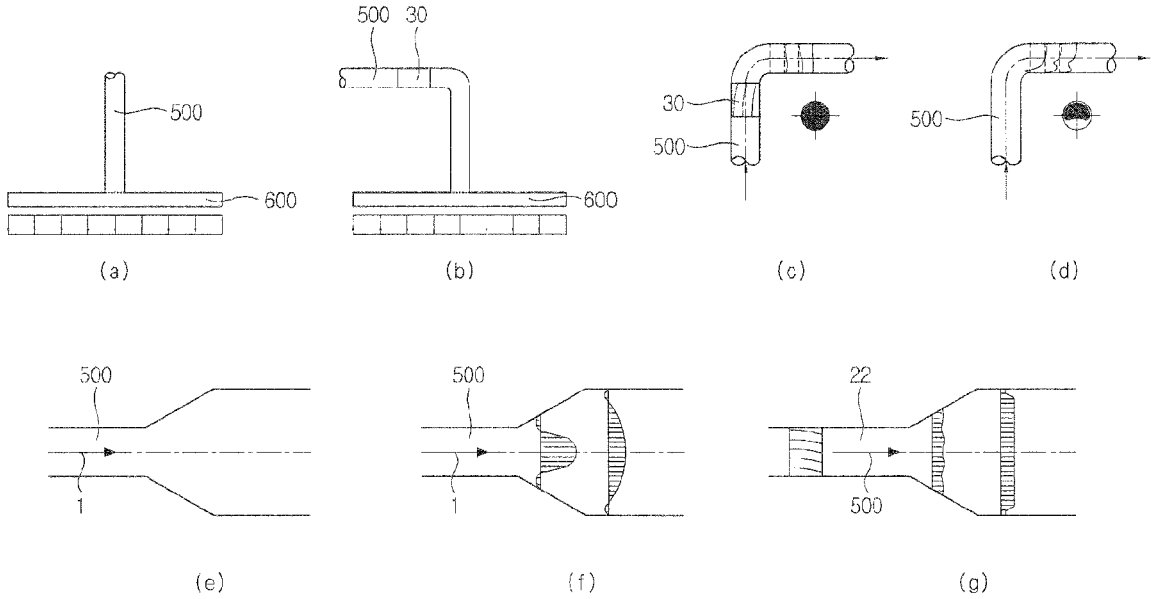
FIG. 4 is cross-sectional views explaining velocity distribution of carrier gas in an elbow part and a diverging part of a carrier pipe.
Figure 5:
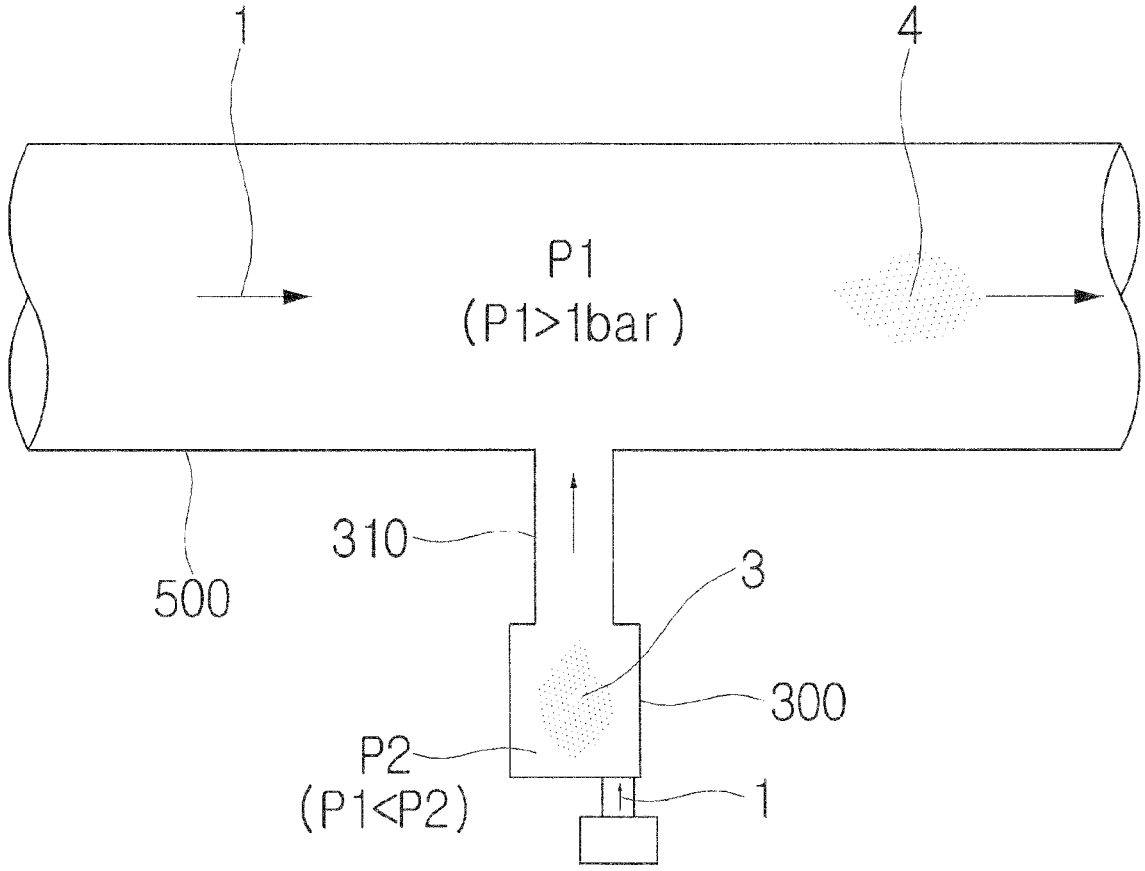
FIG. 5 is a drawing of a conventional device transporting powder into a carrier pipe with pressure higher than atmospheric pressure.

The feeder is connected to said carrier pipe (500) by a connection pipe (310) in a few ways as shown in [FIG. 3] which shows that dispersion of powder is different according to the ways of connection. (a) of [FIG. 3] is the case that the connection pipe penetrates the carrier pipe a little. (b) of [FIG. 3] is the case that the connection pipe penetrates the carrier pipe up to the center of it. (c) of [FIG. 3] is the case that the connection pipe goes through the carrier pipe up to the center of it and then is bent against the flow direction of air. (d) of [FIG. 3] is the case that the connection pipe goes through the carrier pipe up to the center of it and then is bent toward the flow direction of air. All of 4 ways shown in [FIG. 3] can be applied to the present invention, but the (d) method is most desirable since it is of great advantage for uniform dispersion of powder for it to be fed in the same direction as one of the air flow.

A block chamber (330) can be installed on the side of the feeder and let powder pass through it and be fed into the carrier pipe (500). The block-type pipe has an open side (320) through which air flows in. This makes it possible for powder to be fed into the carrier pipe keeping carrier gas velocity (dozens of m/s) and pressure (~40 bar). In the open side (320) of the block chamber (330) a filter or any other device can be installed to eliminate moisture or impurities in the air.

4. Carrier Pipe

Said carrier pipe connecting the air treatment unit and the coating chamber is for transporting powder entrained on the carrier air to said coating chamber (400). In order to keep a fixed amount and velocity of powder entrained on the carrier air flowing through the carrier pipe consistently, the cross-sectional area of a carrier pipe must not change by any impacts or pressure from the outside. So it is desirable to make the carrier pipe of stainless steel or aluminum rather than polymer or plastic. If the cross-sectional area of the carrier pipe increases or decreases, velocity distribution of the flowing powder entrained on the carrier air becomes different and it has a bad effect on the coating.

5. Spray Nozzle

Said spray nozzle (600) is connected to the end of said carrier pipe (500) in the inside of said coating chamber and ejects powder entrained on the carrier air on a substrate (5). The spray nozzle must keep velocity of the ejected powder more than critical velocity and less than erosion velocity to get the most coating efficiency. Either a subsonic orifice nozzle or a supersonic de-Laval nozzle can be used according to the size and the kind of powder (3). For instance, 25 micrometer tin powder ejected at about the velocity of 150 m/s by a subsonic orifice nozzle can be coated on a substrate. But if it is ejected at a supersonic velocity (more than 340 m/s), the coating layer and the substrate could be etched. As the critical velocity and the erosion velocity of powder are different according to its kind, size, and specific weight, a spray nozzle should be chosen considering those properties of the powder. Said spray nozzle (600), as shown in [FIG. 2], could be a slit type to coat a large size substrate. The slit nozzle must be designed to be able to have uniform ejecting pressure and velocity distribution on the whole slit to coat a uniform layer on a substrate. The coating layer by the above described slit nozzle contrasts sharply with one by a multi slit nozzle made by combining several small slit nozzles which cannot obtain a uniform thickness of a coating layer. Also, the distance between the spray nozzle and a substrate can be adjusted by a gap controller (40) installed in said carrier pipe (500). Said spray nozzle (600) can be freely chosen by a subsonic nozzle or a supersonic nozzle according to properties of the powder. And the spray nozzle can be made of stainless steel, titanium, and aluminum alloy which are resistant to pressure and temperature.

6. Coating Chamber Unit

In the conventional aerosol deposition the deposition chamber should be kept in a high-vacuum state, but in the present invention the coating process inside the coating chamber operates in a low vacuum state very well. As a material of said coating chamber unit (400), good is the stainless steel that has strong durability and resists pressure from the outside. A special glass like a transparent glass can be used to make several viewers seeing the inside of the chamber.

Inside the coating chamber there could be installed a transporting device that moves a substrate back and forth as shown in [FIG. 2]. The coating chamber has a slit nozzle and a substrate transporter (900) that moves a substrate on a plate of it. The coating chamber is connected to a vacuum pump (700) through a vacuum connection pipe (710) and has a door for fixing a substrate on the substrate transporter or for cleaning the inside of the coating chamber. Basically, in the coating chamber, powder can be coated on a substrate regardless of its material. But in general, some rigid substrates like glasses or metals are coated on a batch-type substrate transporter and the other flexible substrates such as polymers and foils are coated by using a roll-to-roll device (For more details, see "III. Embodiment of continuous powder coating apparatus with roll-to-roll device"). The above substrate transporters can be reassembled and replaced according to the material of the substrate.

Figure 31:
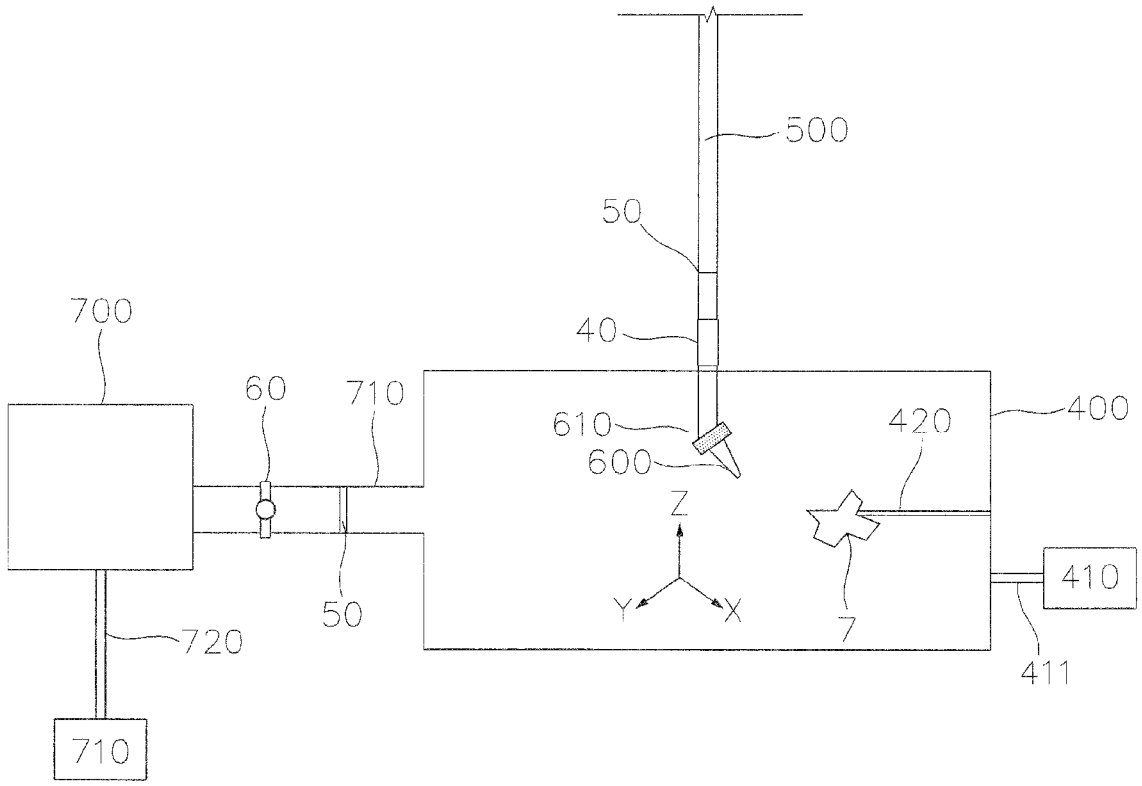
FIG. 31 is a drawing showing a device coating a surface of a 3 dimensional workpiece inside the coating chamber through a subsonic orifice nozzle.
Figure 34:
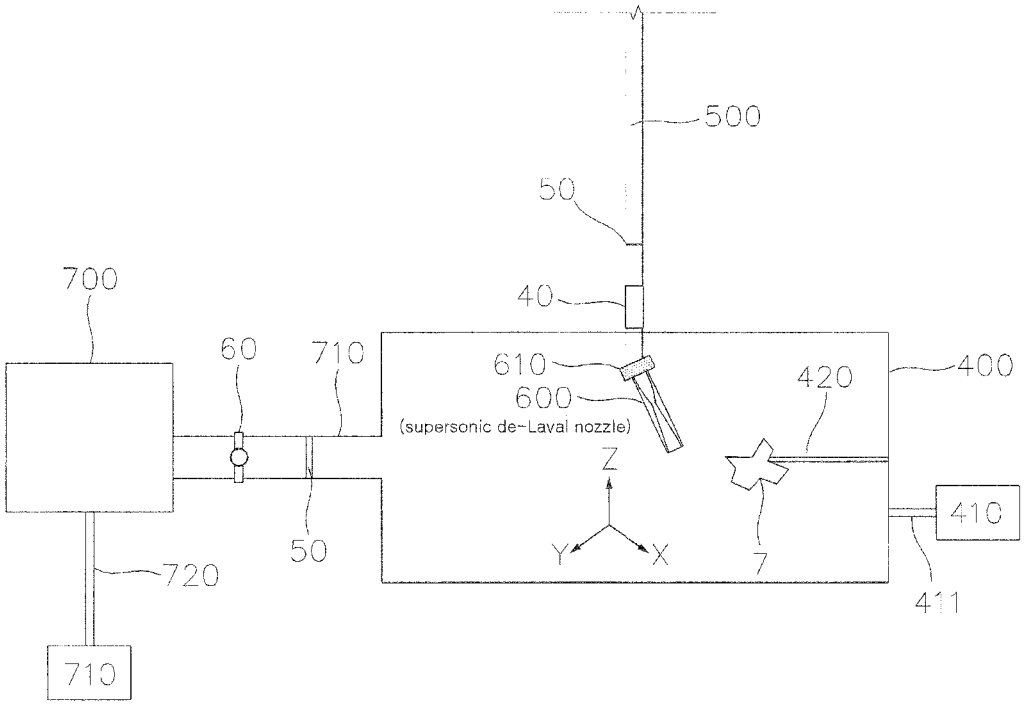
FIG. 34 is a diagram of a device for coating a surface of a 3 dimensional workpiece in the coating chamber through a supersonic de-Laval nozzle.

As shown in [FIG. 31] and [FIG. 34], a workpiece positioner (420) being able to control posture of a 3 dimensional workpieces (irregular or regular shapes like spherical types, tetrahedrons, pipes, etc.) can be installed to fix them for coating.

Figure 32:
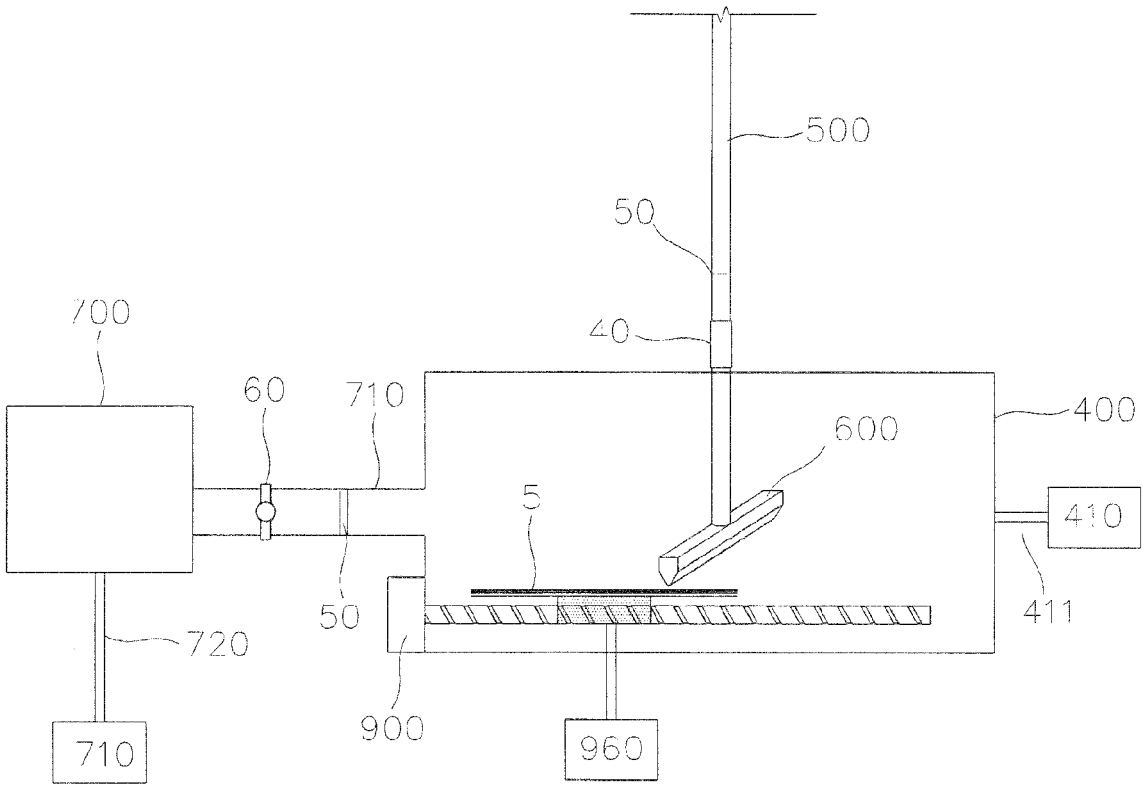
FIG. 32 is a diagram of a device for coating a 2 dimensional large size substrate in the coating chamber through a subsonic orifice nozzle.
Figure 35:
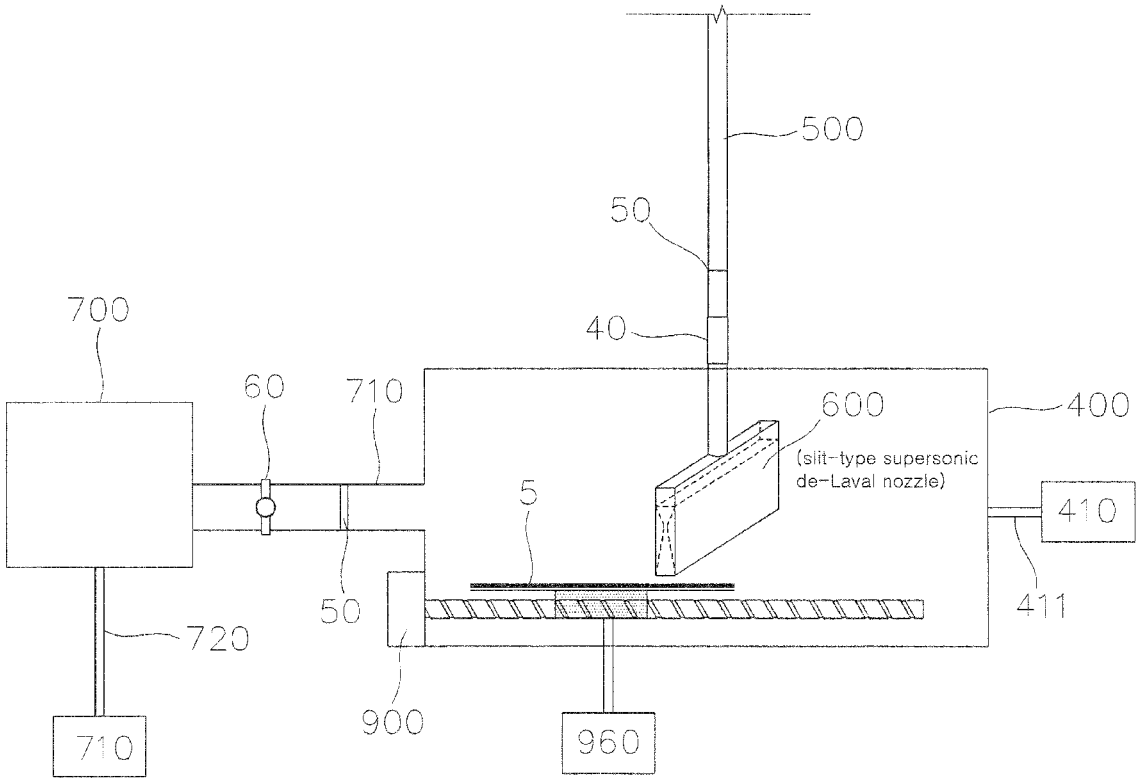
FIG. 35 is a drawing showing a device coating a 2 dimensional large size substrate inside the coating chamber through a slit-type supersonic de-Laval nozzle.

Also, as shown in [FIG. 32] and [FIG. 35], said substrate transporter (900) can play a role in controlling a moving speed of a substrate and the vacuum chuck absorbing and holding the substrate can be installed on the substrate transporter to suppress movement of the substrate caused by ejecting the powder entrained on the carrier air. In the case that said substrate transporter (900) is not installed in the coating chamber, the vacuum chuck can be placed at the bottom of the coating chamber and hold a substrate for coating (For more details, see "III. Embodiment of continuous powder coating apparatus with roll-to-roll device").

A pressure gauge (50) is installed inside said carrier pipe (500) and said vacuum connection pipe (710) respectively and said substrate transporter (900) is linked to the pressure gauges (50) in the carrier pipe and said vacuum connection pipe (710). The moving speed of the substrate transporter (900) becomes fast or slow as pressure of said carrier pipe (500) and said coating chamber (400) increases or decreases.

7. Vacuum Pump

Said vacuum pump (700) is necessary to make said coating chamber (400) vacuumed which can decrease chemical reactions occurring in the coating chamber, prevent speed of particles from being reduced due to a aerodynamic drag (flow of gas rebounding after hitting on a substrate) generated immediately after gas impinges on a substrate, and finally reduce deposition noise.

The coating chamber keeps a low vacuum state by the vacuum pump and the pressure control valve (60) installed in said vacuum connection pipe (710) can keep and control the vacuum state of the coating chamber efficiently.

8. Ventilation Pump

In the present invention, a ventilation pump (800) which collect and discharge the residual after coating through a ventilation pipe (810) can be installed additionally. Said ventilation pump (800) keeps said coating chamber (400) in a vacuum state in order to reduce chemical reaction, coating noise and decreasing of velocity of the particles due to the aerodynamic drag.

II. Embodiment of Continuous Powder Coating Apparatus Preventing Thermal Shock

1. Summary

Figure 27:
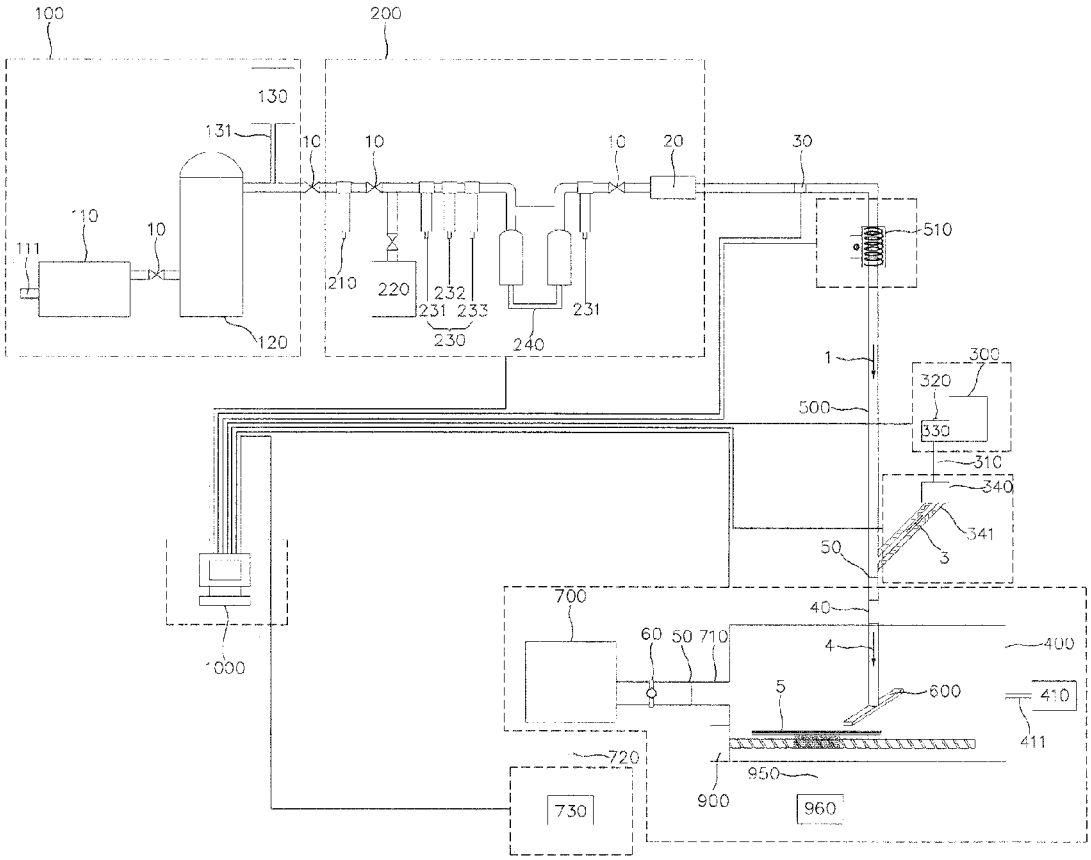
FIG. 27 is a drawing of a continuous powder coating apparatus being able to eliminate shock wave on a substrate.

[FIG. 27] is a drawing of a continuous powder coating apparatus being able to eliminate shock wave on a substrate.

In order to increase coating efficiency, spray velocities ranging from subsonic and supersonic are needed and at the same time carrier gas must keep high flow rate and high pressure. Generally, a normal pressure pump (7~14 bar) is not enough to meet the conditions and therefore a costly high pressure pump (40 bar) or a high pressured nitrogen gas must be used. One disadvantage of using the high pressured nitrogen gas in a continuous process is that a costly nitrogen gas generator is necessary. In the present invention, the problem can be solved by installing a pressurizer that can increase a capacity of the air supply unit and pressure of carrier air and thus expensive inert gases such as nitrogen gas and helium gas can be replaced with an ordinary air. On the other hand, as temperature of carrier gas decreases rapidly when it passes through a spray nozzle, a temperature controller adjusting the temperature of the carrier gas should be installed to maintain the constant temperature of the gas that does not give a thermal shock on a substrate. For example, when plastic is used as a substrate, the temperature of carrier gas ejected from the outlet of a nozzle should range between −40° C.~80° C. Thermal conductivity of powder varies according to its particle size. As a micrometer particle of powder has high thermal conductivity and its temperature is higher than one of carrier gas when it passes through a supersonic nozzle, it could give damage to a substrate. The temperature controller should decrease temperature of the powder to be fit for temperature of carrier gas.

2. Pressurizer

As shown in [FIG. 27], the pressurizer connected to a pipe connecting said air supply unit (100) and said air treatment unit (200) controls pressure of air flowed in from the air supply unit. When a subsonic or supersonic nozzle is used and pressure of carrier gas (P) is increased by the pressurizer, their spray velocity ($V_e$) can be obtained by the following (Equation 5).

(Equation 5)

$V_e$=spraying velocity at the outlet of a supersonic nozzle (m/s)

T=absolute temperature of inlet gas (K)

R=universal gas law constant, 8,314.5 J/(kmol·K)

M=gas molecular mass, kg/kmol $K=c_p/c_v$=isentropic expansion factor $c_p$=specific heat of gas at constant pressure $c_v$=specific heat of gas at constant volume $P_e$=absolute pressure of exhaust gas at nozzle outlet (Pa)

P=absolute pressure of inlet gas

3. Heater

A heater (510), as shown in [FIG. 27], is installed in the carrier pipe (500) between the air treatment unit (200) and the feeder (300) and increases temperature of carrier gas.

Figure 28:
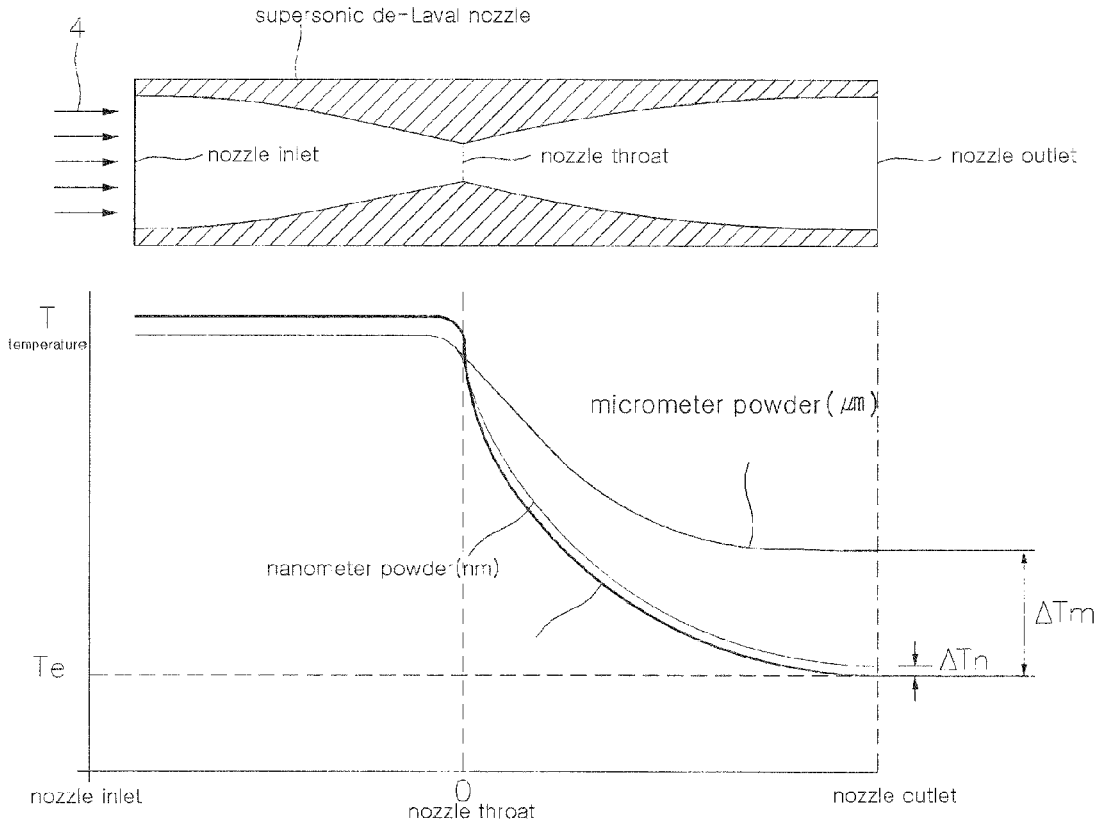
FIG. 28 is a graph showing temperature change of carrier gas, nanometer size particles, and micrometer size particles of powder in the three regions of the supersonic de-Laval nozzle.

As shown in [FIG. 28], velocity of carrier gas increases as it passes through a throat of a nozzle and becomes supersonic while its temperature (T) and pressure (P) drop rapidly. Thermal shock that could be given on a substrate when it is coated is prevented controlling temperature of carrier gas (1) by the heater, For instance, carrier gas at room temperature (20° C.) drops up to about −120° C. as soon as it passes through the throat of a nozzle at supersonic velocity (over Mach 1) and therefore it could give thermal shock on a substrate. But as temperature of the carrier gas heated up to 160° C. becomes 20° C. after it passes through a throat of a nozzle, the thermal shock could be avoid.

As spraying velocity of a subsonic orifice nozzle is under Mach 1, its temperature drop after passing through a nozzle is relatively less than one of a supersonic de-Laval nozzle. So in the case of a subsonic orifice nozzle, thermal shock can be avoid with much lower temperature of carrier gas than it of a supersonic de-Laval nozzle (160° C.). Consequently, appropriate temperature adjustment to carrier gas according to the kind of nozzles can prevent a substrate from the thermal shock.

4. Cooler

Figure 29:
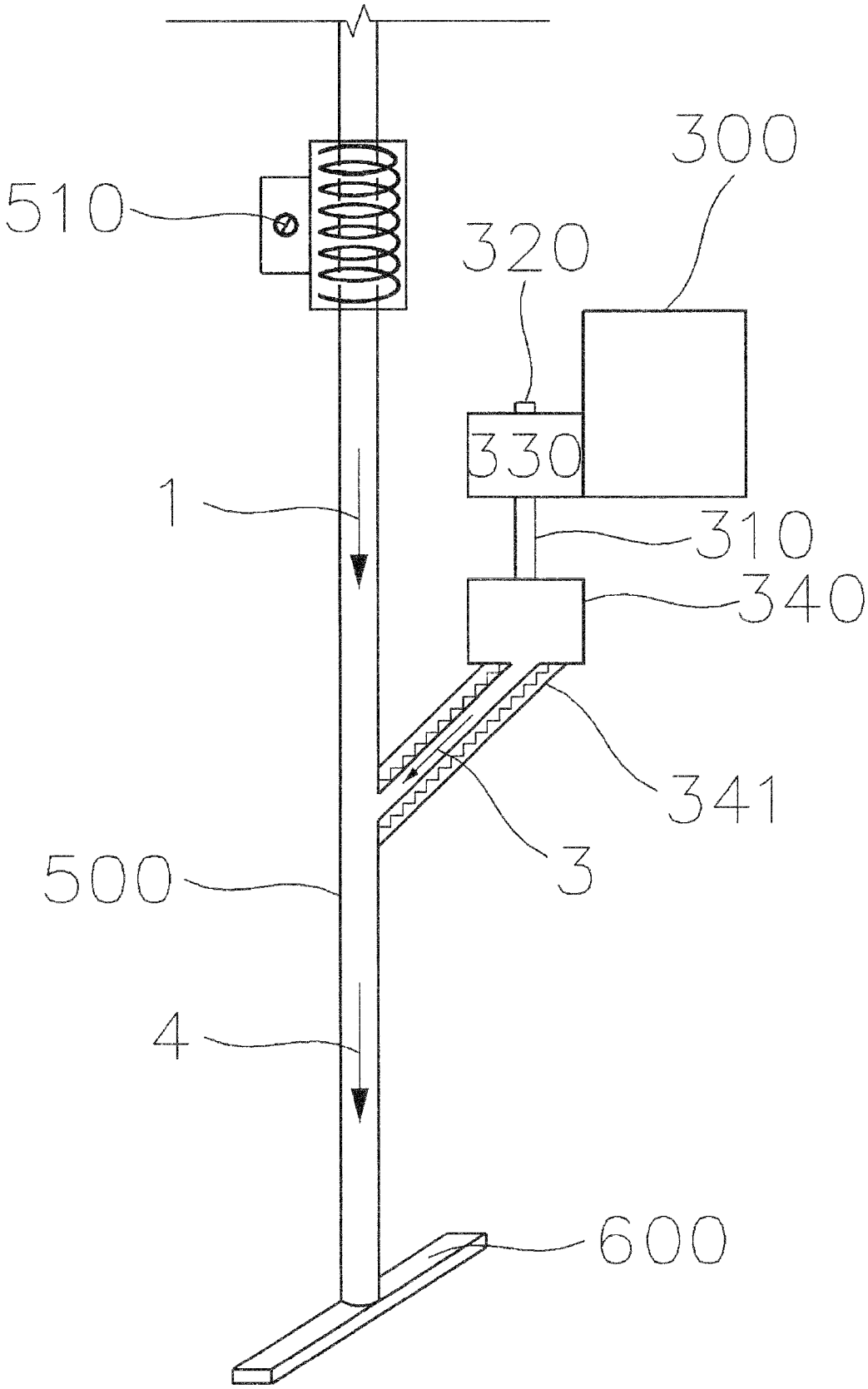
FIG. 29 is a diagram showing a mixing process of the cooled powder and the heated carrier air in a carrier pipe.

A cooler (340), as shown in [FIG. 29], is a device that drops temperature of powder (3) transported from said feeder (300). As shown in [FIG. 28], temperature (T) of a heated carrier gas after passing through the inlet of a nozzle rapidly drops ($T_e$) upon passing the throat of a nozzle. And it is necessary to consider a particle size of powder since its thermal conductivity varies. As shown in [FIG. 28], a nanometer particle has a similar temperature change range ($\Delta T_n$) to one of the carrier gas while a micrometer particle shows big temperature difference ($\Delta T_m$) from carrier gas. The temperature difference must be offset before powder passes through the inlet of a nozzle not to give thermal shock on a substrate. As a result, not only temperature of carrier gas at the outlet of a nozzle but also temperature of powder should be controlled within a permissible range which does not give thermal shock to a substrate. Said heater (510) and said cooler (340) should be linked to each other and be able to effectively control temperature of carrier gas and powder through their feedbacks to avoid thermal shock on a substrate. It is desirable to have enough length of the insulated cooling pipe to cool powder and disperse powder entrained on the carrier air effectively. This makes it easy to control temperature of powder and temperature change at the outlet of a nozzle not to give thermal shock on a substrate.

On the other hand, there is a case that said cooler (340) is not necessary. As shown in [FIG. 38], powder at room temperature is fed between the throat and the outlet of a nozzle (in a diverging part of a nozzle) through a connection pipe (310). As shown in [FIG. 39], a heated carrier air flowed in through the inlet of a nozzle is mixed with powder upon passing through the nozzle throat and forms powder entrained on the carrier air. The powder entrained on the carrier air is ejected through the outlet of a nozzle and coated on a substrate without giving it thermal shock. The carrier gas should be heated enough not to give a substrate thermal shock.

5. Subsonic Orifice Nozzle or Supersonic De-Laval Nozzle

In order for collision velocity of powder to be subsonic or supersonic, the following conditions with regard to a subsonic nozzle or a supersonic nozzle should be satisfied.

The subsonic nozzle can have subsonic spray velocity under Mach 1 when the ratio ($P_2/P_1$) of absolute pressure of exhaust air at nozzle outlet ($P_2$) to absolute pressure of inlet air ($P_1$) equals 0.528 or is less than that. In order to realize subsonic collision velocity (under Mach 1) of powder, the spray nozzle should have the orifice type shown in [FIG. 36] and keep the ratio of $P_2$ to $P_1$ to be around 0.528. The flow rate ($Q=\rho AV$, ρ: density of air) could be decided by a cross-sectional area of a nozzle (A) and the required flow rate can be controlled by pressure of $P_1$. The cross-sectional area of an orifice to realize the most spray velocity under Mach 1 can be obtained by relation between the flow rate and spray velocity.

Figure 30:
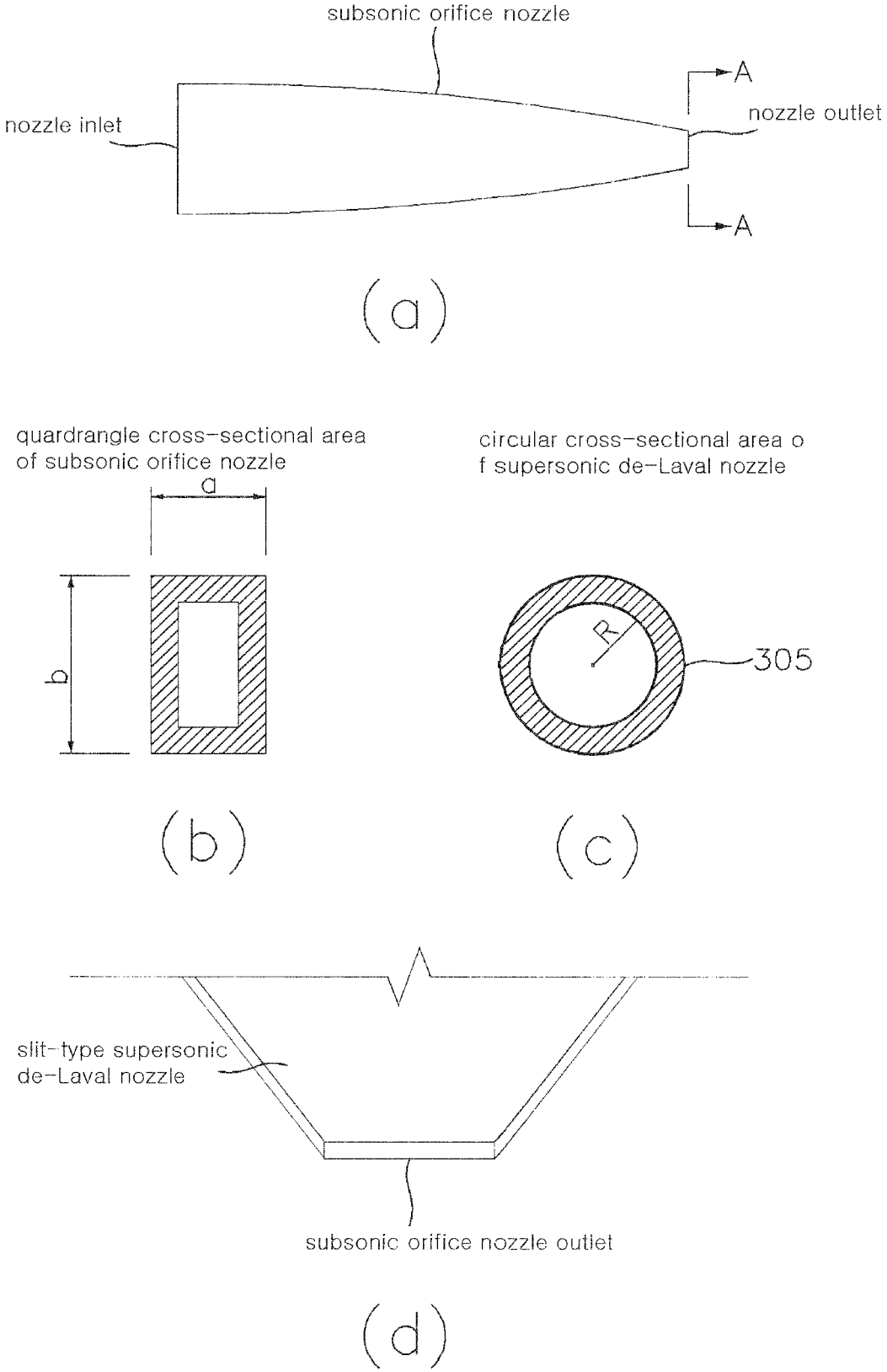
FIG. 30 is a drawing showing cross-sectional areas of a subsonic orifice nozzle and a structure of its slit-type.

[FIG. 30] is a drawing showing cross-sectional areas of a subsonic orifice nozzle and a shape of a slit-type nozzle. As shown in [FIG. 31], a 3 dimensional workpiece can be coated. A nozzle positioner (610) connecting said carrier pipe (500) and the subsonic nozzle can control a position of the subsonic nozzle on 3 axes (x-axis, y-axis, and z-axis). (d) of [FIG. 30]

is a slit-type subsonic nozzle for coating a large size substrate and [FIG. 32] is a diagram of a device for coating a large size substrate in the coating chamber through a subsonic nozzle.

On the other hand, in order to realize supersonic collision velocity, a supersonic de-Laval nozzle is used. Carrier gas and powder pass through the inlet of a nozzle at subsonic velocity, but their velocity becomes supersonic shortly after passing through the throat of a nozzle by adiabatic expansion of the carrier gas. And temperature and pressure of the carrier gas and powder having passed through the nozzle throat can be dropped rapidly. The cross-sectional area of a supersonic nozzle converges from a nozzle inlet to a nozzle throat and diverges from a nozzle throat to a nozzle outlet and it is called Laval nozzle. The first supersonic nozzle was invented by a Swede, Gustaf de Laval, in 1897 and it was applied to a steam turbine and then to a rocket engine later. The above mentioned (Equation 5) is applied to setting values of pressure, temperature, velocity, and flow rate with regard to a supersonic nozzle and [FIG. 33] shows a cross sectional view of the supersonic nozzle. The powder entrained on the carrier air expands when it passes the nozzle throat and its velocity becomes supersonic. But its temperature and pressure drop rapidly.

Figure 33:
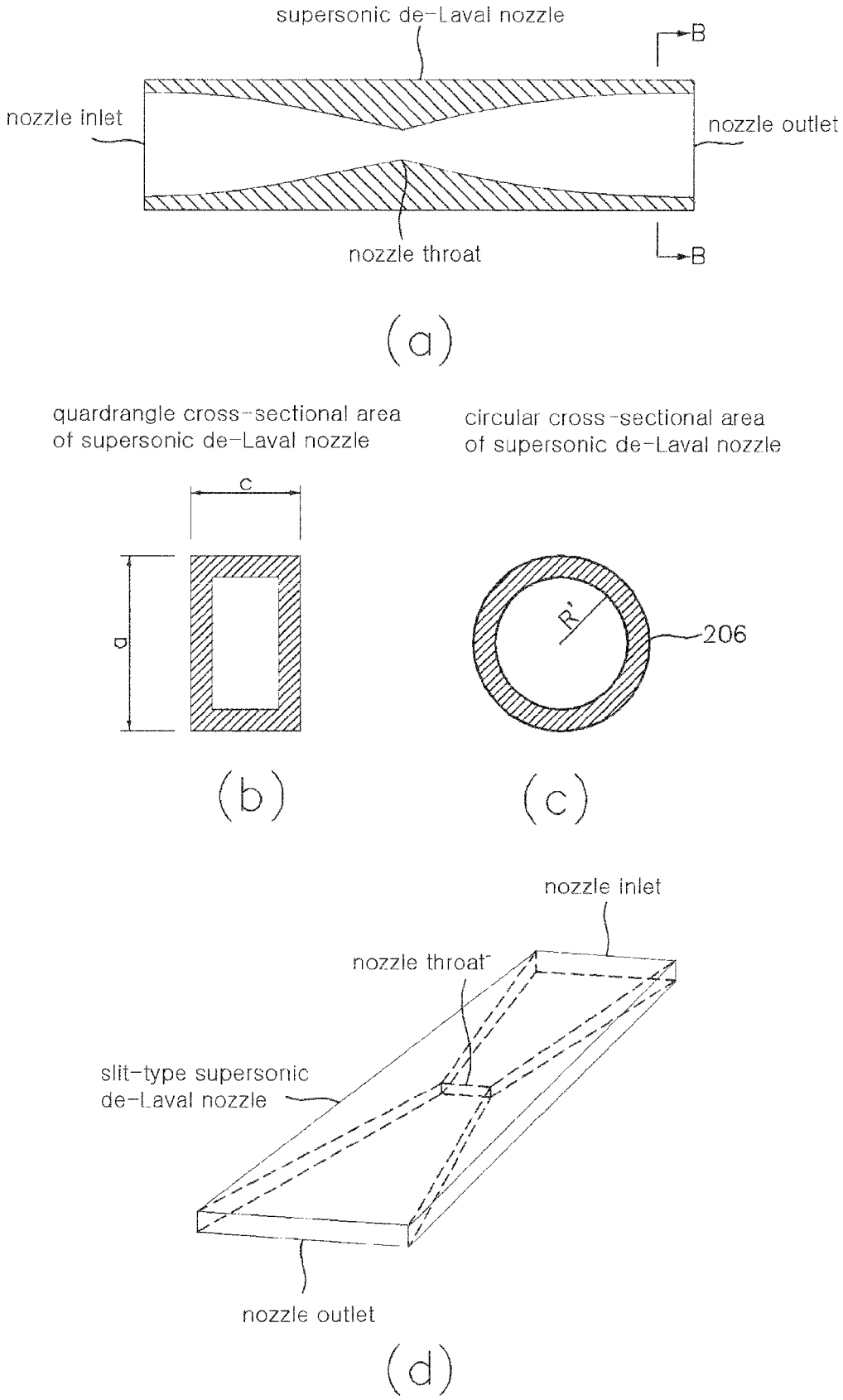
FIG. 33 is a drawing showing cross-sectional areas of a supersonic de-Laval nozzle and a structure of its slit-type

(d) of [FIG. 33] shows a shape of a slit-type supersonic nozzle for coating a large size substrate and [FIG. 34] is a diagram of a device for coating a 3 dimensional workpiece in the coating chamber through a supersonic nozzle.

A nozzle positioner (610) connecting the carrier pipe (500) and the supersonic nozzle can control a position of the supersonic nozzle on 3 axes (x-axis, y-axis, and z-axis). [FIG. 35] is a diagram of a device for coating a 2 dimensional large size substrate in the coating chamber through a supersonic slit-type nozzle.

6. Substrate Temperature Controller

There occurs a big difference of temperature in a contact surface between a substrate and powder entrained on the carrier air when temperature of the substrate ($T_s$) is much higher than it of the powder entrained on the carrier air ($T_a$), ($T_a<T_s$). It results in decreasing coating efficiency because the collision velocity of the powder entrained on the carrier air is reduced by an aerodynamic drag generated by the difference of temperature. In order to minimize the aerodynamic drag generated by the above mentioned mechanism, in the present invention, a substrate temperature controller (410) connected to said coating chamber (400) could be installed as shown in [FIG. 27].

Figure 42:
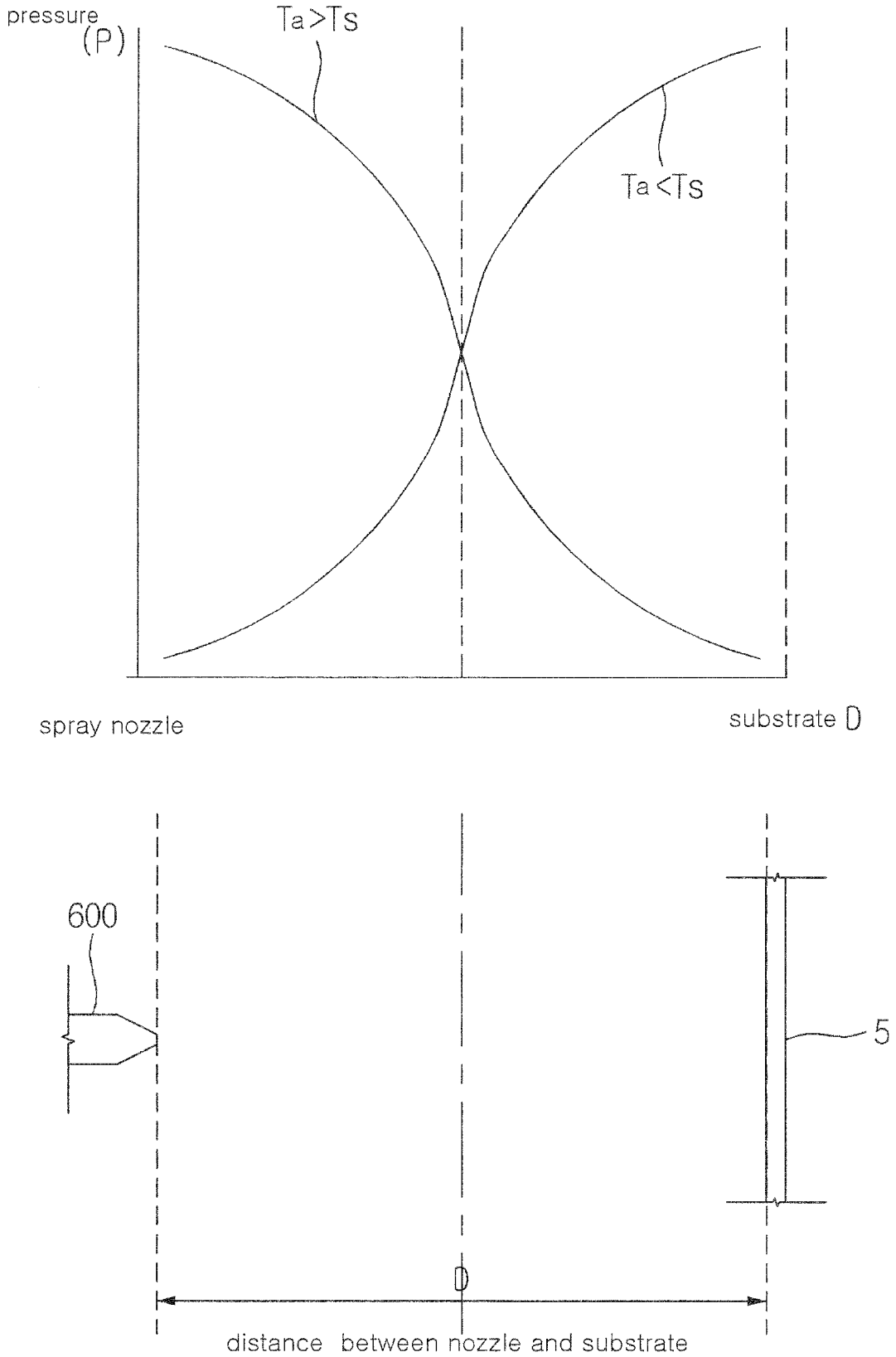
FIG. 42 is a graph showing change of pressure (P) according to the distance between a nozzle and a substrate (D) and temperature of a substrate ($T_s$) and powder ($T_a$) entrained on the carrier air in the outlet of a nozzle.

As shown in [FIG. 42], coating efficiency can be improved as temperature ($T_s$) of the substrate (5) is controlled less than it ($T_a$) of the powder entrained on the carrier air at the outlet of the spray nozzle. Temperature of a substrate can be automatically controlled as the substrate temperature controller (410) is linked to the system control unit (1000) which will be mentioned later. Also, the aerodynamic drag can be minimized by making the coating chamber low vacuumed even if the substrate temperature controller is not used.

7. Particle Collector

A particle collector (730) connected to a vacuum pump (700) through a particle collector connection pipe (720) is installed for collecting residual powder inside the coating chamber which is not coated. The powder heavier than air is collected at the bottom of the coating chamber and air is exhausted to the outside of the coating chamber.

8. System Control Unit

The system control unit is connected to the pressurizer (130), the heater (510), and the cooler (340) and controls pressure, velocity, flow rate, and temperature of carrier air and powder. In the present invention, it is also linked to the air supply unit (100), the air treatment unit (200), the feeder (300), the carrier pipe (500), the spray nozzle (600), the coating chamber (400), the vacuum pump (700), and the particle collector (730) and interacts with them organically according to the necessary conditions.

9. Embodiment Feeding Powder to Spray Nozzle Directly

Figure 38:
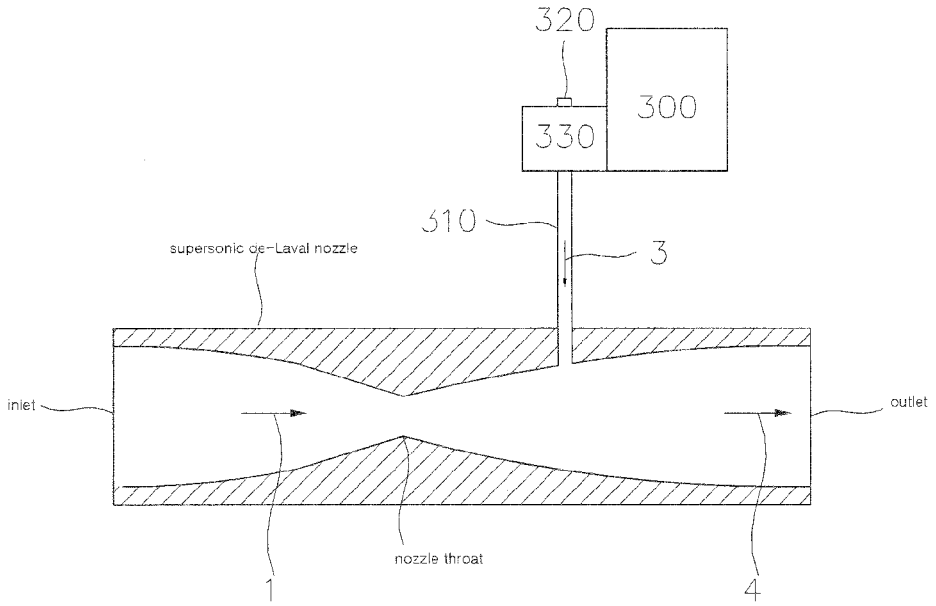
FIG. 38 is a cross sectional view of a supersonic de-Laval nozzle improved to feed powder between the throat and the outlet of a nozzle.
Figure 39:
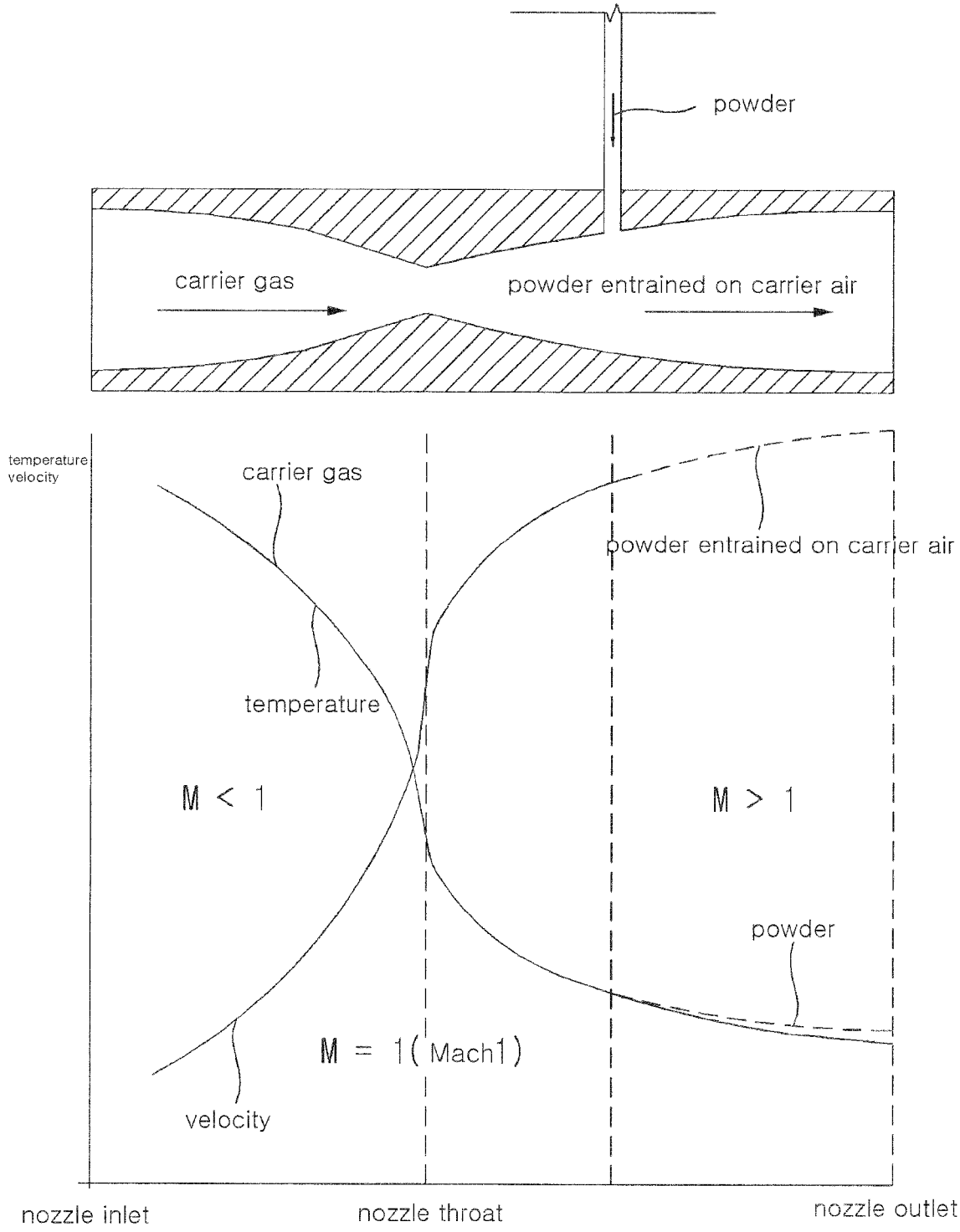
FIG. 39 is a graph explaining changes of temperature and velocity of carrier air and powder when powder under room temperature is fed between the throat and the outlet of a supersonic de-Laval nozzle.

As shown in [FIG. 38], an improved supersonic de-Laval nozzle can be used to generate powder entrained on the carrier air inside the nozzle as powder is fed near the throat of the nozzle. As shown in [FIG. 39], the powder entrained on the carrier air is generated inside the nozzle the moment that the carrier air heated at the inlet of the nozzle passes through the nozzle throat and is mixed with powder. The powder entrained on the carrier air flows at the same velocity as the air and is ejected and coated on a substrate without thermal shock as temperature of carrier air can be heated up to a level not to give thermal shock.

Figure 40:
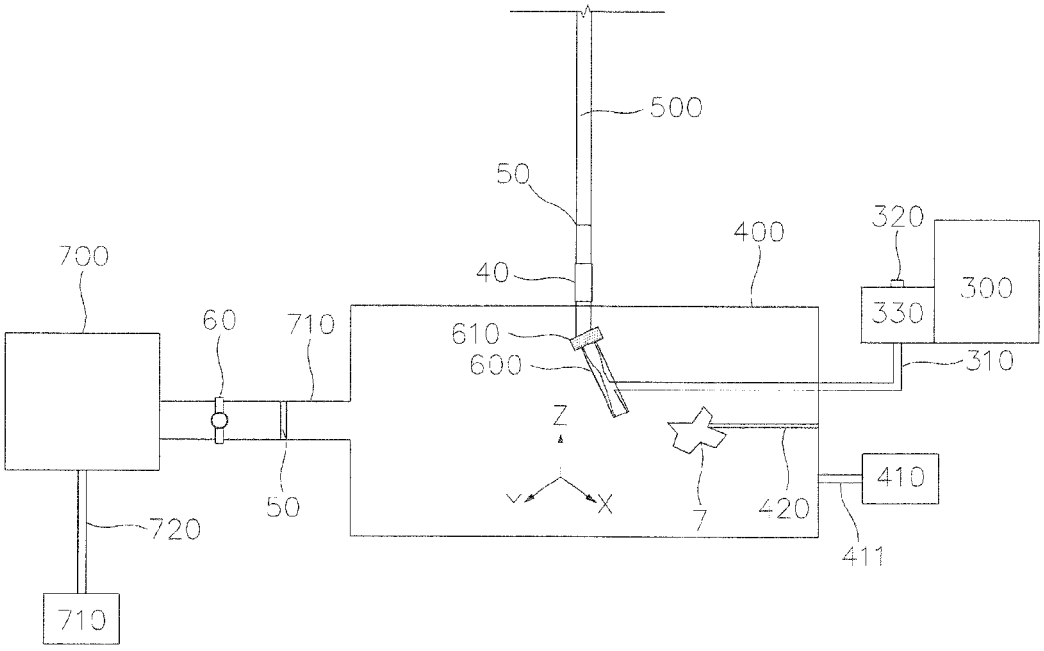
FIG. 40 is a drawing showing a device coating a surface of a 3 dimensional workpiece inside the coating chamber through a supersonic de-Laval nozzle connected to the block-type pipe directly.
Figure 41:
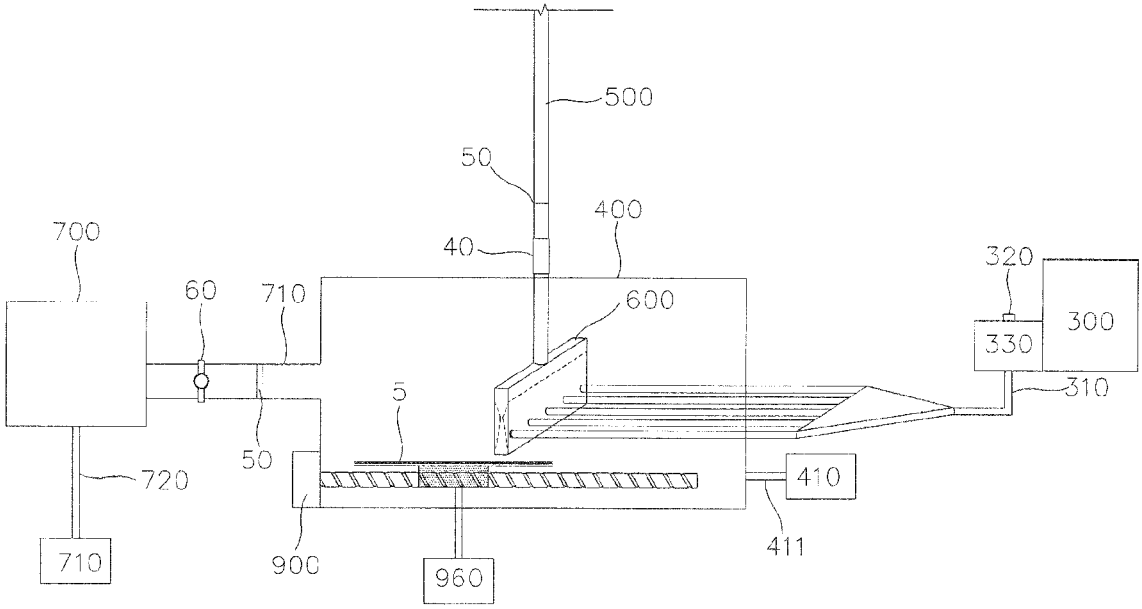
FIG. 41 is a drawing showing a device coating a 2 dimensional large size substrate inside the coating chamber by feeding powder in between the throat and the outlet of a slit-type supersonic de-Laval nozzle.

[FIG. 40] and [FIG. 41] shows embodiments of use of the improved supersonic de-Laval nozzle.

III. Embodiment of Continuous Powder Coating Apparatus with Roll-to-roll Device

1. Summary

The present invention relates to continuous powder coating wherein powder is coated on a substrate uniformly and continuously regardless of size, shape, and specific weight of the powder particle. For obtaining a desirable coating result, are demanded technical factors that prevent vibrations of a flexible substrate caused by pressure of powder entrained on the carrier air ejected from a nozzle. The present invention can be applied not only to general roll-to-roll processes, but to printing a circuit board requiring intricate and accurate operations.

Figure 19:
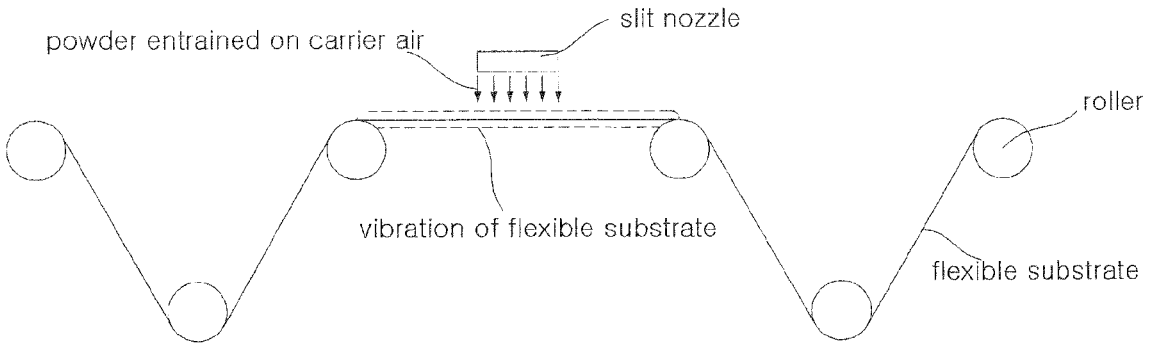
FIG. 19 is a diagram explaining a conventional roll-to-roll device for coating powder on a flexible substrate.

When powder is coated on a flexible substrate, an ordinary roll-to-roll device shown in [FIG. 19] makes it very difficult to form a uniform coating layer because the flexible substrate vibrates up and down by powder entrained on the carrier air ejected from a nozzle.

Figure 20:
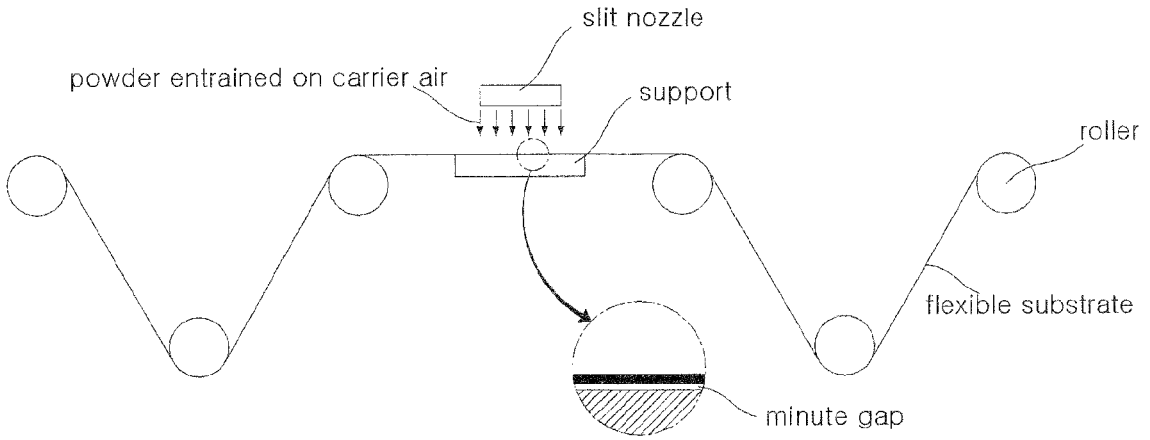
FIG. 20 is a diagram explaining a conventional roll-to-roll device with a support for coating powder on a flexible substrate.
Figure 21:
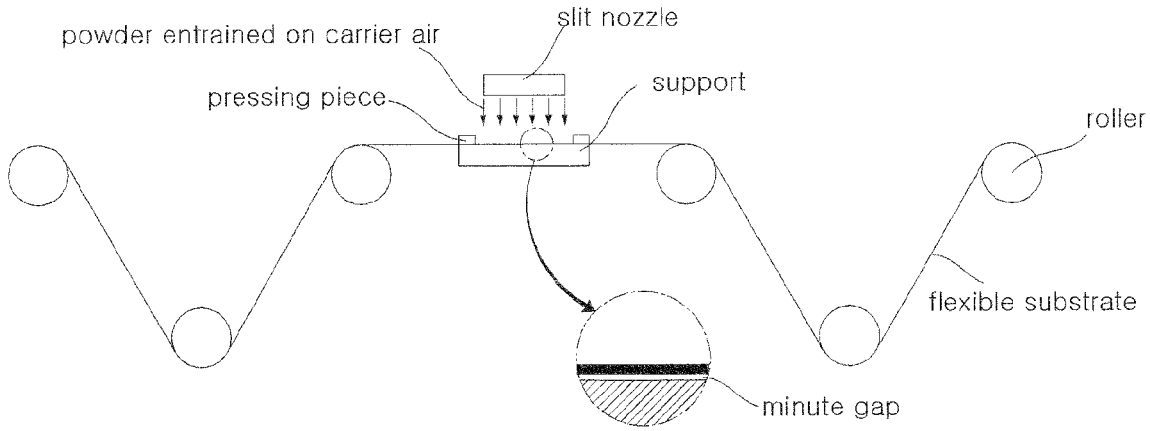
FIG. 21 is a diagram explaining a conventional roll-to-roll device with a support and a pressing piece for coating powder on a flexible substrate.
Figure 22:
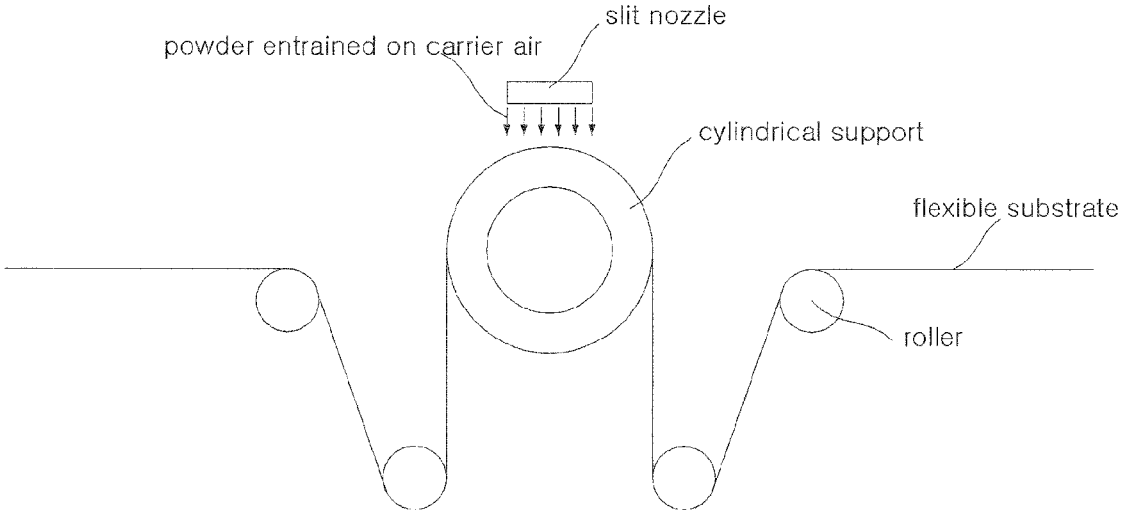
FIG. 22 is a diagram explaining a conventional roll-to-roll device with a cylindrical support for coating powder on a flexible substrate.

As shown in [FIG. 20], to solve the problem, a support can be used to prop up the flexible substrate. But it is not enough to adhere the flexible substrate to the support firmly, especially it is very hard to form a uniform coating layer if the powder such as carbon nanotube is used. To supplement this, as shown in [FIG. 21], a pressing piece which prevents the flexible substrate from being detached from the support can be used. But this cannot completely solve the problem of a gap between the flexible substrate and the support. Another way to solve the problem, as shown in [FIG. 22], is using a cylindrical support to which the flexible substrate can be adhered tight and pass through without the gap between support and it. In this method, however, there is another problem that powder is not coated on the flexible substrate uniformly because it has a curved shape on the cylindrical support although it adheres to the cylindrical support. It would be much better if diameter of the cylindrical support becomes bigger and therefore its curvature is lowered. But there is a weakness that the cost of the devices such as the cylindrical support and the coating chamber increases as sizes of them become bigger.

2. Roll-to-roll Device

Figure 23:
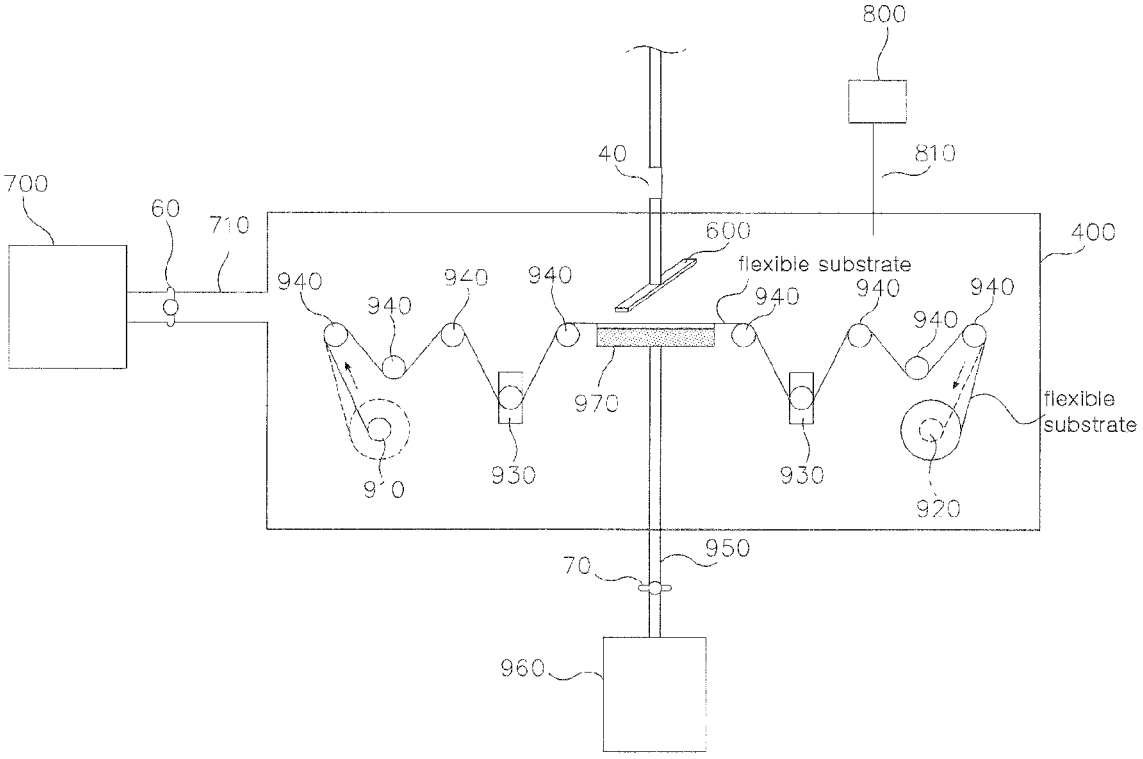
FIG. 23 is a drawing explaining a first embodiment of a roll-to-roll device applied to the present invention.
Figure 24:
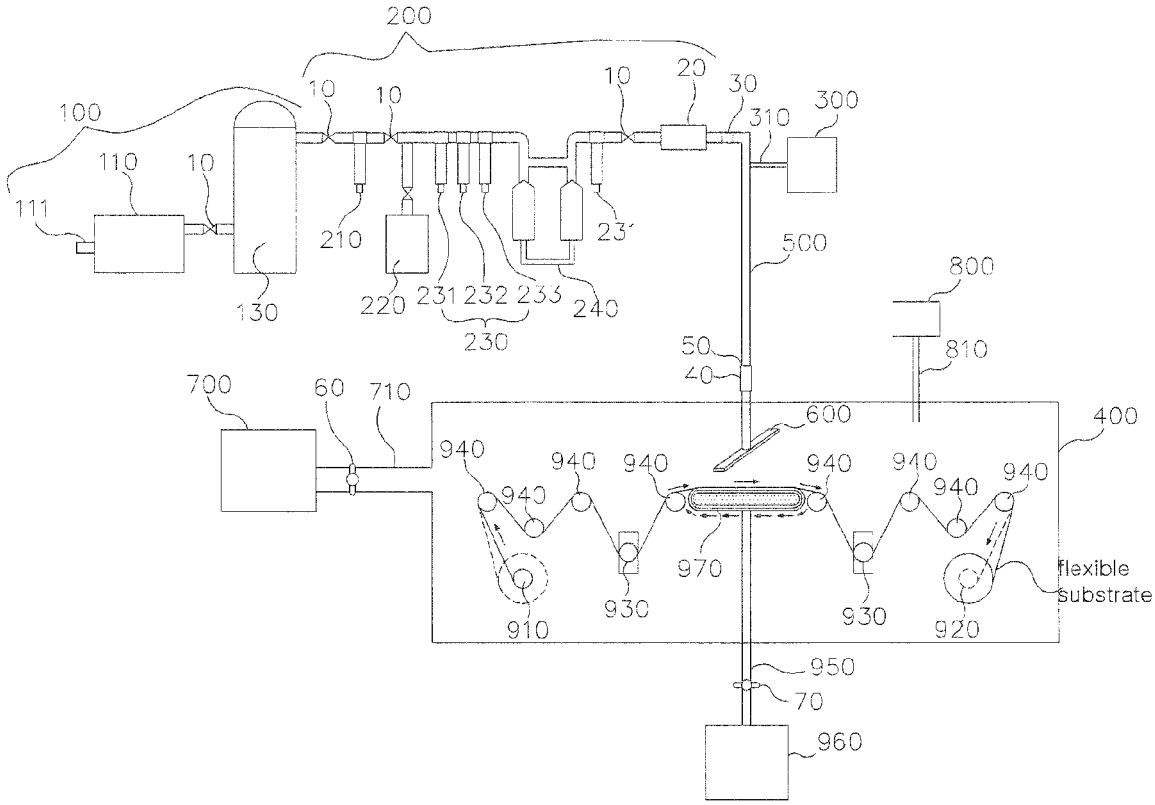
FIG. 24 is a drawing explaining a second embodiment of a roll-to-roll device applied to the present invention.

The present invention includes a roll-to-roll device that a flexible substrate wound on a raveling roller (910) unwinds and is wound on a winding roller (920) by a rotary motion. The ending part of the flexible substrate wound on a raveling roller is pulled and fixed on a wounding roller, and then the wounding roller must be rolled for the flexible substrate to be wound on it. Powder is coated on the flexible substrate in the middle point of both rollers while it winds on the wounding roller. Also, auxiliary rollers can be installed on necessary places in the light of the size and the composition of the coating chamber and direction of tension influencing the flexible substrate as shown in [FIG. 23] and [FIG. 24].

3. Suction Holder and Suction Pump

Figure 25:
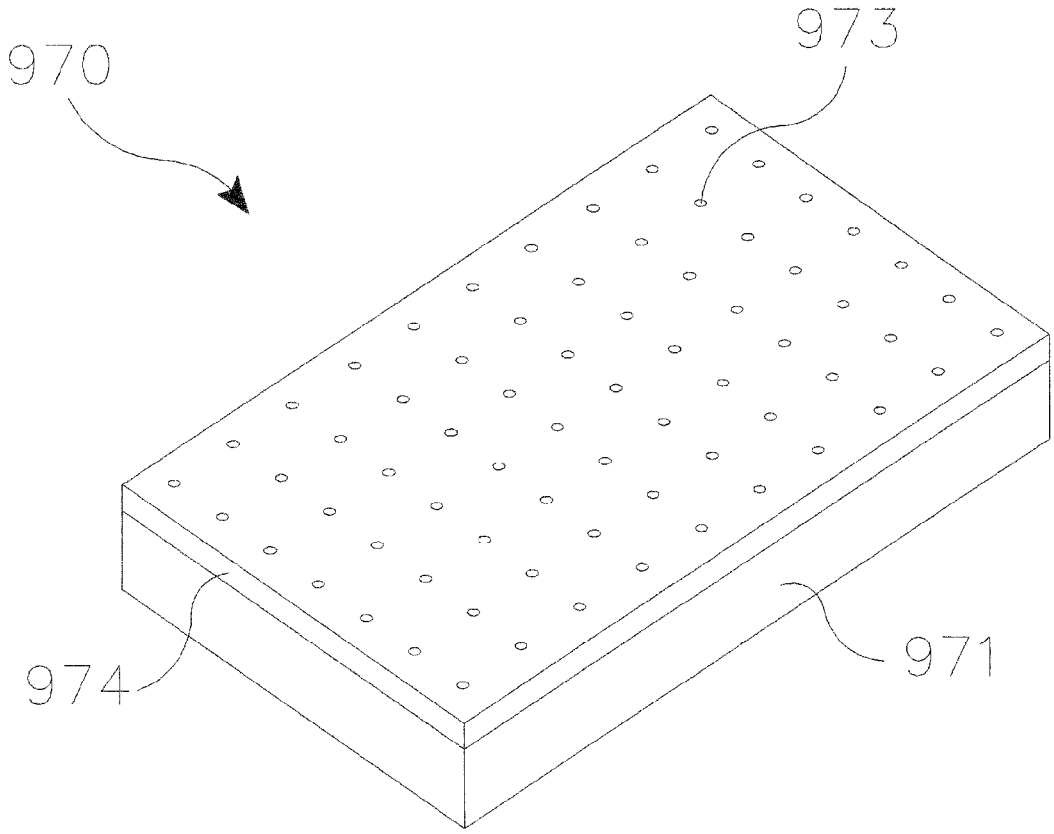
FIG. 25 is a drawing of a vacuum chuck.

The present invention includes a suction holder (970) and a suction pump. The suction holder (970) between the raveling roller and the winding roller props up the coating part of the flexible substrate. It plays a role similar to the support shown in [FIG. 20] and [FIG. 21] in that it supports the flexible substrate. But it is unique to the present invention that the flexible substrate adheres to the support by adsorptive power of the suction pump (960). As shown in [FIG. 23] and [FIG. 24], the suction holder (970) and the suction pump (960) are connected through a suction pump connection pipe (950). Adhesion strength of the suction holder (970) is usually controlled by the suction pump (960), but it could be done more delicately if a suction force controller (70) is installed in the suction pump connection pipe (950). The suction holder (970) can be used by a vacuum chuck shown in [FIG. 25] covered with holes set (974) that has many holes on the top of a suction holder body (971). As the holes set is firmly adhered to the flexible substrate by adsorptive power of air coming through the holes, the impact occurring when powder is coated on the flexible substrate does not affect forming uniform coating layer. Sucking strength of the vacuum chuck should be properly controlled in the light of a moving speed and an adhesive effect of the flexible substrate. It is possible by controlling the adsorptive power of the suction pump (960) and the valve of the suction force controller (70).

Figure 26:
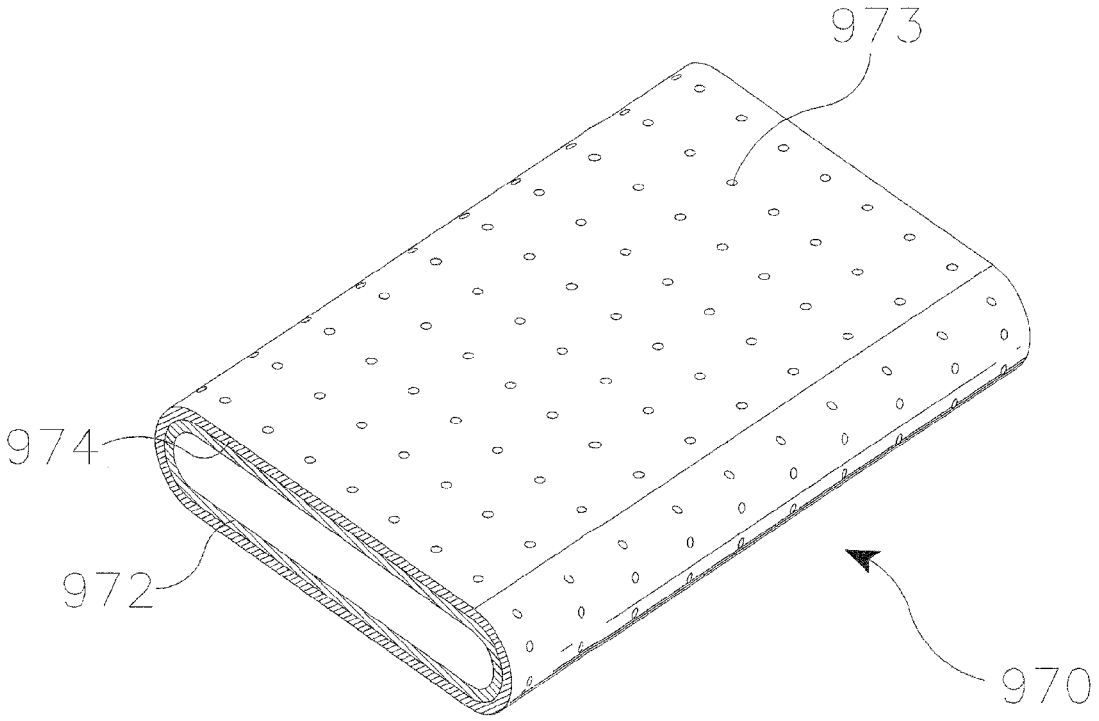
FIG. 26 is a drawing of a revolving vacuum chuck.

On the other hand, the suction holder (970) can be also used by a revolving vacuum chuck shown in [FIG. 26] covered with the holes set (974) which has many holes on a track (972). The revolving vacuum chuck can move the flexible substrate more softly than the vacuum chuck. It is because adsorptive power holding the flexible substrate is naturally removed when the flexible substrate moving horizontally along the track passes the curved part of the track. This is possible because adsorptive power of the suction pump (960) works up and down.

4. Tension Control of Flexible Substrate

The flexible substrate can adhere to the suction holder by adsorptive power firmly, but the crumpled flexible substrate cannot be coated uniformly in spite of tight adhesion between them. The present invention, therefore, includes a tensile strength control roller (930) to solve that problem which is installed in the front or back of the suction holder between the raveling roller (910) and the winding roller (920). The tensile strength control roller can stretch the flexible substrate tight to spread out the crumpled part and tensile strength can be adjusted according to the kinds of the flexible substrates.

IV. Embodiments of Powder Feeding by Minus Pressure

1. Summary

The present invention provides a method and an apparatus by which powder under atmospheric pressure can be fed into the carrier pipe in which carrier air over atmospheric pressure flows. In order to feed powder into the carrier pipe more than atmospheric pressure, a spot inside the carrier pipe where powder is fed must keep minus pressure by controlling the feeding system. Consequently, the present invention does not take the conventional feeding method that injects powder into the carver pipe with higher pressure than pressure of the inside of the carrier pipe. The present invention replaces it with a more effective and natural new method as mentioned above. That is, the first key point of the method applied in the present invention is that powder at the atmospheric pressure state flows into the specific space with minus pressure in the carrier pipe. The minus pressure space inside the carrier pipe can be formed by application of principles of a subsonic nozzle and a supersonic nozzle in connection with cross-sectional area of the carrier pipe, pressure of the carrier pipe, and velocity of the carrier air. The ultimate goal feeding powder into the carrier pipe is that the powder entrained on the carrier air is ejected on a substrate by high pressure. The second key point of the present invention, therefore, is making it possible that powder fed into the carrier pipe. The apparatuses that powder at atmospheric pressure is softly fed into a specific space at minus pressure of the carrier pipe are shown in the following two embodiments.

2. First Embodiment

Figure 7:
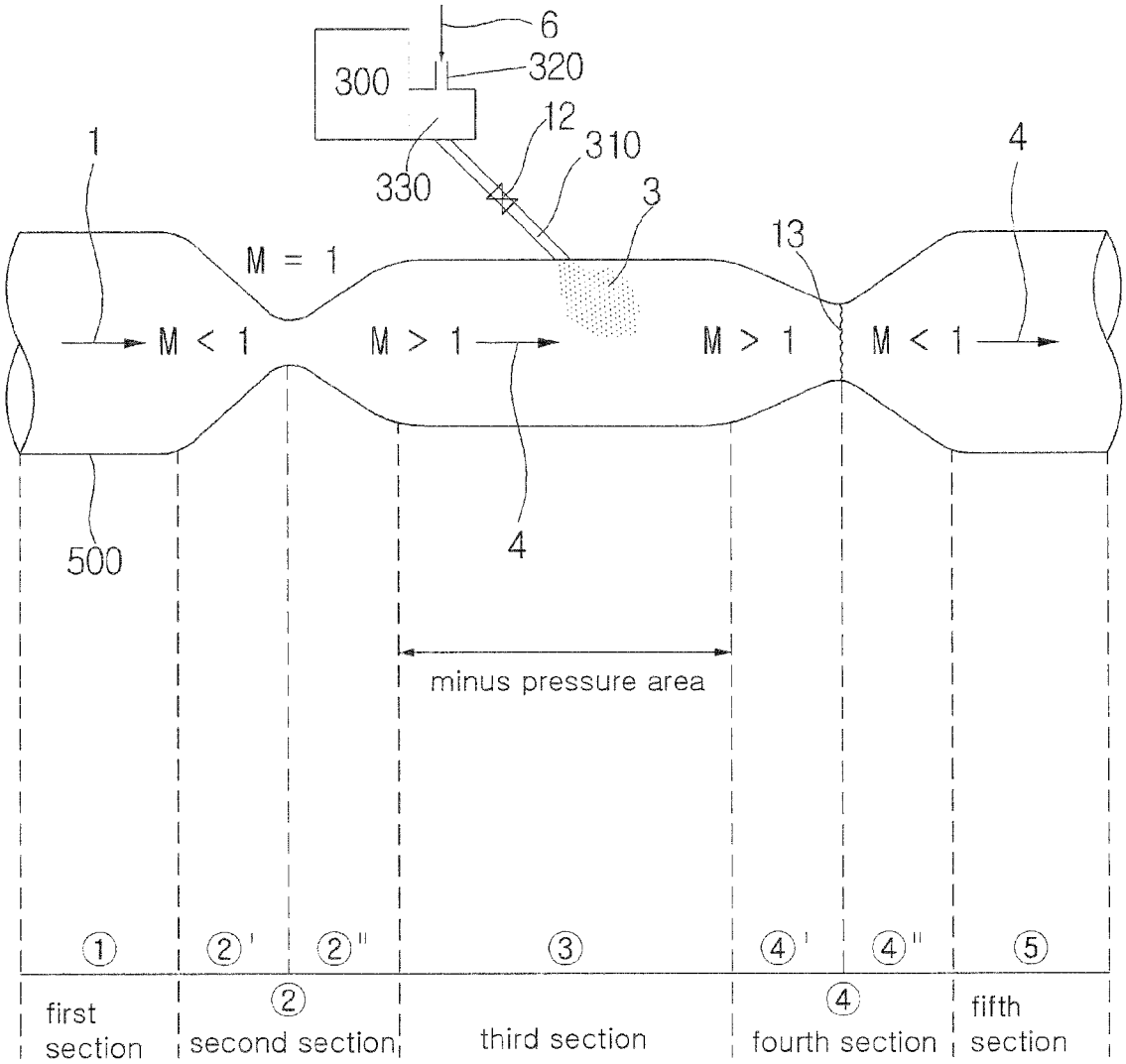
FIG. 7 is a cross-sectional view explaining a first embodiment of a carrier pipe applied to the present invention.

As shown in [FIG. 7], the carrier pipe of the first embodiment is divided into the five sections such as a first section, a second section, a third section, a fourth section, and a fifth section. A pipe diameter of the first section, the third, and the fifth does not change, but the second and the fourth have a throat in the middle of a pipe and so a pipe diameter gradually scales down moving toward the throat from the ends of each section. The throat of the fourth section is bigger than it of the second section. The third section is connected to the feeder (300) by a connection pipe (310) and a block chamber (330) which has an open side (320) on its top.

Figure 6:
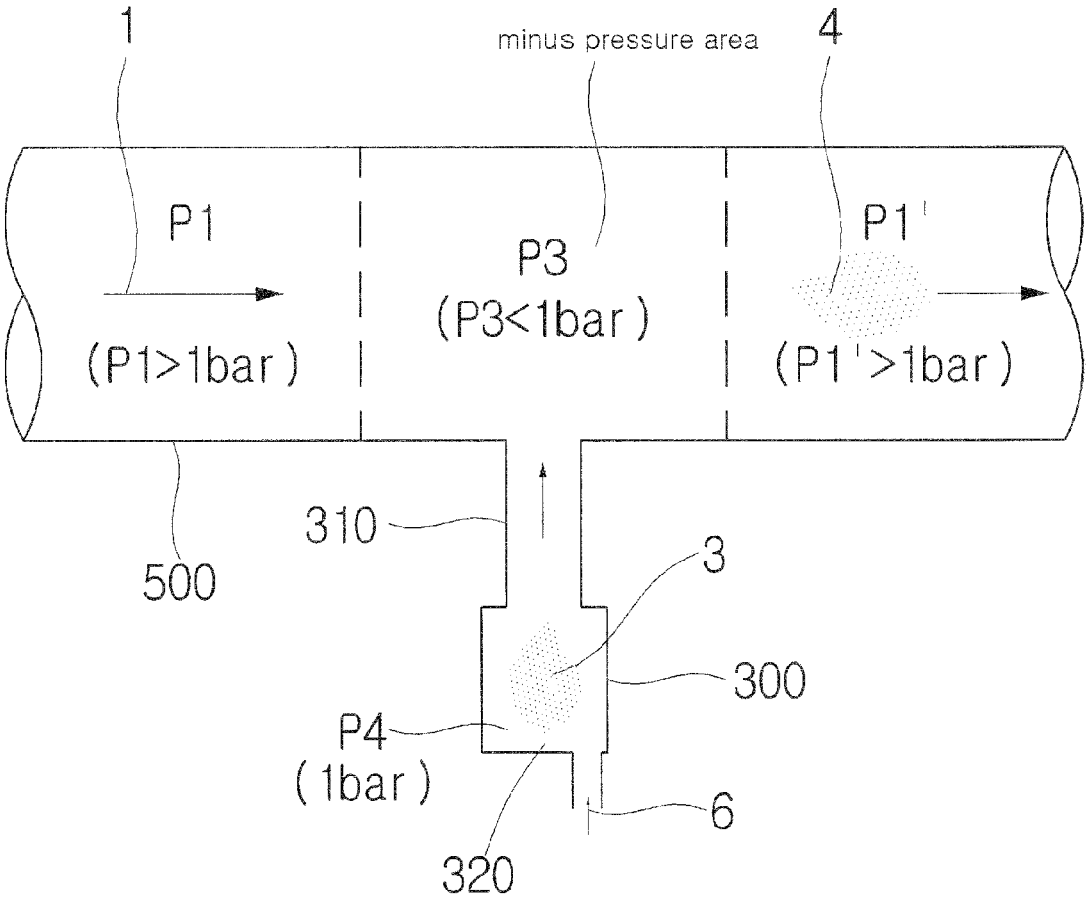
FIG. 6 is a drawing of a device feeding powder in a minus pressured section of a carrier pipe with pressure higher than atmospheric pressure.

As shown in [FIG. 6], powder at atmospheric pressure ($P_4$) is fed into said carrier pipe (500) containing carrier air higher than atmospheric pressure ($P_1$, $P_1'$) as forming a specific section at minus pressure ($P_3$) in the carrier pipe. For this feeding, the cross-sectional area of the carrier pipe in the first section and the fifth section should be shaped as shown in [FIG. 7]. In the present embodiment, pressure lowered in the minus pressure section abruptly increases in the fourth section by shock wave generated by a supersonic air. Accordingly, required pressure and spray velocity of the powder entrained on the carrier air can be formed by controlling change of cross-sectional area of the carrier pipe and a spot where shock wave occurs. The place in which shock wave happens can be controlled by adjusting pressure of carrier air flowed into the carrier pipe.

In the first section (①), a pipe diameter is uniform and carrier air has pressure higher than atmospheric pressure and subsonic velocity. Temperature of carrier air either increases or decreases by change of cross-sectional area of the carrier pipe after the first section (①). Prevention of thermal shock on a substrate or smooth flow of powder entrained on the carrier air can be accomplished by controlling temperature of the carrier air. For instance, the carrier air should be properly heated in the first section lest its temperature drop below 273K (0° C.) in the third section after powder is transported there because powder with a little moisture can be agglomerated. This can be explained by [FIG. 12] and an equation of isoentropic quasi-one-dimensional flow. The theoretical explanation of how temperature of carrier air passing through the third section changes according to temperature of the carrier air passing through the first section is shown in relation between an equation of isoentropic quasi-one-dimensional flow (Equation 6) and an equation of flow generating normal shock wave (Equation 7).

Equation of relation between Mach number and temperature in isoentropic quasi-one-dimensional flow;

$$To = Te\left(1 + \left(\frac{\gamma - 1}{2}\right)M^2\right) \quad \text{(Equation 6)}$$

γ=specific heat ratio (Example; if carrier gas is air, γ=1.4)

M=Mach number

To=Temperature of carrier gas at inlet of the second section
Te=Temperature of carrier gas at outlet of the second section
Equation of flow generating normal shock wave $$T_1\left(1+\frac{\gamma-1}{2}M_1^2\right)=T_2\left(1+\frac{\gamma-1}{2}M_2^2\right) \quad \text{(Equation 7)}$$

$T_1$=Temperature of carrier gas before normal shock wave
$T_2$=Temperature of carrier gas after normal shock wave
$M_1$=Mach number of carrier gas before normal shock wave
$M_2$=Mach number of carrier gas after normal shock wave From (Equation 6), the more Mach number of carrier air that has passed the throat (boundary between a reducing section and an expanding section of a pipe diameter, the same shall apply hereafter) of the second section (②) increases, the more temperature of carrier air at the outlet of the second section falls rapidly compared to it at the inlet of the second section. From (Equation 7), Mach number of the carrier air after normal shock wave happens becomes subsonic (M<1) and at this moment temperature of the carrier air increase steeply. This can be explained clearly with reference to [FIG. 12].

Figure 12:
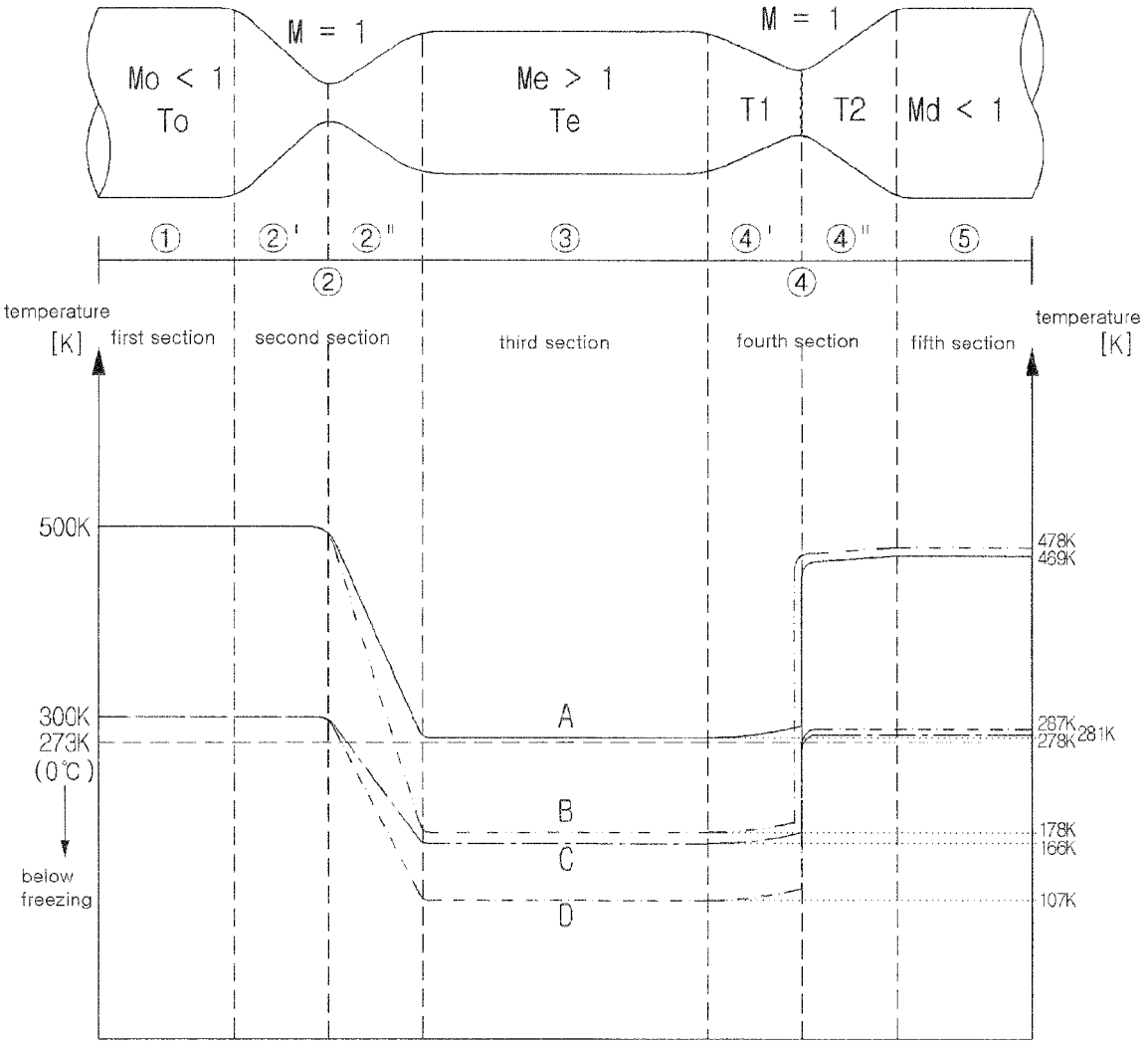
FIG. 12 is a graph showing a temperature change of carrier air from the first section to the fifth section in connection with temperature of carrier air in the first section of a carrier pipe (the first embodiment) and a Mach number of carrier air in the third section of a carrier pipe.

[FIG. 12] shows temperature changes of the carrier air from the first section to the fifth section according to temperature of the carrier air in the first section and Mach number of the carrier air in the third section. It has two cases, when temperature of the carrier air in the first section is 500K and 300K.

First, when temperature of the carrier air ($T_0$) in the first section is 500K;

(1) When Mach number of the carrier air ($M_e$) in the third section is 2 (Case A), temperature of the carrier air ($T_e$) in the third section is about 278K and temperature ($T_2$) of the carrier air having passed the throat of the fourth section becomes about 469K because of the normal shock wave occurring in the throat of the fourth section.

(2) When Mach number of the carrier air ($M_e$) in the third section is 3 (Case B), temperature of the carrier air ($T_e$) in the third section is about 178K and temperature ($T_2$) of the carrier air having passed the throat of the fourth section becomes about 478K because of the normal shock wave occurring in the throat of the fourth section.

Consequently, the 278K carrier air does not make powder frozen in Case A but the 178K carrier air could make powder frozen in Case B.

Second, when temperature of the carrier air ($T_0$) in the first section is 300K;

(1) When Mach number of the carrier air ($M_e$) in the third section is 2 (Case C), temperature of the carrier air ($T_e$) in the third section is about 166K and temperature ($T_2$) of the carrier air having passed the throat of the fourth section becomes about 281K because of the normal shock wave occurring in the throat of the fourth section.

(2) When Mach number of the carrier air ($M_e$) in the third section is 3 (Case D), temperature of the carrier air ($T_e$) in the third section is about 107K and temperature ($T_2$) of the carrier air having passed the throat of the fourth section becomes about 287K because of the normal shock wave occurring in the throat of the fourth section As a result, powder could be frozen in both Case C and Case D because temperature ($T_e$) of the carrier air in the third section is under 274K.

The above four cases are shown in the following [Table 2].

TABLE 2

| Case | $T_o$[K] | $M_e$ | $T_e$[K] | $T_2$[K] |
|---|---|---|---|---|
| A | 500 | 2 | 278 | 469 |
| B | 500 | 3 | 178 | 478 |
| C | 300 | 2 | 166 | 281 |
| D | 300 | 3 | 107 | 287 |

As shown in the four cases, temperature of the carrier air in the first section and Mach number of the carrier gas in the third section should be controlled to keep temperature of the carrier air in the third section above freezing. Explanation of the supersonic speed (M>1) in the third section will be given later.

In the second section (②), a pipe diameter gradually scales down up to the pipe throat and then scales up after passing it. Namely, the pipe in the second section has the identical shape as it of the supersonic nozzle and therefore speed of the carrier air after passing the second section becomes supersonic. Velocity of the carrier air in the converging part (②') of the second section (②) is subsonic (M<1) and pressure of it continuously decreases up to the throat of the second section. At the throat of the second section, Mach number of the carrier air becomes 1 (M=1) and it becomes more than 1, that is, supersonic (M>1), in the diverging part (②") of the second section and pressure of the carrier air continuously decreases (pressure of the carrier air decreases when the diameter of the pipe containing the supersonic carrier air diverges).

The supersonic velocity of carrier air in the second section (②) is decided by shapes of the carrier pipe such as inlet, throat, and cross-sectional area of outlet in the second section and conditions such as pressure and temperature at the inlet and at the outlet in the second section.

The third section (③) of the carrier pipe has a uniform cross-sectional area to shape a minus pressure part in the section. Powder of the feeder at atmospheric pressure can be fed into the minus pressure part of the third section as it is not congested or does not flow backward. In this way, the powder entrained on the carrier air is generated in the third section.

In order to make pressure of the feeder keep at atmospheric pressure (1 bar), the feeder must have an open side on it. And as an air filter is installed in the open side, the impurity such as dust could not flow in to the feeder. A delicate screw with a small diameter is installed in the pipe transporting powder and it can be controlled by RPM of a motor or by a control valve installed on the pipe so that powder may be fed into the third section of the carrier pipe continuously and uniformly without pulsation. Also, an angle of the powder carrier pipe penetrated into the third section could be controlled to make powder and carrier air mixed well.

Figure 10:
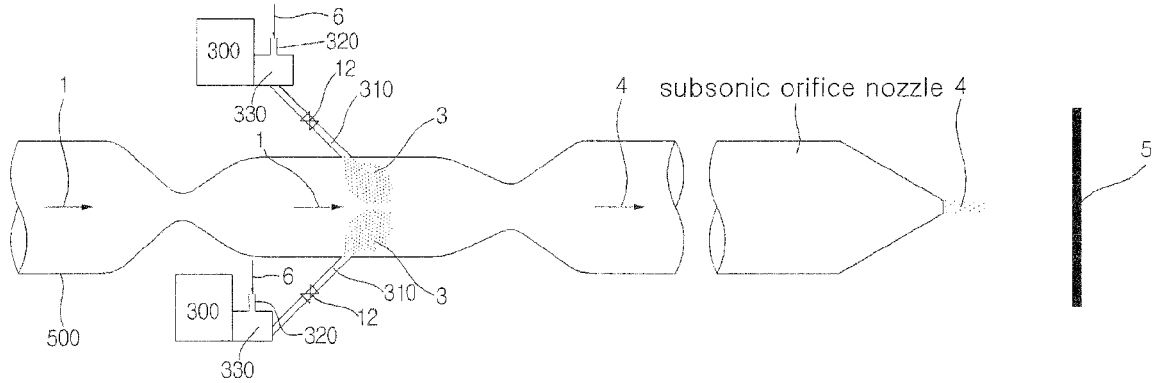
FIG. 10 is a drawing explaining an embodiment of two feeders connected to a part with minus pressure and a subsonic orifice nozzle connected to the end of a carrier pipe.
Figure 11:
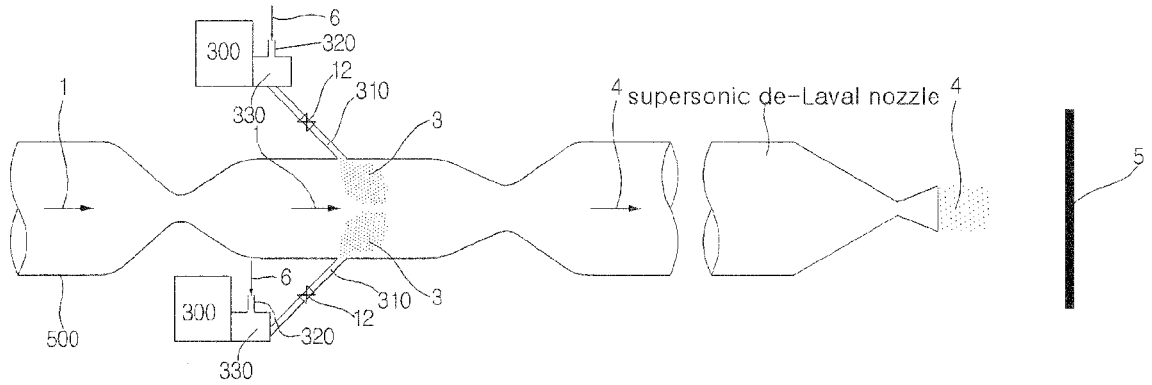
FIG. 11 is a drawing explaining an embodiment of two feeders connected to a part with minus pressure and a supersonic de-Laval nozzle connected to the end of a carrier pipe.

[FIG. 10] and [FIG. 11] are embodiments of the multi-connected feeder that show powders feeding. It makes it possible that several powders can be fed into the third section at the same time.

In the diverging part (②") of the second section (②), Mach number of the carrier air is bigger than 1 (M>1) and in the third section, temperature falls rapidly as Mach number of the carrier air increases. When powder and air at atmospheric pressure are fed into the minus pressure part of the third section, uniform density of the flowing powder entrained on the carrier air cannot be kept because density of the powder entrained on the carrier air does not become uniform as moisture included in the air is frozen. In order to solve the problem, the carrier air is heated in the first section (①) beforehand and is transported to the second section (②). Temperature of the heated carrier air can be set after temperature of the nozzle inlet and the nozzle outlet and temperature of the carrier air when it impinges on a substrate, that is, not giving thermal shock on the substrate, are considered.

In the fourth section (④), the diameter of the pipe converges up to the pipe throat and then diverges again at a certain ratio. And in the same section, pressure increases by shock wave and speed of the carrier air becomes subsonic again. The supersonic velocity (M>1) of the carrier air formed in the third section is continuously maintained in the converging part (④') of the fourth section. On the other hand, in the converging part (④') of the fourth section, the powder entrained on the carrier air formed in the third section keeps the supersonic velocity and pressure gradually increases as the diameter of the pipe decreases. But in the throat of the fourth section, pressure of the powder and the carrier air rapidly increases because of shock wave formed by the supersonic velocity of the carrier air.

Figure 9:
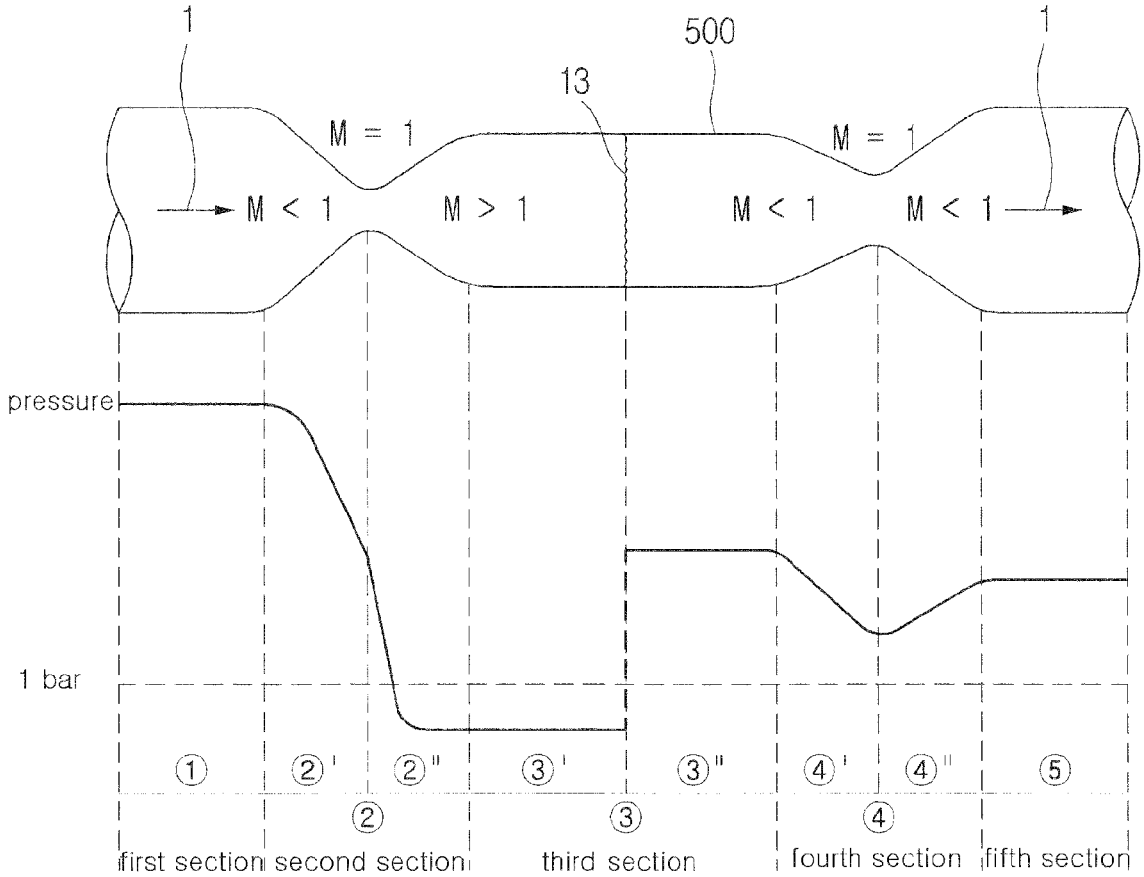
FIG. 9 is a graph showing how a change of a place where a shock wave occurs has an effect on a change of pressure inside the carrier pipe.

In the diverging part (④) of the fourth section (④), the supersonic velocity (M>1) of the carrier air formed in the third section becomes subsonic (M<1) again because of shock wave generated in the throat and as a result, pressure increases steeply. So pressure of the carrier air flowed in to the fifth section through the fourth section is little different from it of the initial carrier air transported to the first section. Velocity of the carrier air becomes supersonic after passing through the second section and as a result, shock wave happens. The present invention, as shown in [FIG. 9], utilizes the third section as a section forming minus pressure so that shock wave may not happen. To achieve this, pressure of the carrier air in the first section must decrease and shock wave should be controlled to be generated in the throat of the fourth section after passing the third section. If the shock wave occurs in the third section, minus pressure space could not be formed in the third section and therefore not only does it become difficult to feed powder, but pressure loss of the powder and the carrier air becomes big in the fifth section as shown in the [FIG. 9] graph. According to the ideal air one-dimensional steady flow equation (PA=P'A'), the value multiplied pressure (P) at the throat of the second section by cross-sectional area (A) of it must equal the value multiplied pressure (P') at the throat of the fourth section by cross-sectional area (A') of it. Pressure in the throat of the second section is bigger than it in the throat of the fourth section because entropy of the carrier air increases as passing the fourth section. So the cross-sectional area (A') of the throat of the fourth section must be bigger than it (A) of the throat of the second section.

The fifth section has a uniform diameter of the pipe. Pressure in the fifth section almost reaches it in the first section again and is kept continuously. And a subsonic orifice nozzle as shown in [FIG. 10] or a supersonic de-Laval nozzle as shown in [FIG. 11] can be connected to the end of the fifth section to spray the powder entrained on the carrier air on a substrate which is at atmosphere or at the coating chamber.

3. Second Embodiment

The present invention provides an apparatus for powder feeding. It is composed of a spray nozzle that is connected to the end of the carrier pipe, one or several feeders that are connected to the second section of the carrier pipe through the powder pipe and have an open side on them, and the carrier pipe which consists of the first section that the diameter of the carrier pipe is uniform up to one point and converges at a certain ratio, the second section that the diameter of the pipe is uniform up to one point and then diverges at a certain ratio, and the third section that has the uniform diameter of the pipe.

Figure 13:
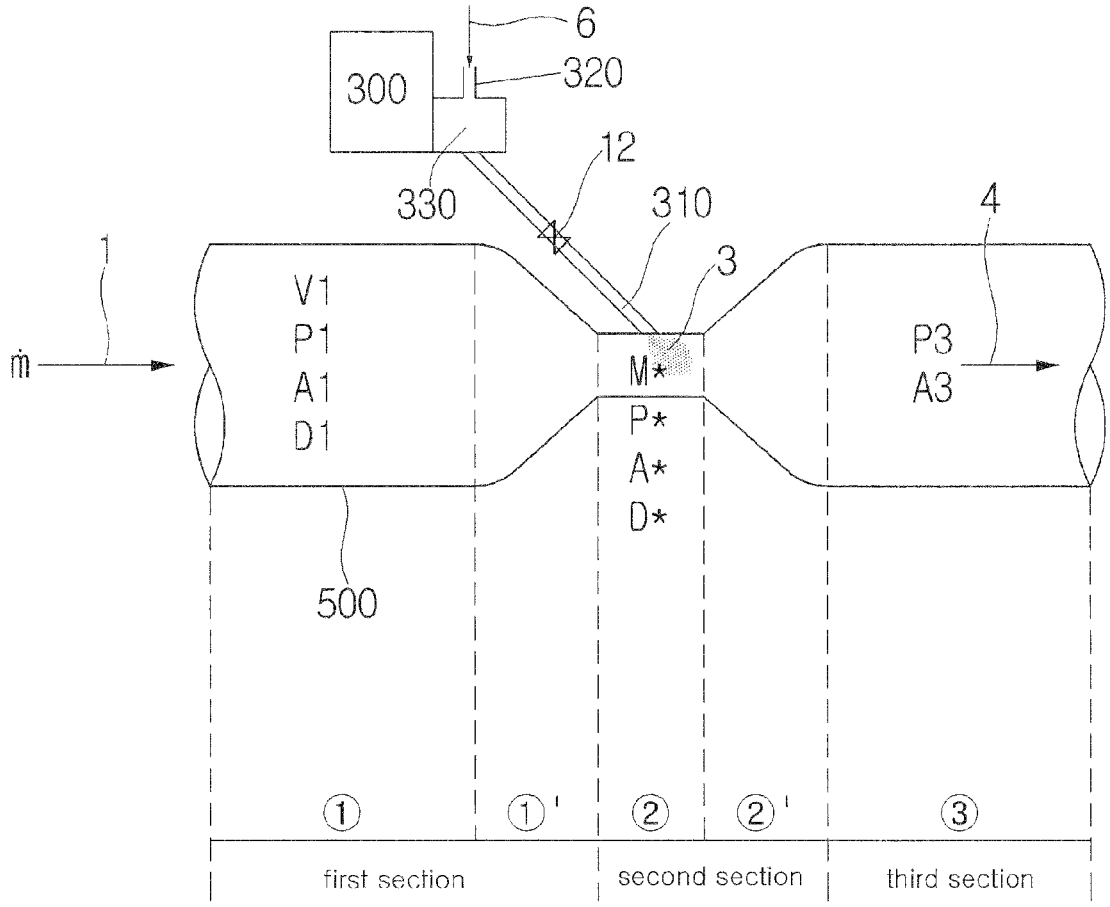
FIG. 13 is a drawing explaining a second embodiment of a carrier pipe applied to the present invention.

In the present invention, powder (3) at atmospheric pressure is fed into the carrier pipe (500) as the minus pressure space is formed in the carrier pipe (500) as shown in [FIG. 13]. The carrier pipe, therefore, is divided into from the first section to the third section.

The first section is divided into two parts. The diameter of one part is uniform (hereafter, ① area) and one of the other part converges at a certain ratio (hereafter, ①' area). The carrier air with higher pressure than atmospheric pressure is transported to the first section. In the ① area the carrier gas is appropriately heated to eliminate thermal shock on a substrate or to transport the powder entrained on the carrier air smoothly.

The second section is composed of two parts. One part has a uniform diameter from the end of the ① ' area to a certain point (hereafter, ② area) and the other part has a diverging diameter of the carrier pipe (hereafter, ②' area). The minus pressure space can be formed in the ② area or the ②' area of this section.

In order to form uniform minus pressure in the whole ② area of the second section, the cross-sectional area of the carrier pipe and the mass flow rate, velocity, pressure of the carrier gas must be properly set by application of the continuity equations of isoentropic quasi-one-dimensional flow (Equation 1 to Equation 4).

A detailed explanation of (Equation 1) to (Equation 4) with regard to relations among the mass flow rate, velocity of the carrier air, and cross-sectional area of the carrier pipe was given in [Detailed description of the invention].

In the case that air is used as carrier gas, the embodiment of the cases that minus pressure happens at the ② area in the second section of the carrier pipe or not is shown in [Table 3] (Refer to [FIG. 13]).

TABLE 3

| Case | D1[mm] | D*[mm] | m[kg/s] | T1[K] | V1[m/s] | P1[torr] | M* | P*[torr] | Remarks |
|---|---|---|---|---|---|---|---|---|---|
| A | 12 | 3.5 | 0.00104 | 328 | 7.5 | 800 | 0.300 | 752 | Minus pressure |
| B | 12 | 3.8 | 0.00104 | 328 | 7.5 | 800 | 0.297 | 765 | Positive pressure |
| C | 15 | 2.6 | 0.00104 | 328 | 4.8 | 800 | 0.297 | 753 | Minus pressure |
| D | 15 | 3.0 | 0.00104 | 328 | 4.8 | 800 | 0.218 | 774 | Positive pressure |

In [Table 3], D1 is a diameter of the ① area in the first section. m is the mass flow rate of the carrier air. T1 is temperature of the carrier air at the ① area in the first section. V1 is velocity of the carrier air at the ① area in the first section. P1 is pressure of the carrier air at the ① area in the first section. D* is a diameter of the ② area in the second section. M* is Mach number of the carrier air at the ② area in the second section. P* is pressure of the carrier air at the ② area in the second section. In the Case A of [Table 3], the diameter of the ① area in the first section is 12 mm and the diameter of the ② area in the second section is 3.5 mm and therefore minus pressure lower than 760 torr (atmospheric pressure) is formed at the ② area. As a result, powder in the feeder is fed into the ② area of the carrier pipe. On the other hand, in the Case B, the diameter of the ① area in the first section is 12 mm and the diameter of the ② area in the second section is 3.8 mm and thus positive pressure higher than 760 torr (atmospheric pressure) is formed at the ② area. In this situation powder is not fed into the ② area of the carrier pipe because powder is under atmospheric pressure (760 torr). In the Case C, the diameter of the ① area in the first section is 15 mm and the diameter of the ② area in the second section is 2.6 mm. And minus pressure lower than 760 torr (atmospheric pressure) is formed at the ② area. As a result, powder in the feeder is fed into the ② area of the carrier pipe. But in the Case D the diameter of the ① area in the first section is 15 mm and the diameter of the ② area in the second section is 3.0 mm. At this case, positive pressure higher than 760 torr (atmospheric pressure) is formed at the ② area and powder is not fed into the ② area of the carrier pipe. Consequently, [Table 3] shows that when conditions of the carrier pipe (cross-sectional area, temperature, pressure, velocity, and mass flow rate of the carrier air) are properly set, minus pressure at the ② area in the second section is formed and powder can be transported softly. The conditions of the carrier pipe vary according to the purpose of the use. A condition of the carrier pipe suitable for the purpose of the use can be set by application of the above mentioned (Equation 1) to (Equation 4).

Figure 14:
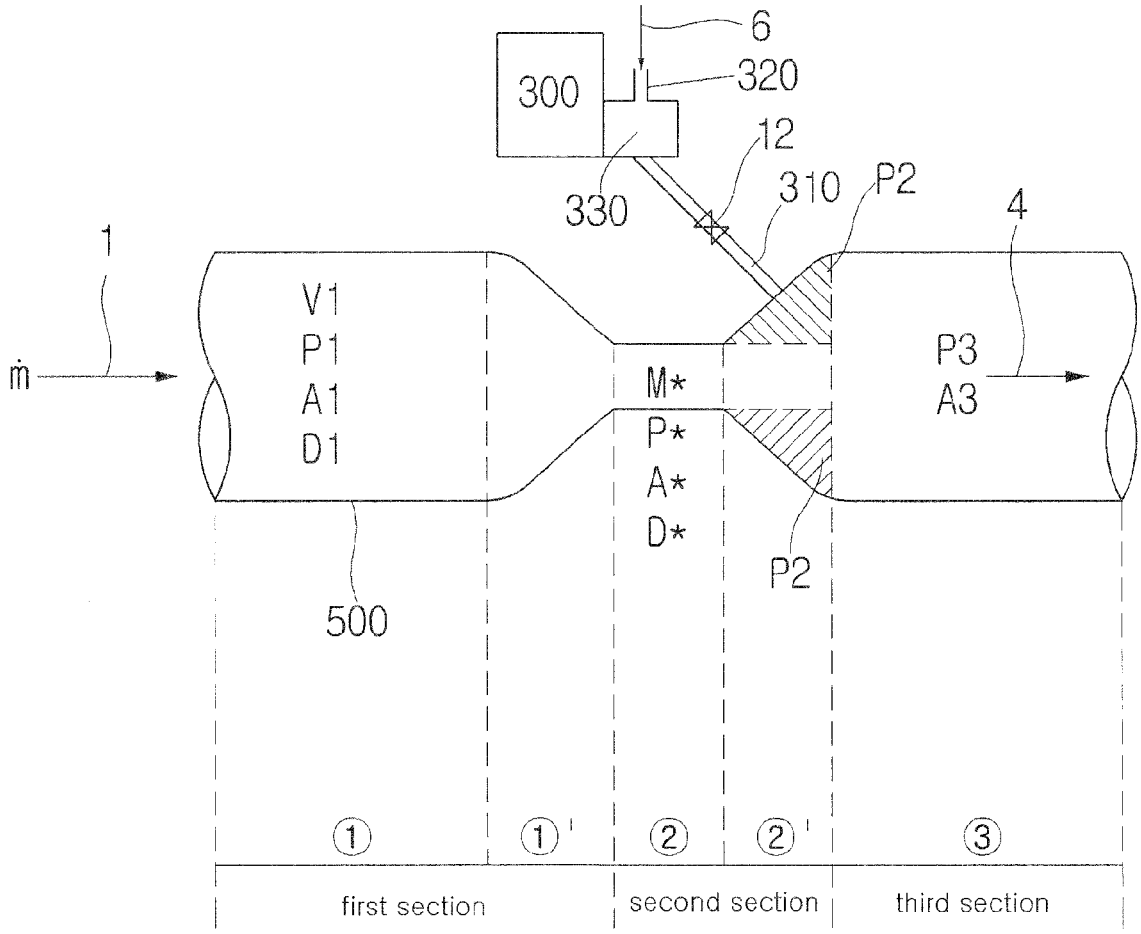
FIG. 14 is a drawing explaining a second embodiment of a carrier pipe with another minus pressure space.

On the other hand, as shown in [FIG. 14], when the carrier air is flowed in to the third section after passing through the ② area and the ②' area, minus pressure (P2) is formed in the shadowed area and therefore powder can be fed in to the shadowed area through the powder pipe. As pressure of the ②' area is lower than it inside the feeder (2), the powder is fed in to the ②' area without flowing backward or being congested and then mixed with the carrier air.

In order to make pressure of the feeder keep at atmospheric pressure (1 bar), the feeder must have an open side on it. And as air filter is installed in the open side, the impurity such as dust could not flow in to the feeder. A delicate screw with a small diameter is installed in the pipe transporting powder and it can be controlled by RPM of a motor or by a control valve installed on the pipe so that powder may be fed into the second section of the carrier pipe continuously and uniformly without pulsation. Also, an angle of the powder carrier pipe penetrated into the second section could be controlled to make powder and carrier air mixed well.

Figure 15:
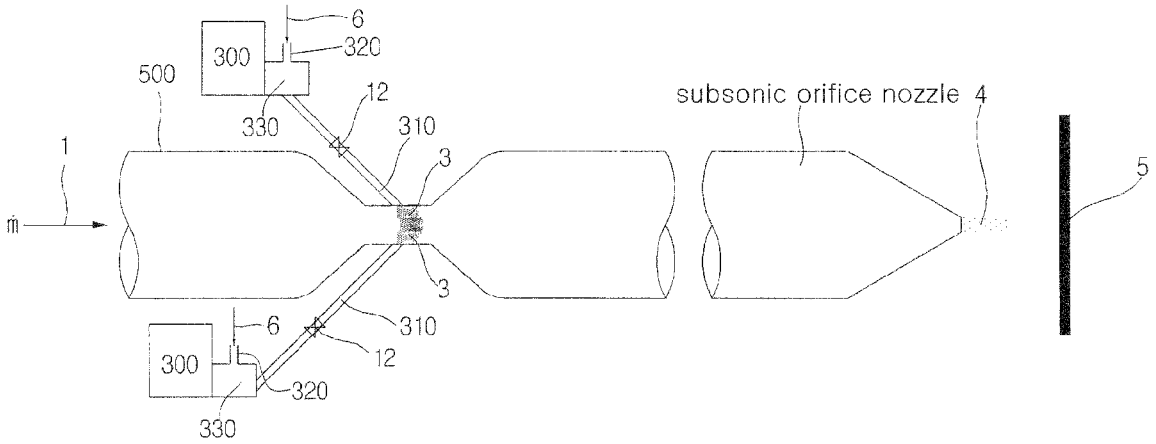
FIG. 15 is a drawing explaining a second embodiment of two feeders connected to the first ② area in the second section of a carrier pipe and a subsonic orifice nozzle connected to the end of a carrier pipe.
Figure 18:
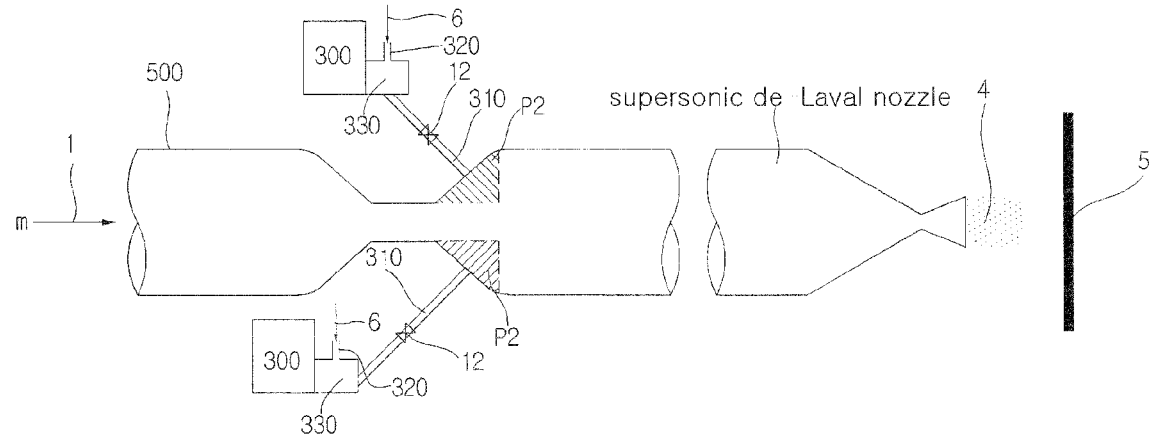
FIG. 18 is a drawing explaining a second embodiment of two feeders connected to the region shaded by slanted lines in the second section of a carrier pipe and a supersonic de-Laval nozzle connected to the end of a carrier pipe.

[FIG. 15] to [FIG. 18] are embodiments of the multi-connected feeder that show powders feeding. It makes it possible that several powders can be fed into the second section once.

Figure 16:
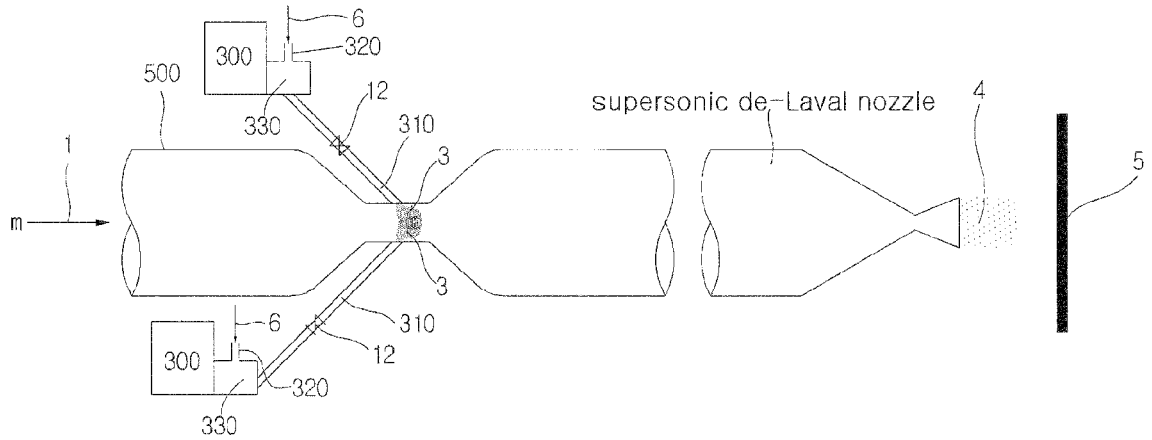
FIG. 16 is a drawing explaining a second embodiment of two feeders connected to the first ② area in the second section of a carrier pipe and a supersonic de-Laval nozzle connected to the end of a carrier pipe.
Figure 17:
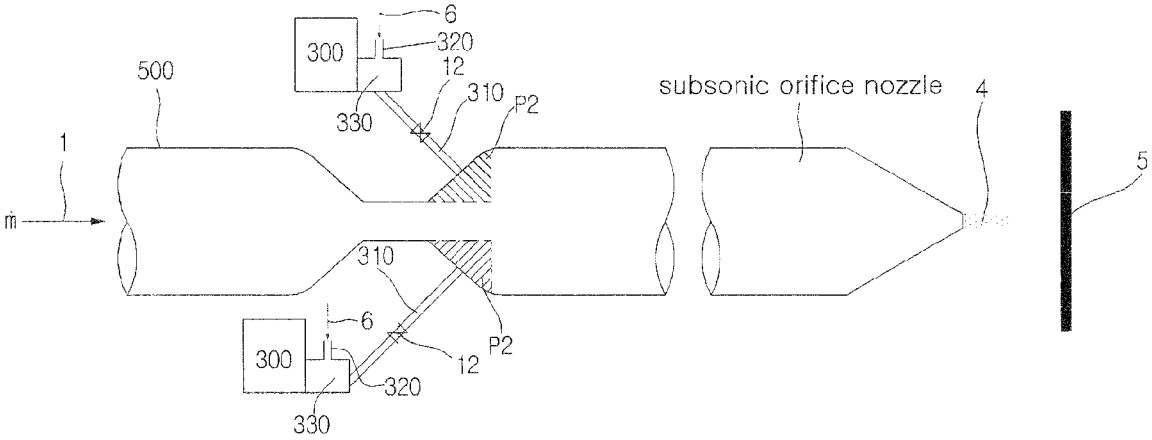
FIG. 17 is a drawing explaining a second embodiment of two feeders connected to the region shaded by slanted lines in the second section of a carrier pipe and a subsonic orifice nozzle connected to the end of a carrier pipe.

A diameter of the carrier pipe in the third section is uniform. In the end of the third section a subsonic orifice nozzle can be connected as shown in [FIG. 15] and [FIG. 17] or a supersonic de-Laval nozzle as shown in [FIG. 16] and [FIG. 18] optionally to spray the powder entrained on the carrier air on a substrate. (The subsonic orifice nozzle has the shape that the cross-sectional area of it decreases from the end of the third section to the outlet of the nozzle at a certain ratio. The supersonic de-Laval nozzle has the shape that the cross-sectional area of it decreases up to the throat and then increases at a certain ratio.

But when velocity of the powder entrained on the carrier air is supersonic in the third section, pressure (P3) of the third section is much lower than pressure (P1) of the first section. In terms of composition of the apparatus, not only is it uneconomical, but spraying could not operate normally depending on the cross-sectional area of the nozzle outlet (in the case of subsonic orifice nozzle) or of the nozzle throat (in the case of the supersonic de-Laval nozzle) when the subsonic orifice nozzle or the supersonic de-Laval nozzle is connected to the end of the third section. It, therefore, is desirable that velocity of the powder entrained on the carrier air in the third section is subsonic.

The relation between velocity of the powder entrained on the carrier air in the third section and the kind of a nozzle connected to the end of the third section can be explained as follows:

(1) When velocity of the powder entrained on the carrier air in the third section is subsonic (M<1) and the subsonic orifice nozzle is connected to the end of the third section, Spray velocity becomes subsonic regardless of the cross-sectional area (A4) of the outlet of the subsonic orifice nozzle and the cross-sectional area (A*) of the ② area in the second section.

(2) When velocity of the powder entrained on the carrier air in the third section is subsonic (M<1) and the supersonic de-Laval nozzle is connected to the end of the third section, If the cross-sectional area (A5) of the throat of the supersonic de-Laval nozzle is bigger than it (A*) of the ② area in the second section, spray velocity becomes subsonic because the mass flow rate passing through (A*) is not chocked in (A5). If (A5) is smaller than A* or equals it, spray velocity becomes supersonic.

(3) When velocity of the powder entrained on the carrier air in the third section is supersonic (M>1) and the subsonic orifice nozzle is connected to the end of the third section, Spray velocity becomes subsonic regardless of the cross-sectional area (A4) of the outlet of the subsonic orifice nozzle and the cross-sectional area (A*) of the ② area in the second section.

(4) When velocity of the powder entrained on the carrier air in the third section is supersonic (M>1) and the supersonic de-Laval nozzle is connected to the end of the third section, If the cross-sectional area (A5) of the throat of the supersonic de-Laval nozzle is bigger than it (A*) of the ② area in the second section, spray velocity becomes subsonic because the mass flow rate passing through (A*) is not chocked in (A5). If (A5) is smaller than A* or equals it, velocity of the powder entrained on the carrier air changes into subsonic and spray velocity becomes supersonic.

As shown in [Table 4], in order for the powder to be sprayed normally regardless of shapes of the subsonic orifice nozzle or the supersonic de-Laval nozzle when velocity of the powder entrained on the carrier air is subsonic or supersonic, the cross-sectional area (A*) of the ② area in the second section must equals or be bigger than it (A4) of the outlet of the subsonic nozzle or it (A5) of the throat of the supersonic de-Laval nozzle. When the conditions are satisfied, the subsonic or supersonic spray can be normally achieved without any shock wave inside the nozzle.

TABLE 4

| Velocity in the third section | Subsonic orifice nozzle | | Supersonic de-Laval nozzle | |
|---|---|---|---|---|
| | A4 > A* | A4 ≤ A* | A5 > A* | A5 ≤ A* |
| Subsonic(M < 1) | Subsonic spray | Subsonic spray | Subsonic spray | Supersonic spray |
| Supersonic (M > 1) | Slow subsonic spray (shock wave inside nozzle) | As velocity becomes subsonic in third section, subsonic spray (sonic velocity (M = 1) in throat) | Subsonic spray (diffuser role) | As velocity becomes subsonic in third section, supersonic spray |

In [Table 4], A* refers to the cross-sectional area of the ② area in the second section, A4 refers to the cross-sectional area of the outlet of the subsonic nozzle, and A5 refers to the cross-sectional area of the outlet of the supersonic nozzle.

V. A Method for Continuous Powder Coating

Continuous powder coating of the present invention can be achieved through the embodiments of the above-described apparatuses for continuous powder coating. The detailed explanation of each process is as follows:

(a) process is the one that air is sucked in and stored. When the air pump pumps in the air, temperature of the sucked-in air increases because of heat generated by the air pump. It is desirable for the sucked-in air to be cooled by about 40% of the temperature.

(b) process is the one that the sucked-in air is filtered, dried, and flowed out at a certain flow rate. The process is conducted in stages as follows:

I) A stage filtering impurity of the sucked-in air;

II) A stage drying moisture of the filtered air through dryer;

III) A stage filtering the air transported through the primary dryer secondly by a dewater filter, an oil filter, and a dust filter;

IV) A stage drying moisture of the secondly filtered air through the secondary dryer;

V) A stage flowing out the purified air by the flow rate controller;

The above-described stages can be conducted by the air treatment unit of the powder continuous coating apparatus and also control velocity of the powder entrained on the carrier air in the following (e) process by adjusting the flow rate of the air.

(c) process is the one that the powder entrained on the carrier air with the fixed density of mixture is formed by providing powder to the air that has passed (b)process. In this process, the flow rate of the air transported after (b)process is controlled by the flow control valve and the amount of the powder is controlled by the feeder. As a result, the powder entrained on the carrier air dispersed uniformly and constantly is formed.

(d) process is the one that uniformly controls density, velocity, and the flow rate of the powder entrained on the carrier air and continuously transports it. A pressure gauge can be installed in the carrier pipe to check the flow rate of the powder entrained on the carrier air per minute and distribution of the velocity.

(e) process is the one that the powder entrained on the carrier air is sprayed on a substrate in the vacuum coating chamber through the nozzle with uniform pressure distribution and spray velocity. The nozzle fitting in the width of a substrate is necessary to uniformly coat a large size substrate and it must have even pressure distribution and constant spraying velocity. The coating chamber can be kept at a low vacuumed state by the vacuum pump and the residual powder inside the coating chamber which is not coated on a substrate can be ejected and collected by the ventilation pump. And the aerodynamic drag impeding coating, therefore, is eliminated and the coating noise reduces. Also, the control of spray velocity of the powder entrained on the carrier air can be linked to the control of the flow rate of the air streaming in (b)process. The (e)process can be conducted simultaneously with the process ejecting the residual powder in the coating chamber.

The present invention provides the continuous powder coating method which can improve the quality of coating by eliminating the thermal shock on a substrate beforehand when a subsonic orifice nozzle or a supersonic de-Laval nozzle sprays the powder. For this purpose, the (a)process can be added by the process to compress the air after it is sucked in and the (b)process can include the process to compensate temperature drop of the carrier air by heating it beforehand. When the size of powder is micrometer, the (c)process can additionally include the process cooling powder before it forms the powder entrained on the carrier air as much as temperature dropped ($\Delta T_m$) after the carrier air passes a subsonic orifice nozzle or a supersonic de-Laval nozzle and temperature of the powder, therefore, becomes the same as it of the carrier air.

The detailed explanation of controlling temperature according to spray velocity of powder and the size of the powder particle is as followings:

(1) Temperature control method for eliminating thermal shock on a substrate when spray velocity is supersonic.

① When the size of the powder particle is micrometer;

After heating the carrier air, powder is cooled before reaching the supersonic de-Laval nozzle as much as temperature dropped ($\Delta T_m$) after the carrier air passes the supersonic nozzle, and temperature of the powder, therefore, becomes the same as one of the carrier air and thermal shock on a substrate does not occur. Temperature of the powder entrained on the carrier air at the outlet of the nozzle (Temperature of the carrier air and the powder) is controlled within the range where thermal shock does not occur.

Figure 37:
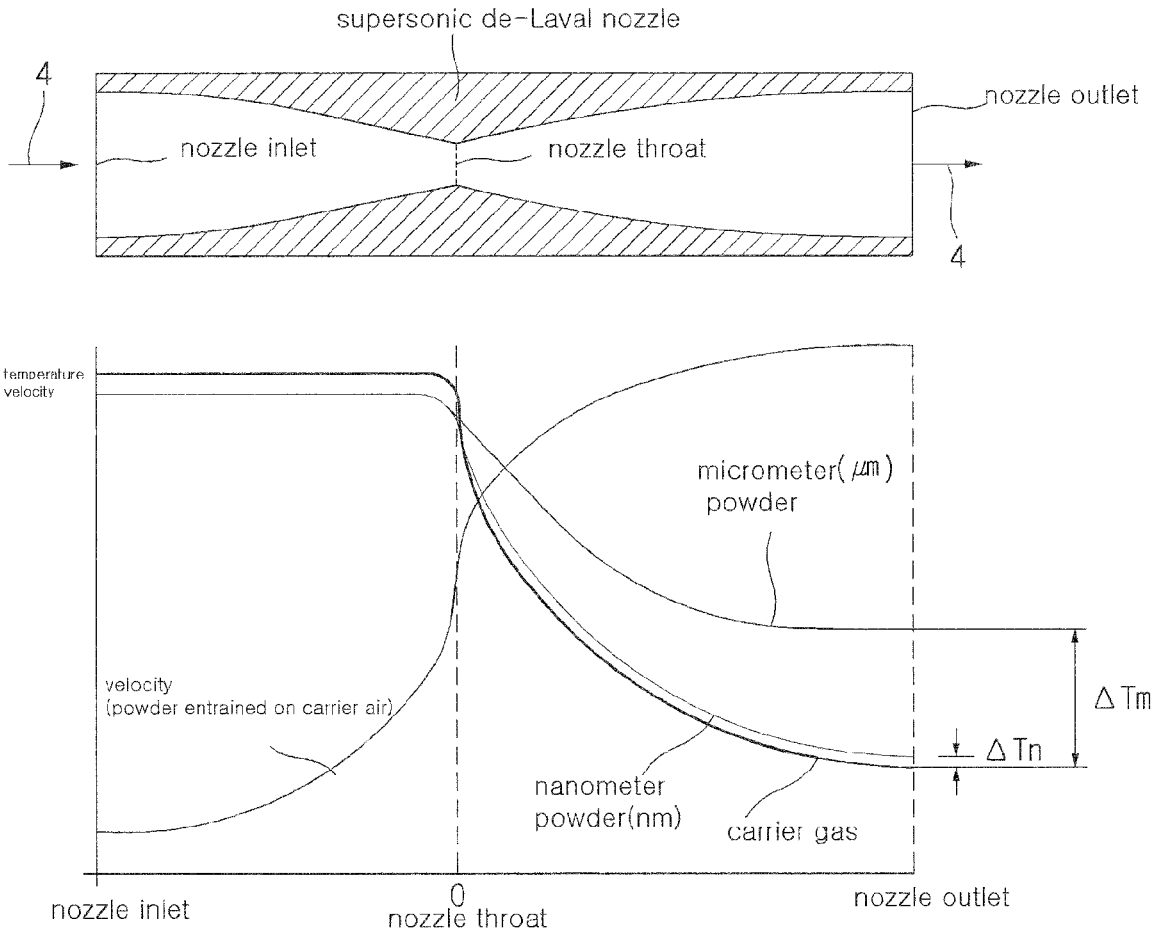
FIG. 37 is a graph showing changes of spraying velocity and temperature according to cross-sectional areas of a supersonic de-Laval nozzle.

② When the size of the powder particle is nanometer;

Unlike the case of the micrometer particle, the carrier air is only heated and the powder is not necessary to be heated because, as shown in [FIG. 37], temperature of the carrier air at the outlet of the supersonic de-Laval nozzle is similar to it of nanometer powder ($\Delta T_m$ is smaller than $\Delta T_m$ relatively). As mentioned above, temperature of the powder entrained on the carrier air at the outlet of the nozzle is controlled within the range where thermal shock does not occur.

(2) Temperature control method for eliminating thermal shock on a substrate when spray velocity is subsonic.

Figure 36:
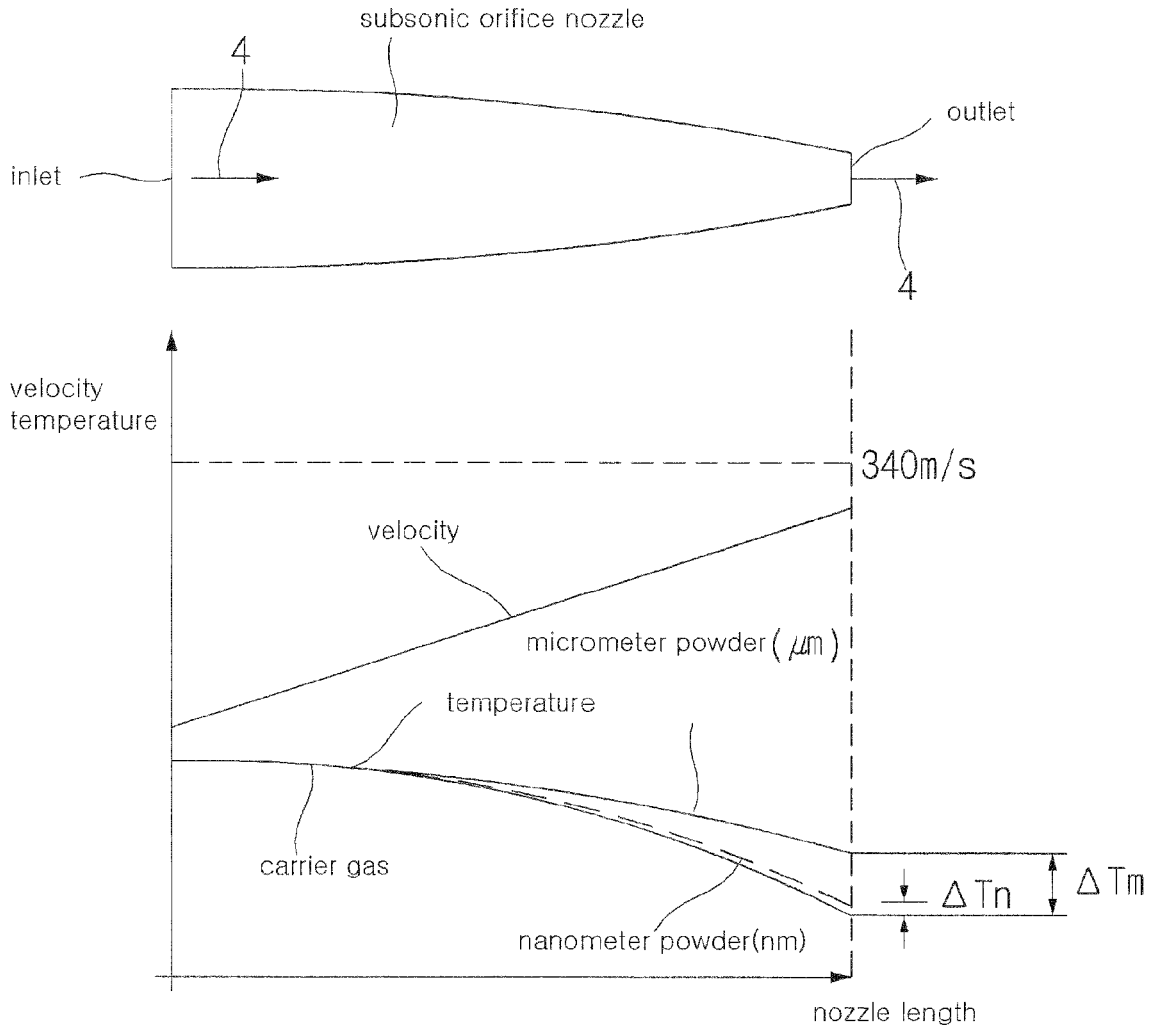
FIG. 36 is a graph showing spraying velocity of a subsonic orifice nozzle and temperature change in the inside of it.

① When the size of the powder particle is micrometer;

As shown in [FIG. 36], there is little necessity of cooling the powder when its size is a few micrometers because $\Delta T_m$ is small relatively. On the other hand, the powder should be cooled when its size is hundreds of micrometers because $\Delta T_m$ is big relatively. As a result, whether or not the powder is heated depends on the size of the powder particle.

② When the size of the powder particle is nanometer;

As shown in [FIG. 36], the nanometer powder is not necessary to be heated as its temperature changes the same as it of the carrier air. And the thermal shock on a substrate can be eliminated by only heating the carrier air.

Temperature of the carrier air at the outlet of the nozzle is controlled beforehand before the inlet of the nozzle within the range where thermal shock does not occur.

In the present invention, the carrier air and the powder entrained on the carrier air flow along the following processes. They flows the carrier pipe (500) divided into the five sections such as a first section, a second section, a third section, a fourth section, and a fifth section. Each pipe diameter of the first section, the third, and the fifth does not change, but the second and the fourth have a throat in the middle of each pipe and their pipe diameters gradually scale down moving toward a throat from the ends of each section (converging and diverging parts). The throat of the fourth section is bigger than it of the second section. The above (a) process has a stage compressing the sucked-in air with higher pressure than atmospheric pressure, and (b) process includes a stage lowering pressure of the carrier air transported to the first section and controlling shock wave to be happened in the throat of the fourth section, and the (c) process is the one that powder at atmospheric pressure is transported to the third section of the carrier pipe.

Figure 8:
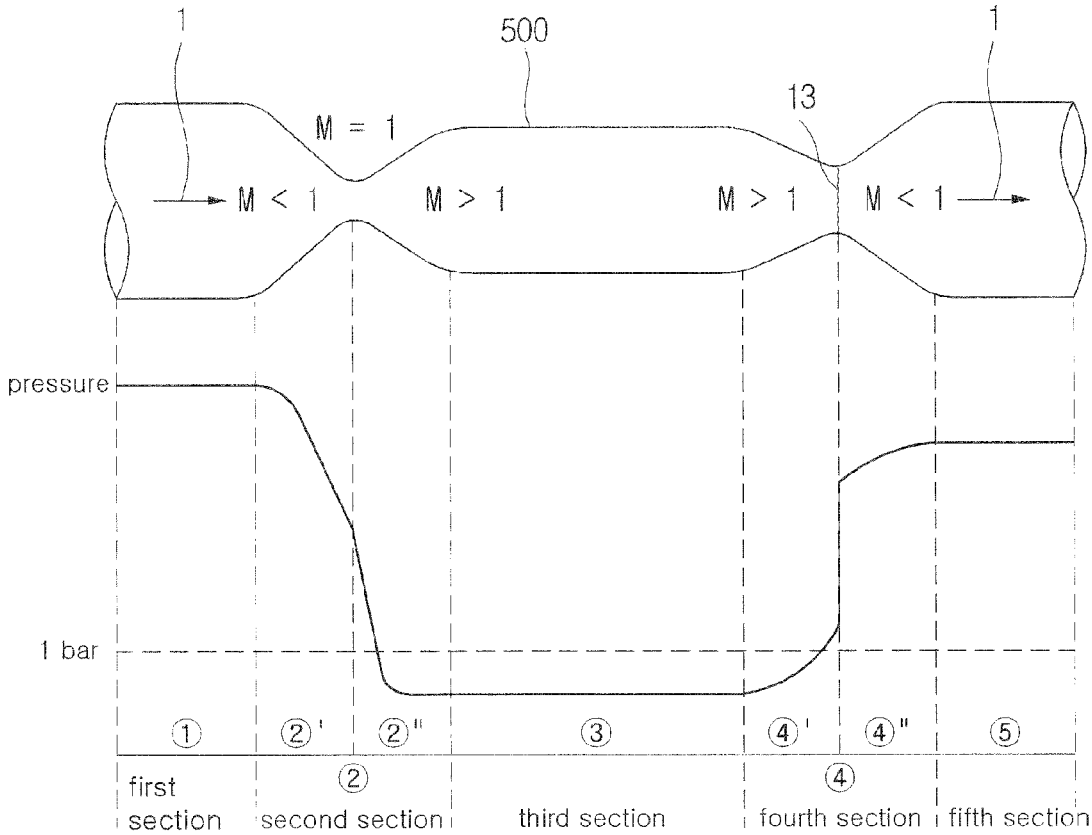
FIG. 8 is a graph showing the relation between a change of a cross section area of a carrier pipe and a change of pressure inside the carrier pipe.

As shown in [FIG. 7] and [FIG. 8], according to the above processes, the subsonic carrier air with higher pressure than atmospheric pressure is flowed in to the first section (①) and then its pressure decreases and its velocity is near-sonic as it passes through the converging ②' area in the second section and its pressure continuously decreases, but its velocity becomes supersonic as it passes through the diverging ②" area in the second section. And minus pressure, therefore, is formed as it passes the third section and as pressure of the carrier air transported to the first section (①) is lowered, the shock wave (13) can occur at the throat of the fourth section (④). At this moment, the powder at atmospheric pressure can be fed in to the third section (③) and it has the powder entrained on the carrier air. The powder entrained on the carrier air keeps the supersonic velocity and its pressure starts to increase at the converging area (④'). But its pressure in the diverging area (④) rapidly increases because of the shock wave occurred at the throat in the fourth section, and its velocity becomes subsonic, and finally the powder entrained on the carrier air is transported to the nozzle through the fifth section.

In order for the shock wave to occur at the throat of the fourth section, the pressure gauge which can check that pressure steeply increases at the interface of the throat in the fourth section is installed in the carrier pipe. When pressure drops steeply, the process lowering pressure of the carrier air in the first section (①) is stopped. Consequently, the powder in the feeder (300) can be coated on a large substrate uniformly as a fixed small amount of the powder is continuously fed in to the third section (③) for a certain time.

Also, in order for temperature of the carrier air passing the third section to remain above freezing, temperature of the carrier air passing the first section can be controlled or Mach number of the carrier air passing the third section. The detailed explanation of it was described above.

In the present invention, as shown in [FIG. 13] and [FIG. 14], the carrier pipe (500) can be also divided into three sections; the first section that a diameter of a pipe is uniform up to one point and then scales down, the second section that a diameter is uniform up to one point and then scales up, the third section that keeps a uniform diameter of a pipe. The above (a) process has a stage compressing the sucked-in air with higher pressure than atmospheric pressure and the (b) process includes a stage that minus pressure is formed in the second section of the carrier pipe as the pressurized air is transported to the first section of the carrier pipe. The (c) process is the one that powder at atmospheric pressure is transported to the second section of the carrier pipe.

According to the ratio of cross-sectional areas of the parts with the uniform diameter in the first section and the second section of the carrier pipe and mass flow rate of the carrier air, velocity of the carrier air transported to the first section and pressure of the carrier pipe can be set by application of (Equation 1) to (Equation 4) and as a result, minus pressure can be formed in the second section. (Equation 1) to (Equation 4) are explained above.

The present invention has been mainly described with regard to the drawings attached in the present invention, but it could be modified and changed within the essential idea of the present invention and applied to a variety of fields. The claim range of the present invention, therefore, includes modification and changes based on it.

Industrial Applicability

Applications to which a powder continuous coating apparatus can be applied are as follows:

1. Translucent or transparent conductive electrodes coated by powder (carbon nanotube, ITO (Indium Tin Oxide), etc.)
2. FED (Field Emission Display) and BLU (Backlight unit) coated by carbon nanotube powder
3. High efficiency lighting equipments coated by carbon nanotube powder
4. Solar cells coated by powder
   Silicon solar cell
   III-V compound GaAs, InP sola cell
   CIGS (CGS, CIS), CdTe solar cell
   Quantum dot solar cell
5. Quantum dot semiconductor diode coated by powder
6. Semiconductor circuit coated by powder (carbon nanotube, copper, etc.)
7. Electromagnetic shielding materials coated by powder
8. High efficiency heating element coated by powder
9. High efficiency sensor coated by powder
10. Flexible displayer coated by powder
11. Electrostatic disperser coated by powder
12. High molecular composites and ultralight and high strength composites coated by carbon nanotube
13. Dielectric coated by powder
14. Magnetically conducting material coated by powder
15. Antifriction material coated by powder
16. Corrosion-resistance material coated by powder
17. Surface hardening material coated by powder
18. Secondary cell material coated by powder 19. Supercapacitor material coated by powder
20. Light emitting diode material coated by powder
21. Anti-static material coated by powder, and so on.

What is claimed is:

1. A method of continuous powder coating, comprising the steps of:

(a) Sucking in and storing air;

(b) filtering and drying the sucked-in air, transporting the air, adjusting flow of the air, and controlling pressure in a vacuum coating chamber;

(c) entraining a powder sucked from an atmospheric pressure environment on a carrier air that has gone through step (b) while a minus pressure is formed in a specific section of a carrier pipe;

(d) transporting the powder entrained on the carrier air continuously in the condition of uniform density, velocity, and the flow rate; and (e) spraying the powder entrained on the carrier air on a substrate in the vacuum coating chamber through a spray nozzle with uniform pressure distribution and spray velocity.

2. A method for continuous powder coating according to claim 1, wherein said step (e) comprises: discharging and collecting an uncoated powder remained in said vacuum coating chamber after coating a substrate.

3. A method for continuous powder coating according to claim 1, wherein said step (a) comprises pressurizing air, wherein said step (b) comprises preventing temperature drop of the carrier air from being dropped by heating it beforehand, wherein said spray nozzle is a subsonic nozzle or a supersonic de-Laval nozzle.

4. A method for continuous powder coating according to claim 3, wherein said step (c) comprises cooling powder before the powder is entrained on the carrier air which is necessary to reduce a difference ($\Delta t_m$) of temperatures between the powder and the carrier air after both of them pass a subsonic nozzle or a supersonic nozzle and thus to prevent thermal shock on a substrate, wherein the powder size is from about a several nanometer to several micrometers.

5. A method for continuous powder coating according to claim 1, wherein the sucked-in air and the powder entrained on the carrier air flow through the carrier pipe divided into the five sections such as a first section, a second section, a third section, a fourth section, and a fifth section, that each pipe diameter of the first section the third and the fifth does not change, but the second and the fourth have a throat in the middle of each pipe and their pine diameters gradually scale down moving toward a throat from the ends of each section ,(converging and diverging parts), and the throat of the fourth section is bigger than one of the second section, wherein said step (a) comprises compressing the sucked-in gas with higher pressure than atmospheric pressure, wherein said step (b) comprises lowering pressure of the carrier gas transported into the first section, controlling shock wave to be happened in the throat of the fourth section, wherein said step (c) comprises transporting powder sucked from the atmospheric pressure environment on carrier air higher than atmospheric pressure as forming the third section with minus pressure (negative pressure) in said carrier pipe, wherein the sucked-in air and the powder entrained on the carrier air flow through the carrier pipe divided into the five sections such as a first section, a second section, a third section, a fourth section, and a fifth section, that each pipe diameter of the first section, the third, and the fifth does not change, but the second and the fourth have a throat in the middle of each pipe and their pipe diameters gradually scale down moving toward a throat from the ends of each section (converging and diverging parts), and the throat of the fourth section is bigger than one of the second section.

6. A method for continuous powder coating according to claim 5, wherein step (b) comprises controlling temperature of air passing the first section of said carrier pipe to make temperature of air passing the third section of the carrier pipe remained above freezing.

7. A method for continuous powder coating according to claim 5, wherein said step (b) comprises checking if pressure in the throat of the fourth section increases by a pressure gauge linked to said carrier pipe.

8. A method for continuous and uniform powder coating according to claim 5, wherein said step (b) comprises controlling a Mach number of air passing through the third section of a carrier pipe so that temperature of the air passing through the third section of a carrier pipe may be kept above freezing.

9. A method for continuous powder coating according to claim 1, wherein said step (a) comprises compressing the sucked-in air with higher pressure than atmospheric pressure, wherein said step (b) comprises forming a minus pressure area in the second section of the carrier pipe by transporting the compressed air to the first section of the carrier pipe, wherein said step (c) comprises feeding powder sucked from the atmospheric pressure environment into the second section of said carrier pipe, wherein the sucked-in air and the powder entrained on the carrier air flow through the first section of the carrier pipe that the diameter of the carrier pipe is uniform up to one point and converges at a certain ratio, the second section that the diameter of the pipe is uniform up to one point and then diverges at a certain ratio, and the third section that has the uniform diameter of the pipe.

10. A method for continuous powder coating according to claim 9, wherein, said step (b) comprises forming minus pressure at the second section of said carrier pipe as setting ratio of cross-sectional area ratio between the first section and the second section and flow rate streaming through the first section.

* * * * *

UNITED STATES PATENT AND TRADEMARK OFFICE

CERTIFICATE OF CORRECTION

PATENT NO. : 8,936,830 B2
APPLICATION NO. : 13/764670
DATED : January 20, 2015
INVENTOR(S) : Kim et al.

It is certified that error appears in the above-identified patent and that said Letters Patent is hereby corrected as shown below:

Delete title page with illustrative figure and substitute new title page with illustrative figure. (attached)

Title page

Item (12) delete "Kim" and insert -- Kim et al. --
Item (72) Inventors: should read -- Ok Ryul Kim and Ok Min Kim --.

Signed and Sealed this
First Day of December, 2015

Michelle K. Lee

Michelle K. Lee
*Director of the United States Patent and Trademark Office*

(12) United States Patent
Kim

(10) Patent No.: US 8,936,830 B2
(45) Date of Patent: Jan. 20, 2015

(54) APPARATUS AND METHOD FOR CONTINUOUS POWDER COATING

(71) Applicant: FEMVIX Co. Ltd., Seongnam-si (KR)

(72) Inventor: Ok Ryul Kim, Yongin-si (KR)

(73) Assignees: FEMVIX Corp., Jung-dong, Giheung-gu, Yongin-si, Gyeonggi-do (KR); Ok Ryul Kim, Gongse-dong, Giheung-gu, Yongin-si, Gyeonggi-do (KR); Ok Min Kim, Geumgok-ri, Jinjeop-eup, Namyangju-si, Gyeonggi-do (KR)

( * ) Notice: Subject to any disclaimer, the term of this patent is extended or adjusted under 35 U.S.C. 154(b) by 0 days.

(21) Appl. No.: 13/764,670

(22) Filed: Feb. 11, 2013

(65) Prior Publication Data

US 2013/0149471 A1 Jun. 13, 2013

Related U.S. Application Data

(62) Division of application No. 12/999,058, filed on Dec. 14, 2010.

(51) Int. Cl.
*B05D 1/12* (2006.01)
*C23C 24/04* (2006.01)

(52) U.S. Cl.
CPC ..... *B05D 1/12* (2013.01)
USPC ..... 427/190; 427/294; 427/421.1

(58) Field of Classification Search
USPC ..... 427/190, 294, 421.1
See application file for complete search history.

(56) References Cited

U.S. PATENT DOCUMENTS

2007/0074656 A1* 4/2007 Zhao et al. ..... 118/308
2007/0160769 A1* 7/2007 Maev et al. ..... 427/446

* cited by examiner

*Primary Examiner* — Frederick Parker
(74) *Attorney, Agent, or Firm* — John K. Park; Park Law Firm

(57) ABSTRACT

The present invention relates to a method and an apparatus by which powder is evenly dispersed and is coated on a substrate uniformly and continuously so that a uniform layer may be formed. More specifically the present invention provides a method and an apparatus for forming a coating layer that powder is coated on an entire surface of a substrate uniformly and continuously, regardless of the material or the size of the substrate, as a uniform amount of powder entrained on the carrier air which is generated by carrier air and powder transported to a carrier pipe at a certain rate is consistently fed in to a nozzle, regardless of the size, morphology, and specific weight of the powder particles.

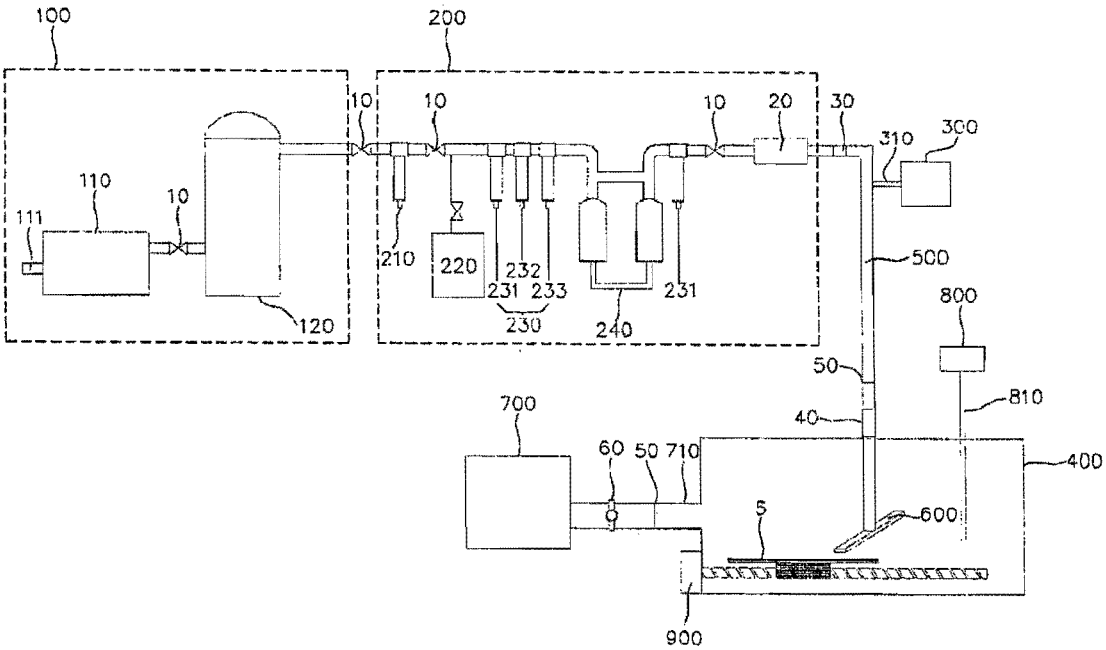

10 Claims, 27 Drawing Sheets